US011104532B2

(12) United States Patent
Machida

(10) Patent No.: US 11,104,532 B2
(45) Date of Patent: Aug. 31, 2021

(54) DOCUMENT FEEDING DEVICE

(71) Applicant: CANON DENSHI KABUSHIKI KAISHA, Chichibu (JP)

(72) Inventor: Takashi Machida, Tokyo (JP)

(73) Assignee: Canon Denshi Kabushiki Kaisha, Chichibu (JP)

( * ) Notice: Subject to any disclaimer, the term of this patent is extended or adjusted under 35 U.S.C. 154(b) by 0 days.

(21) Appl. No.: 16/202,850

(22) Filed: Nov. 28, 2018

(65) Prior Publication Data

US 2019/0135564 A1 May 9, 2019

Related U.S. Application Data

(63) Continuation of application No. PCT/JP2017/020236, filed on May 31, 2017.

(30) Foreign Application Priority Data

Jun. 2, 2016 (JP) ..... JP2016-110626
Apr. 25, 2017 (JP) ..... JP2017-085764

(51) Int. Cl.
*B65H 3/52* (2006.01)
*B65H 3/06* (2006.01)
(Continued)

(52) U.S. Cl.
CPC ..... *B65H 3/0607* (2013.01); *B65H 1/04* (2013.01); *B65H 3/0653* (2013.01);
(Continued)

(58) Field of Classification Search
CPC ..... B65H 3/063; B65H 3/0669; B65H 3/56; B65H 3/34; B65H 3/5276; B65H 3/5284; B65H 3/523; B65H 3/5238
See application file for complete search history.

(56) References Cited

U.S. PATENT DOCUMENTS 4,239,203 A 12/1980 Uchida
5,277,416 A * 1/1994 Kim ..... B65H 3/063 271/119
(Continued)

FOREIGN PATENT DOCUMENTS

CN 1258863 A 7/2000
CN 101506073 A 8/2009
(Continued)

OTHER PUBLICATIONS

International Search Report and Written Opinion dated Jul. 11, 2017, in International Application No. PCT/JP2017/020236.
(Continued)

*Primary Examiner* — Luis A Gonzalez
(74) *Attorney, Agent, or Firm* — Venable LLP

(57) ABSTRACT

A document feeding device includes a feeding unit feeding documents from a batch of documents on a placing tray, a separation member in pressure contact with the feeding unit and separating documents one by one, a separation swinging member supporting the separation member and displaceable in a thickness direction of the batch of documents, and a movable member supported as to be displaceable with respect to the separation swing member in the thickness direction of the batch of documents, and entering a space formed between the separation member and a document.

10 Claims, 33 Drawing Sheets

(51) Int. Cl.

| | |
|---|---|
| ***B65H 7/12*** | (2006.01) |
| ***B65H 3/56*** | (2006.01) |
| ***B65H 1/04*** | (2006.01) |

(52) U.S. Cl.

CPC ..... *B65H 3/0669* (2013.01); *B65H 3/0684* (2013.01); *B65H 3/5284* (2013.01); *B65H 3/56* (2013.01); *B65H 7/12* (2013.01); *B65H 2402/31* (2013.01); *B65H 2402/46* (2013.01); *B65H 2403/72* (2013.01); *B65H 2404/133* (2013.01); *B65H 2404/623* (2013.01)

(56) References Cited

U.S. PATENT DOCUMENTS

| | | | | |
|---|---|---|---|---|
| 5,718,424 | A * | 2/1998 | Nakatani | B65H 3/5238 271/121 |
| 6,568,668 | B1 | 5/2003 | Wakabayashi et al. | |
| 8,087,661 | B2 | 1/2012 | Iwami et al. | |
| 8,876,103 | B2 | 11/2014 | Kasashima et al. | |
| 9,181,050 | B2 | 11/2015 | Machida et al. | |
| 9,242,815 | B2 | 1/2016 | Okumura et al. | |
| 2006/0220300 | A1* | 10/2006 | Nakakita | B65H 3/0676 271/121 |
| 2008/0203652 | A1* | 8/2008 | Yasukawa | B65H 3/063 271/117 |
| 2016/0257511 | A1 | 9/2016 | Machida et al. | |
| 2017/0107068 | A1* | 4/2017 | Kanamitsu | H04N 1/00628 |

FOREIGN PATENT DOCUMENTS

| | | | | |
|---|---|---|---|---|
| CN | 201301135 | Y | | 9/2009 |
| JP | 02-138040 | A | | 5/1990 |
| JP | 04023740 | A | * | 1/1992 |
| JP | 06156780 | A | * | 6/1994 |
| JP | 11-193139 | A | | 7/1999 |
| JP | 2001-171855 | A | | 6/2001 |
| JP | 2002-265083 | A | | 9/2002 |
| JP | 2008-207944 | A | | 9/2008 |
| JP | 2011-136800 | A | | 7/2011 |
| JP | 2014-047050 | A | | 3/2014 |
| JP | 2014-136644 | A | | 7/2014 |

OTHER PUBLICATIONS

Office Action dated Aug. 5, 2019, in Chinese Patent Application No. 201780033418.4.

Office Action dated Apr. 10, 2020, in Chinese Patent Application No. 201780033418.4.

Office Action dated Jun. 15, 2020, in Japanese Patent Application No. 2018-520954.

* cited by examiner

DOCUMENT FEEDING DEVICE

This application is a continuation of International Patent Application No. PCT/JP2017/020236 filed on May 31, 2017, and claims priority to Japanese Patent Application No. 2016-110626 filed on Jun. 2, 2016 and Japanese Patent Application No. 2017-085764 filed on Apr. 25, 2017, the entire contents of which are incorporated herein by reference.

TECHNICAL FIELD

The present invention relates to a document feeding device such as a document scanner, a facsimile machine, a printer, and a copying machine.

BACKGROUND ART

As a document feeding device of the related art, there has been a device that separates document, fed by a feeding roller, one by one by a separation roller, conveys the separated document by a conveying roller, and reads images of the document by a reading sensor. When a batch of documents having a thin thickness is fed by the abovementioned document feeding device of the related art, there have been cases where the batch of documents plunges into a nip (hereinafter referred to as a "feed nip") at which the feeding roller and the separation roller come into contact with each other, thereby causing a leading edge of the document to be curled or a paper jam depending on the state in which the batch of documents enters the feed nip.

In Japanese Patent Laid-Open No. 2014-136644, there is disclosed a configuration that prevents the buckling of a medium by including a closing unit on the upstream side of a nip region in order to suppress the jam of the medium. However, depending on the conveyed medium, there has been a fear that the document is not fed due to a load received by the conveyed document at the closing unit.

SUMMARY OF INVENTION

According to an aspect of the present invention, there is provided a document feeding device comprising: a feeding unit configured to feed a document from a batch of documents on a placing tray; a separation member configured to be in pressure contact with the feeding unit and configured to separate documents one by one; a separation swinging member configured to be support the separation member and displaceable in a thickness direction of the batch of documents; and a movable member configured to be supported so as to be displaceable with respect to the separation swinging member in the thickness direction of the batch of documents, and configured to enter a space formed between the separation member and a document.

Further features of the present invention will become apparent from the following description of exemplary embodiments (with reference to the attached drawings).

DESCRIPTION OF EMBODIMENTS

Figure 1:
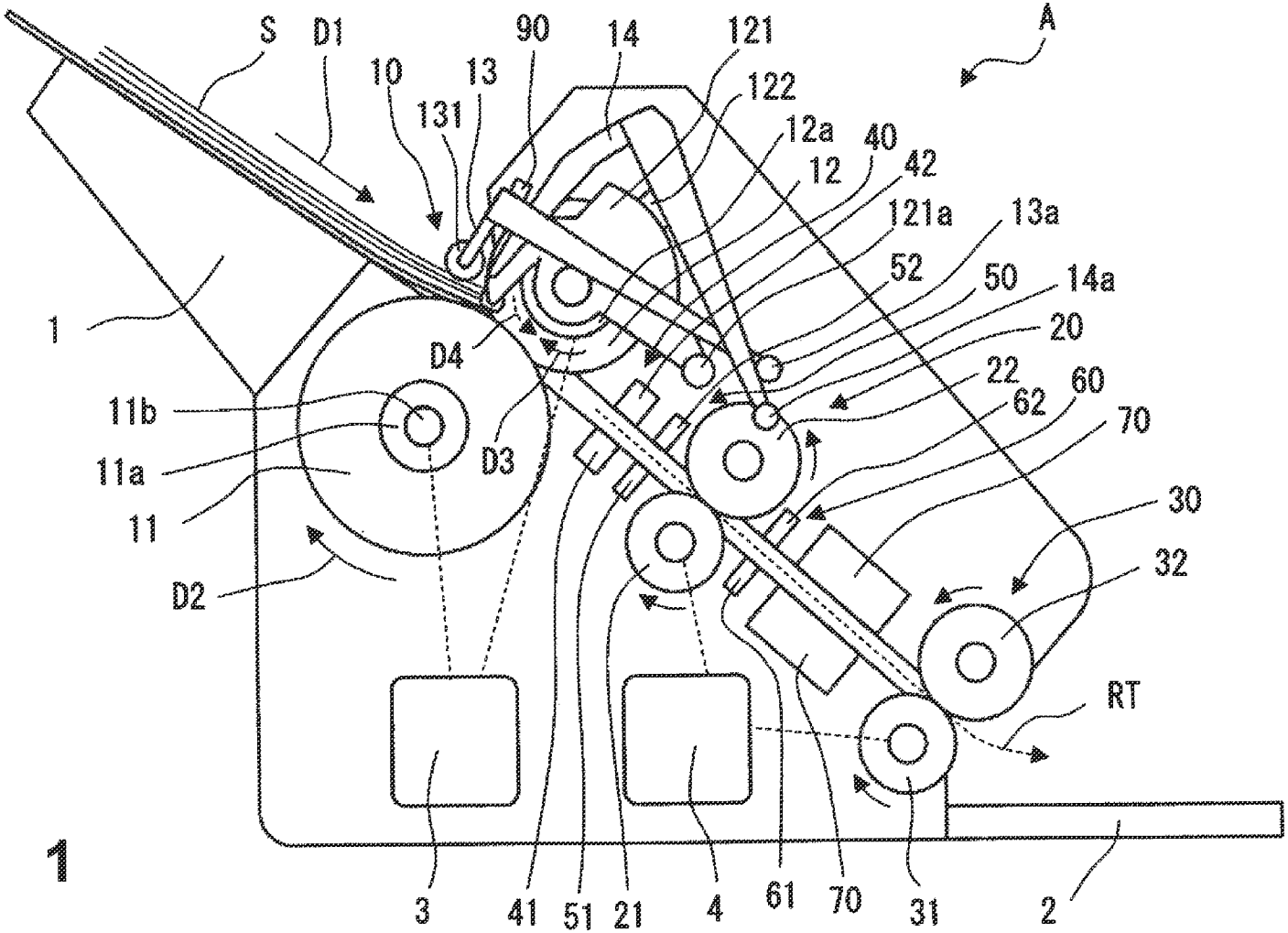
FIG. 1 is a schematic cross-sectional view of a document feeding device (conveying state) according to Embodiment 1 of Embodiment A.

Embodiments of the present invention are described below with reference to the drawings. The embodiments below are broadly divided into Embodiment A and Embodiment B. Embodiment A includes Embodiment 1 to Embodiment 4. Embodiment B includes Embodiment 1 and Embodiment 2. The embodiments and modified examples and the like included in the embodiments can be combined with each other, as appropriate. In addition, the present invention can be configured by a single mode or a single example of the embodiments and modified examples and the like included in the embodiments. Note that reference characters denoting the configurations are only uniformly used in each group, that is, a group of Embodiment A and a group of Embodiment B. Therefore, for example, the same reference character as the reference character in Embodiment A may be used as a reference character denoting another configuration in Embodiment B.

Embodiment A

Embodiment 1

Embodiment 1 is described with reference to FIGS. 1 to 18. FIG. 1 is a schematic view of a document feeding device A according to an embodiment of the present invention.

<Configuration of Device>

The document feeding device A is a device that conveys one or more documents S loaded on a placing tray 1 one by one into the device through a route RT, reads images thereof, and outputs the documents S to an output tray 2. The documents S to be read may be sheets such as an OA paper, a bill, a check, a business card, and cards, for example, and may be a thick sheet or a thin sheet. The cards can include an insurance card, a license, a credit card, and the like, for example.

<Feeding>

Figure 2:
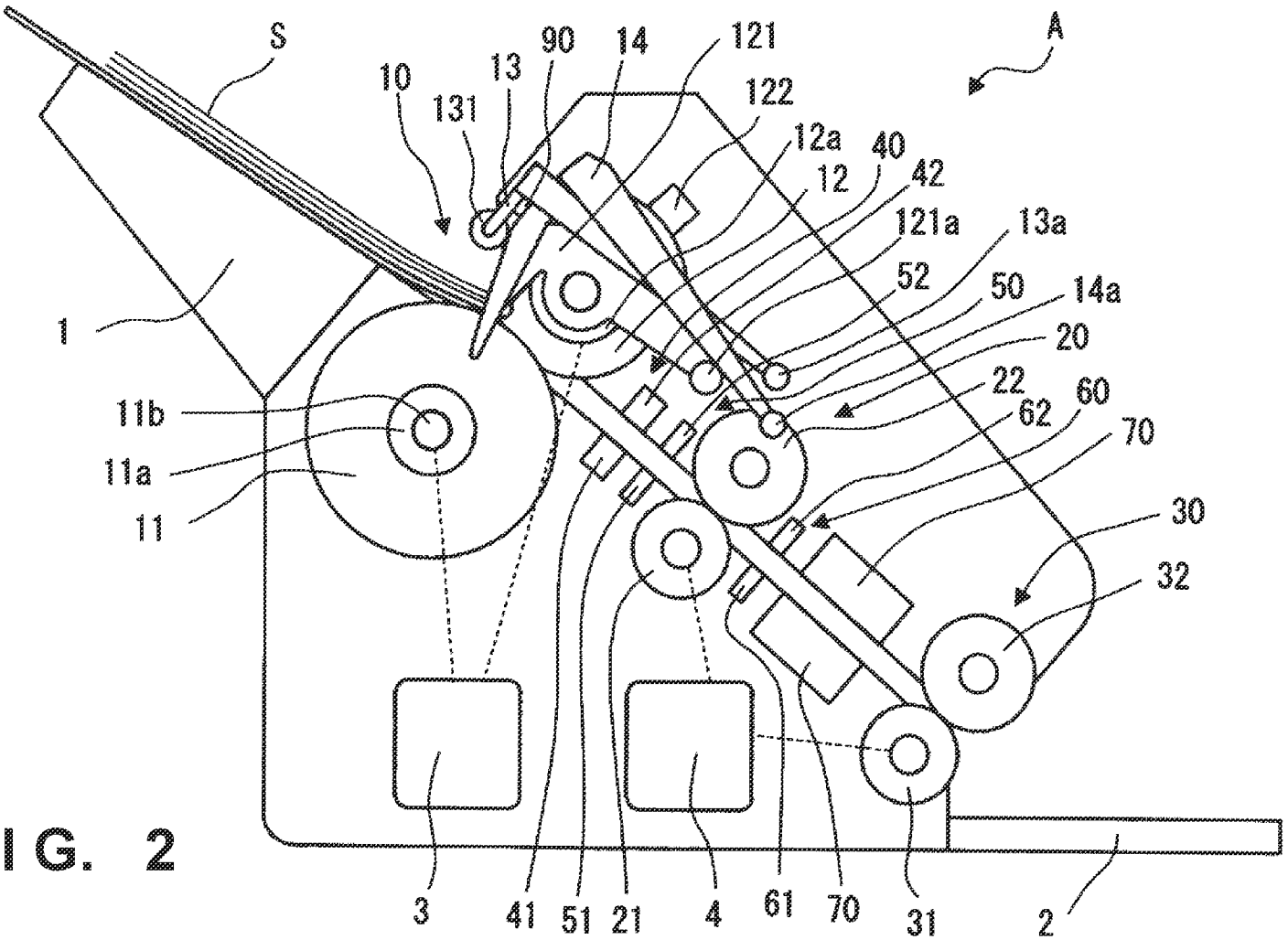
FIG. 2 is a schematic cross-sectional view of the document feeding device (standby state) in FIG. 1.

As illustrated in FIG. 1, a first conveyance unit 10 serving as a feed mechanism that feeds the documents S along the route RT is provided. In this embodiment, the first conveyance unit 10 includes feeding rollers 11 and separation rollers 12 placed so as to face the feeding rollers 11, and sequentially conveys the documents S on the placing tray 1 one by one in a feeding direction D1. Note that FIG. 1 illustrates a conveying state while FIG. 2 illustrates a standby state. In this embodiment, the feeding direction D1 is provided so as to be inclined at a predetermined angle with respect to a mounting surface of the document feeding device A. Further, by the self-weight of the documents S mounted on the placing tray 1, the document is supplied to the feed mechanism.

The feeding roller 11 are supported by a feeding roller shaft 11*b* via one-way clutches 11*a*. The drive force of a motor 3 is transmitted to the feeding roller shaft 11*b* via a drive transmission unit (not shown) and the feeding rollers 11 are driven via the one-way clutches 11*a*. When the feeding roller shaft 11*b* rotates in the feeding direction (the direction of solid arrow D2 in FIG. 1) by driving of the motor 3, the one-way clutches 11*a* mesh with the feeding roller shaft 11*b*, and the feeding rollers 11 rotate in the feeding direction. The conveying speed of the feeding rollers 11 is set to be a speed that is slower than the conveying speed of a conveying roller 21 described below. Therefore, when the fed document S reaches the conveying roller 21 and the conveying speed of the document S increases, the mesh between the one-way clutches 11*a* and the feeding roller shaft 11*b* is released, and the feeding rollers 11 rotate together with the conveyed document S and rotate faster than the speed at which the feeding rollers 11 rotate by the drive transmission from the motor 3. In this embodiment, the one-way clutch 11*a* is individually provided for each of the plurality of feeding rollers 11 provided on the right and the left.

The feeding rollers 11 and the separation rollers 12 described below each are one unit, and are units mountable on and removable from the device. Therefore, the maintenance is easy, and the units can be replaced when the roller surface starts to wear out, for example.

<Separation>

The separation rollers 12 placed so as to face the feeding rollers 11 are rollers for separating the documents S one by one and are in pressure contact with the feeding rollers 11 at a constant pressure. In order to ensure the pressure contact state, the separation rollers 12 are supported by separation swinging members 121 as illustrated in FIG. 1. The separation swinging members 121 are rotatably supported about a shaft portion 121*a*. In addition, in order for the separation rollers 12 to be in pressure contact with the feeding rollers 11, the separation swinging members 121 is applied with a biasing force by a compression spring 122 so as to be displaceable in the thickness direction of the batch of documents orthogonal to the conveying direction. Note that, in this embodiment, the separation swinging members 121 and the separation rollers 12 are rotatably supported due to the mesh of gears for driving the separation rollers 12, but the present invention is not limited thereto. The separation swinging members 121 may be supported so as to linearly operate.

As illustrated in FIG. 1, the drive force is transmitted to the separation rollers 12 from the motor 3 via a torque limiter 12*a*, and the separation rollers 12 are driven to rotate in the direction of solid arrow D3. The transmission of the drive force to the separation rollers 12 is restricted by the torque limiter 12*a*, and hence the separation rollers 12 rotate in a direction (the direction of dashed arrow D4) of rotating together with the feeding rollers 11 when in abutment against the feeding rollers 11. As a result, when the plurality of documents S are conveyed to a portion at which the feeding rollers 11 and the separation rollers 12 are in pressure contact with each other, the plurality of documents S are held back so that two or more of the documents S are not conveyed to the downstream besides one document S.

Note that a structure using the separation rollers 12 is described in this embodiment, but the present invention is not necessarily limited to a form of a roller. The same applies to a case where a portion that applies a load to the document S in a direction opposite to the feeding direction, for example, a separation pad and the like is used, and any form of separation members may be used.

<Document Detection Structure of Feeding Unit>

In order to detect whether there are documents S on the placing tray 1, a document detection sensor 90 is provided on an upstream portion of the feeding rollers 11 as illustrated in FIG. 1. The document detection sensor 90 is a lever-type sensor. As another example, the document detection sensor 90 may be an optical sensor such as medium detection sensors 50 and 60 described below.

<Pick Arm and Document Stopper>

As in FIG. 1, the document feeding device A includes pick rollers 131 that press the document S against the feeding rollers 11 on the upstream side of a nip (hereinafter referred to as a "feed nip") at which the feeding roller 11 and the separation roller 12 come into contact with each other, and a pick arm 13 that pivotally supports the pick rollers 131. The pick rollers 131 assist the feeding of the document S by increasing the conveying force of the document S by pressing the document S against the feeding rollers 11.

In the pick arm 13, a shaft portion 13*a* of the pick arm 13 is rotatably supported by the device A, and the pick arm 13 is biased in a direction in which the pick rollers 131 are pressed against the feeding rollers 11 by a spring (not shown). By the drive force of a motor 4 described below, the pick arm 13 can be moved to a pressure contact position illustrated in FIG. 1 at which the pick rollers 131 press the document S against the feeding rollers 11, and a retraction position illustrated in FIG. 2 at which the pick rollers 131 are retracted from the feeding rollers 11.

As another configuration that assists the feeding of the feeding rollers 11, there is a configuration in which another feeding roller is provided on the upstream of the feeding rollers 11. However, the abovementioned configuration in FIG. 1 can realize the downsizing of the device and the cost reduction of the device.

As in FIG. 1, the document feeding device A includes a document stopper 14. The document stopper 14 has a function of holding back the loaded batch of documents by causing a leading edge thereof to protrude to the conveying path side in the state in FIG. 2. In the document stopper 14, a shaft portion 14*a* of the document stopper 14 is rotatably supported by the device A, and the document stopper 14 can be moved to an opening position illustrated in FIG. 1 in which the conveying path opens so that the documents S can be fed, and a closing position illustrated in FIG. 2 in which the conveying path closes so that the batch of documents does not enter the feed nip. FIG. 2 is the standby state of the document feeding device A, and the batch of documents can be set on the placing tray 1 by causing the leading edge of the batch of documents to butt against the document stopper 14 in this state.

The pick arm 13 and the document stopper 14 are driven by the motor 4 by a drive transmit mechanism (not shown). When the motor 4 drives a predetermined number of pulses in the forward direction, the pick arm 13 moves to the pressure contact position and the document stopper 14 moves to the opening position. When the motor 4 drives a predetermined number of pulses in the reverse direction, the pick arm 13 moves to the retraction position and the document stopper 14 moves to the closing position. The forward direction herein is a direction in which the conveying roller 21 and a conveying roller 31 described below are rotated so as to convey the document S in the feeding direction D1 in FIG. 1.

<Conveyance Structure>

As illustrated in FIG. 1, the second conveyance unit 20 serving as a conveying mechanism on the downstream side of the first conveyance unit 10 in the feeding direction includes the conveying roller 21 and a driven roller 22 driven by the conveying roller 21, and conveys the document S conveyed from the first conveyance unit 10 to the downstream side thereof. The drive force is transmitted to the conveying roller 21 from the motor 4, and the conveying roller 21 is driven to rotate in the direction of the solid arrow in FIG. 1. The driven roller 22 is in pressure contact with the conveying roller 21 at a constant pressure, and rotates together with the conveying roller 21.

A third conveyance unit 30 that is on the downstream side of the second conveyance unit 20 as above in the feeding direction includes the conveying roller 31 and a driven roller 32 driven by the conveying roller 31, and conveys the document S conveyed from the second conveyance unit 20 to the output tray 2. That is, the third conveyance unit 30 serves as an output mechanism. The drive force is transmitted to the conveying roller 31 from the motor 4, and the conveying roller 31 is driven to rotate in the direction of the solid arrow in FIG. 1. The driven roller 32 is in pressure contact with the conveying roller 31 at a constant pressure, and rotates together with the conveying roller 31.

<Multi-Feed Detection>

A multi-feed detection sensor 40 placed between the first conveyance unit 10 and the second conveyance unit 20 is an example of a detection sensor (a sensor that detects the behavior and the state of the documents S) for detecting, when the documents S such as paper have passed through the first conveyance unit 10 in a state in which the documents S are stuck together due to static electricity and the like (that is, in a multi-feed state in which the documents S are conveyed while overlapping with each other), the state. As the multi-feed detection sensor 40, various sensors may be used. In this embodiment, the multi-feed detection sensor 40 is an ultrasonic sensor, and includes a transmitting unit 41 for ultrasonic waves and a receiving unit 42 thereof. Further, the multi-feed detection sensor 40 detects multi-feed on the basis of the principle that the attenuation of the ultrasonic wave that passes through the documents S such as paper changes between a case where the documents S are multi-fed and a case where the documents S are conveyed one by one.

<Registration Sensor>

A medium detection sensor 50 placed on the downstream side of the multi-feed detection sensor 40 as above in the feeding direction is an example of a detection sensor (a sensor that detects the behavior and the state of the documents S) on the upstream side placed on the upstream side of the second conveyance unit 20 and the downstream side of the first conveyance unit 10. The medium detection sensor 50 detects the position of the document S conveyed by the first conveyance unit 10. In detail, the medium detection sensor 50 detects whether an edge of the document S has reached or passed through a detection position of the medium detection sensor 50. As the medium detection sensor 50, various sensors can be used. In this embodiment, the medium detection sensor 50 is an optical sensor, and includes a light-emitting unit 51 and a light-receiving unit 52 thereof. Further, the medium detection sensor 50 detects the document S on the basis of a principle that the intensity of the received light (the amount of the received light) changes when the document S reaches or passes through the medium detection sensor 50.

In this embodiment, the abovementioned medium detection sensor 50 is provided on the downstream side of the multi-feed detection sensor 40 in the vicinity thereof so that the document S reaches a position at which the multi-feed detection sensor 40 can detect multi-feed at the time point at which the leading edge of the document S is detected by the medium detection sensor 50. Note that the medium detection sensor 50 is not limited to the abovementioned optical sensor. For example, a sensor (an image sensor and the like) that can detect the edge of the document S may be used, or a lever-type sensor protruding to the route RT may be used.

A medium detection sensor 60 different from the medium detection sensor 50 is placed on the upstream side of an image reading unit 70. The medium detection sensor 60 is an example of a detection sensor on the downstream side placed on the downstream side of the second conveyance unit 20, and detects the position of the document S conveyed by the second conveyance unit 20. As the medium detection sensor 60, various sensors can be used. In this embodiment, the medium detection sensor 60 is an optical sensor as with the medium detection sensor 50, and includes a light-emitting unit 61 and a light-receiving unit 62. Further, the medium detection sensor 60 detects the document S on the basis of a principle that the intensity of the received light (the amount of the received light) changes when the document S reaches or passes through the medium detection sensor 60.

<Place of CIS>

The image reading unit 70 on the downstream side of the medium detection sensor 60 performs optical scanning, conversion into an electrical signal, and reading as image data, for example, and includes a light source such as an LED, an image sensor, a lens array, and the like on the inside thereof. In this embodiment, the image reading unit 70 is placed on each of both sides of the route RT, and is formed by a contact image sensor (CIS) that reads the front and back surfaces of the document S.

<Description of Block Diagram>

Figure 3:
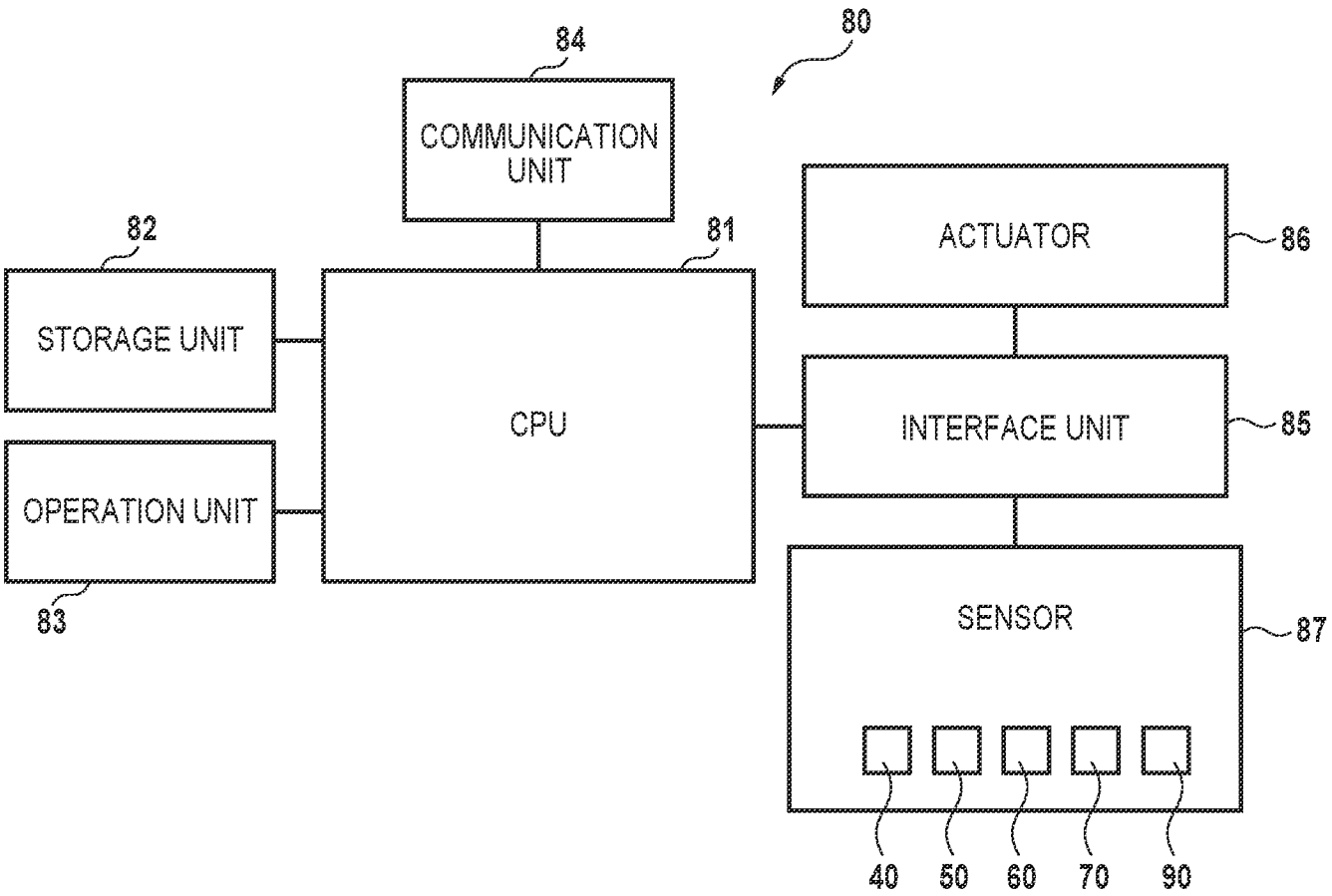
FIG. 3 is a block diagram of a controlling unit.

A control unit 80 is described with reference to FIG. 3. FIG. 3 is a block diagram of the control unit 80 of the document feeding device A.

The control unit 80 includes a CPU 81, a storage unit 82, an operation unit 83, a communication unit 84, and an interface unit 85. The CPU 81 controls the entire document feeding device A by executing a program stored in the storage unit 82. The storage unit 82 is formed by a RAM, a ROM, or the like, for example. The operation unit 83 is formed by a switch, a touch panel, and the like, for example, and receives the operation from an operator.

The communication unit 84 is an interface that communicates information with an external device. When a PC (personal computer) is supposed as the external device, a USB interface or a SCSI interface can be used as the communication unit 84, for example. In addition, other than the wired communication interfaces as above, the communication unit 84 may be a wireless communication interface, or may include interfaces for both wired communication and wireless communication.

The interface unit 85 is an I/O interface that inputs and outputs data from and to an actuator 86 and a sensor 87. The actuator 86 includes the motor 3, the motor 4, and the like. The sensor 87 includes the multi-feed detection sensor 40, the medium detection sensors 50 and 60, the image reading unit 70, the document detection sensor 90, and the like.

<Drive by Reception of Start Command from PCC=

A basic operation of the document feeding device A is described. The control unit 80 starts to drive the first to third conveyance units 10 to 30 when the control unit 80 receives a command for starting the image reading from an external personal computer connected to the document feeding device A, for example. The documents S loaded on the placing tray 1 are conveyed one by one from the bottommost document S. The command for starting the image reading may be executed by pressing a start button provided on the document feeding device A.

<Start of Reading in Accordance with Output of Registration Sensor>

At a timing based on the detection result of the medium detection sensor 60, the control unit 80 starts the reading of the image of the document S, which is conveyed by the second conveyance unit 20, by the image reading units 70, 70. The control unit 80 temporarily stores the read images and sequentially transmits the read images to the external personal computer. The document S of which image is read is output to the output tray 2 by the third conveyance unit 30, and image reading processing of the document S ends.

<Operation Flow of Feeding and Conveying>

Figure 4:
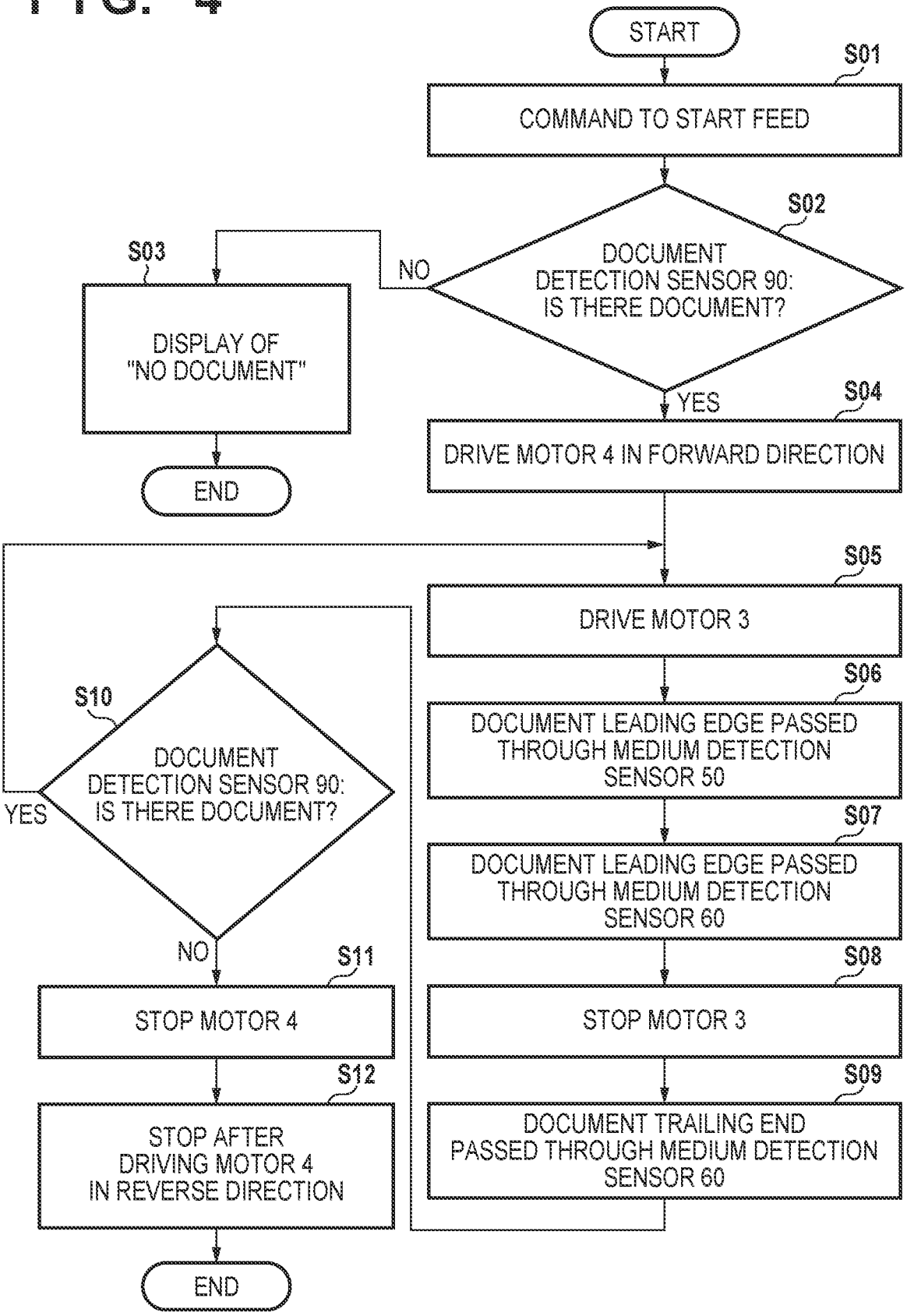
FIG. 4 is a flowchart illustrating the operation of the document feeding device in FIG. 1.

Next, an operation flow of the feeding and the conveying is described with reference to FIG. 4.

In step S1, the control unit 80 receives a command for starting the image reading from an external personal computer connected to the document feeding device A, for example.

In step S2, the control unit 80 determines whether there are documents S on the placing tray 1 by the document detection sensor 90.

In step S3, when the control unit 80 determines that there are no documents S by the document detection sensor 90, the control unit 80 displays a notice saying that there are no documents S on the external personal computer and the like, and the processing ends without performing the feeding and the conveying.

In step S4, when the control unit 80 determines that there are documents S on the placing tray 1 by the document detection sensor 90, the control unit 80 drives the motor 4 in the forward direction. At this time, the pick arm 13 is moved to the pressure contact position, and the document stopper 14 is moved to the opening position.

In step S5, the control unit 80 drives the motor 3, rotates the feeding rollers 11 in a direction (forward direction) in which the documents S are fed, and feeds the documents S.

In step S6, it is detected that the leading edge of the conveyed document S has passed through the medium detection sensor 50. Next, in step S7, it is detected that the leading edge of the conveyed document S has passed through the medium detection sensor 60.

At this time, when the leading edge of the conveyed document S has passed through the medium detection sensor 60, the conveyed document S has reached the second conveyance unit 20. Therefore, even when the first conveyance unit 10 is stopped, the conveyed document S is conveyed by the second conveyance unit 20, and hence the control unit 80 stops the motor 3 in step S8.

Meanwhile, the image of the document S is started to be read when the document S reaches the image reading unit 70, that is, after a predetermined period has elapsed from the time point at which the leading edge of the document S reaches the medium detection sensor 60.

In step S9, it is detected that a trailing edge of the conveyed document S has passed through the medium detection sensor 60. The image reading of the document S ends after a predetermined period has elapsed from this time point. As a result, a series of a reading operation for one sheet of the document S is completed.

In step S10, the control unit 80 determines whether there are documents S on the placing tray 1 by the document detection sensor 90. When it is determined that there are documents S, the processing proceeds to step S5, and the conveying and image reading of the document S is performed.

In step S10, when it is determined that there are no documents S on the placing tray 1 by the document detection sensor 90, the control unit 80 stops the motor 4 in step S11. At this time, the motor 4 is stopped after a predetermined period has elapsed so that the document that has passed through the medium detection sensor 60 is output by the third conveyance unit 30. When the third conveyance unit does not drive the motor 4, the motor 4 may be immediately stopped.

Subsequently, in step S12, the control unit 80 stops the motor 4 after driving the motor 4 in the reverse direction by a predetermined number of pulses. At this time, the pick arm 13 is moved to the retraction position and stopped, and the document stopper 14 is moved to the closing position and stopped. As a result, the operation of the feeding and the conveying ends.

By the operation flow as above, a conveying control for feeding the next document S is performed with the medium detection sensor 60 being the trigger. As a result, a predetermined space between the sheets of paper is provided at the reading position of the image reading unit 70, and hence the documents S can be successively conveyed in a stable manner.

<Separation Swinging Member>

Figure 5:
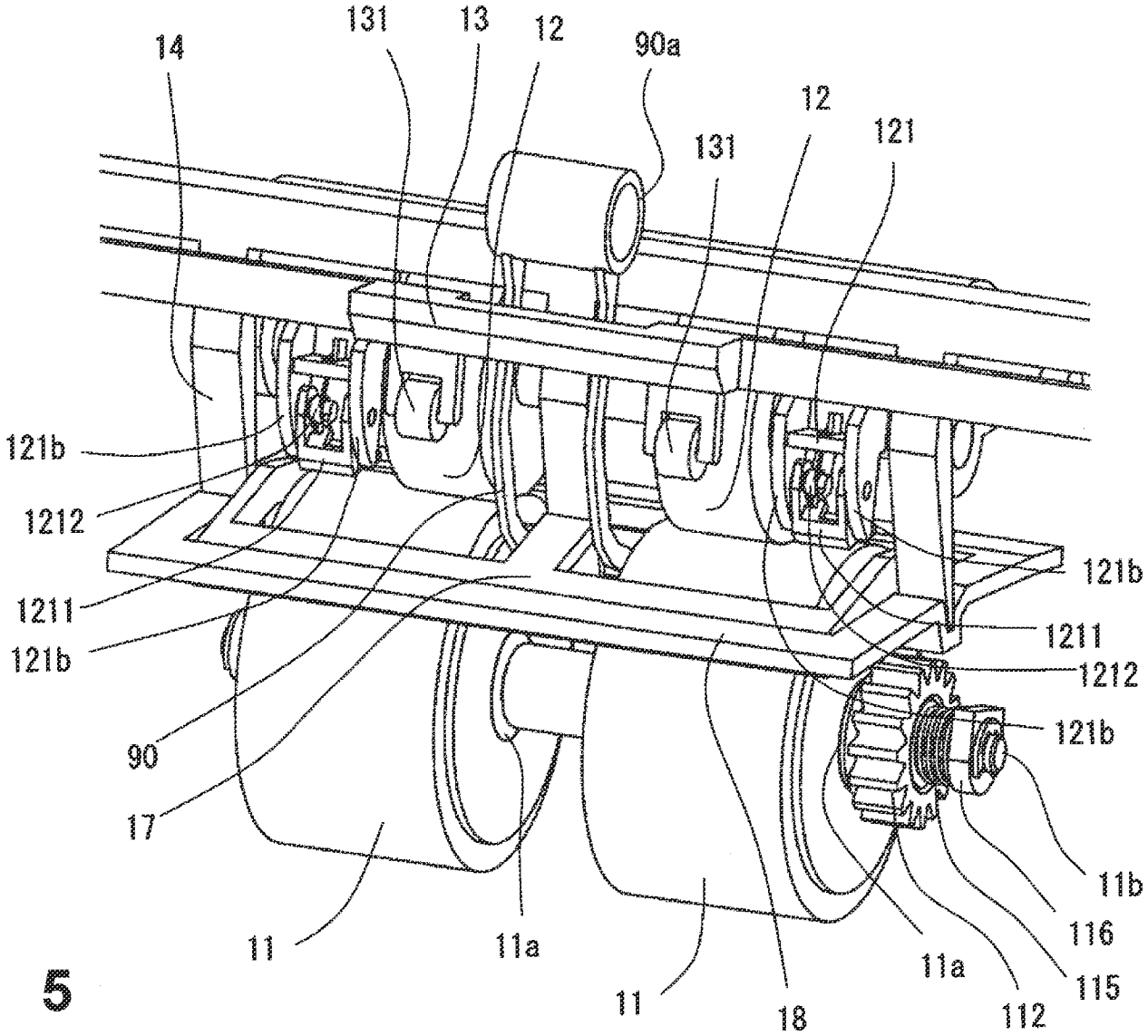
FIG. 5 is a perspective view of a feeding unit.

As illustrated in FIG. 5, the separation swinging member 121 is provided on a side portion of the separation roller 12, and includes a rib portion 121*b* provided on a surface that abuts against the document S, a limitation member 1211 supported by the rib portion 121*b* in a swingable manner, and a spring 1212 that biases the limitation member 1211. The limitation member 1211 is an example of a movable member, and enters a space between the separation roller 12 and the leading edge side of the document as described below.

Figure 6:
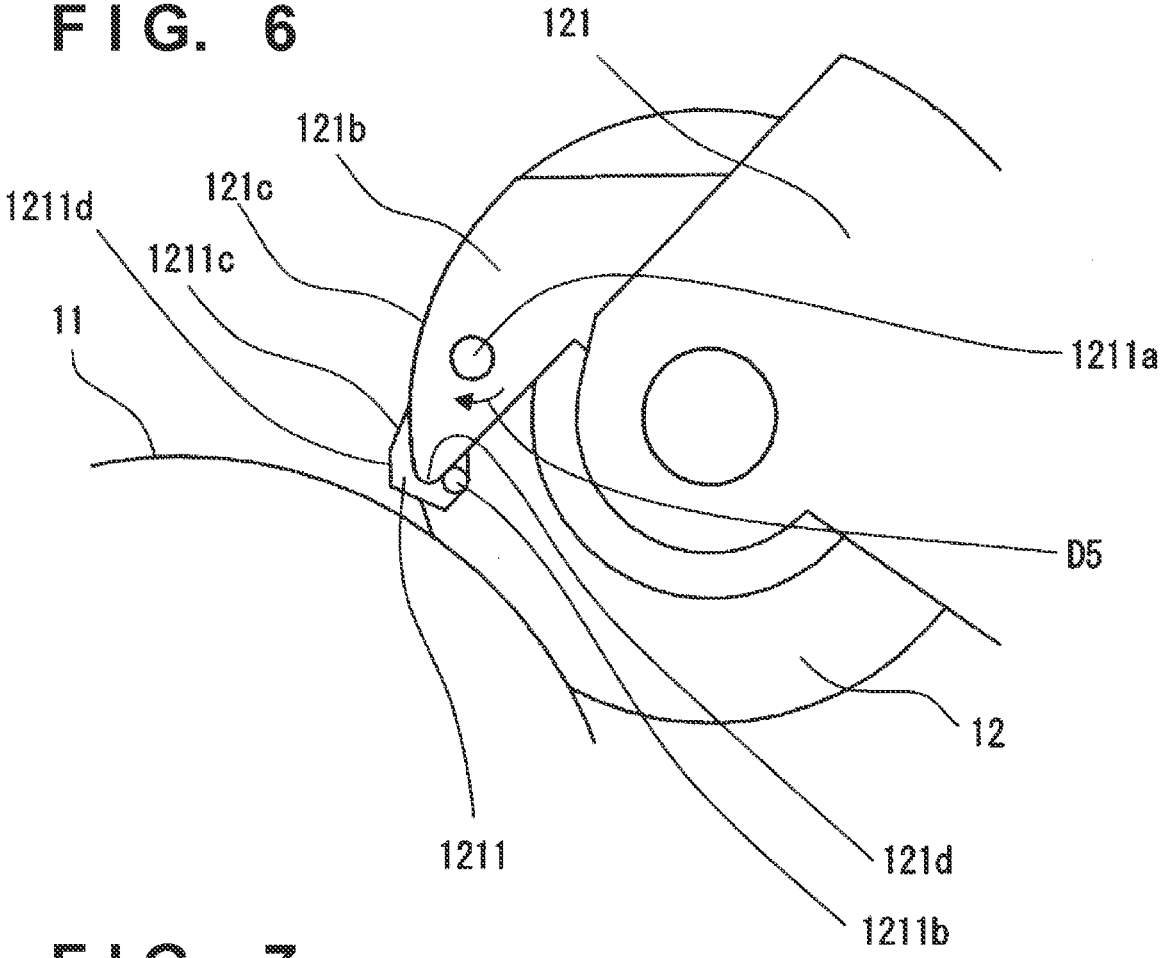
FIG. 6 is a cross-sectional view of the feeding unit.
Figure 7:
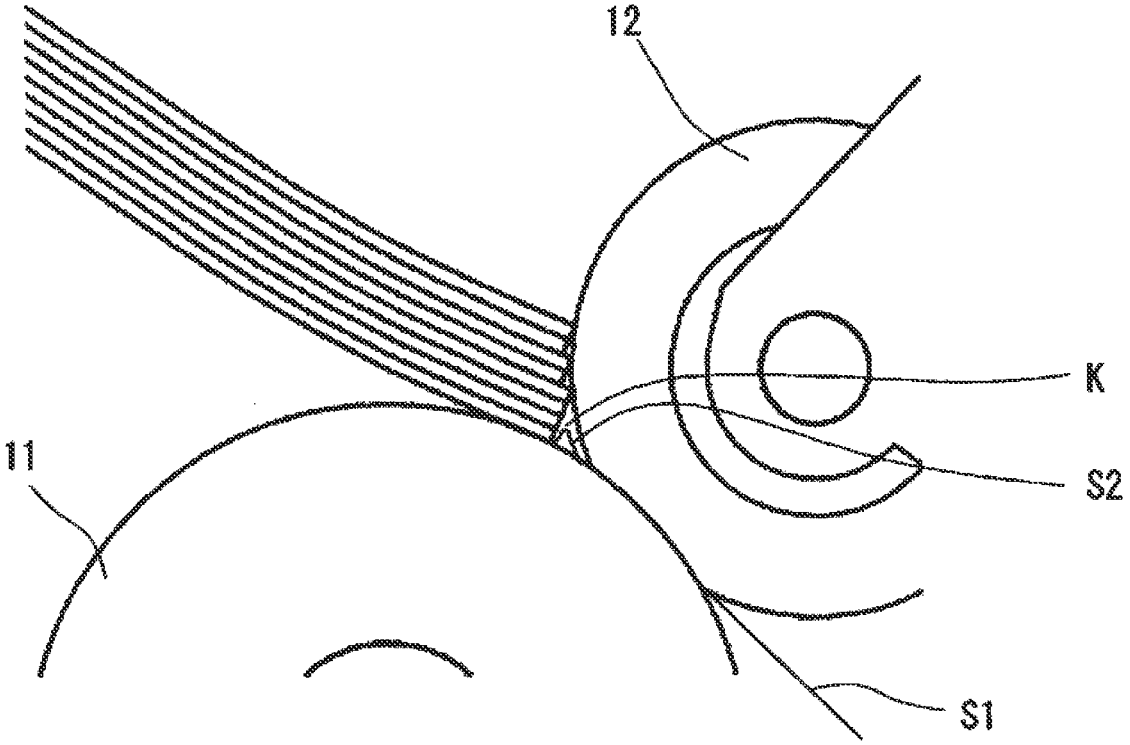
FIG. 7 is a cross-sectional view of another feeding unit.

As illustrated in FIG. 6 that is a side view of the separation swinging member 121, the rib portion 121*b* has a surface 121*c* that is substantially the same surface as an external surface of the separation roller 12 on the upstream side in the feeding direction with respect to the rotation center. When a heavy batch of documents such as a batch of documents having a large number of loaded sheets is fed, the leading edge of the batch of documents butts against the surface 121*c*. As a result, a case where the surface of the separation roller 12 on the upstream side is crushed by the document S on the upper side of the loaded batch of documents being pressed against the separation roller 12 is prevented, the number of sheets of the batch of documents that enters the feed nip is limited, and the feeding failure is reduced.

The limitation member 1211 is provided so as to protrude toward the conveying path from a protruding portion 121*d*, which is a leading edge of the rib portion 121*b* protruding to the conveying path side, and also protrude to the upstream side in the feeding direction from the rib portion 121*b*. The limitation member 1211 is rotatable about the shaft portion 1211*a*. Further, the limitation member 1211 is biased in a direction (the direction of arrow D5 in FIG. 5) protruding to the conveying path by the spring 1212, and a rotation stopper portion 1211*b* butts against the rib portion 121*b*. Note that the limitation member 1211 only needs to be provided so as to be swingable in the thickness direction of the batch of documents with respect to the separation swinging member 121, and may be provided so as to linearly move. The expression "linearly" also includes movement while moving in the width direction with respect to the moving direction.

The limitation member 1211 is biased by the spring 1212 so as to retract (rotate in the opposite direction of arrow D5) when a heavy batch of documents is set, and so as not to retract when a light batch of documents is set. The light batch of documents is particularly a document of which paper thickness is thin and document size is small such as a bundle of small slips. For example, in this embodiment, in the document feeding device A of which maximum number of loaded sheets is 60 sheets, the conveying path has an angle of 40 degrees with respect to the installation surface of the document feeding device A. In that case, the load of the spring 1212 is set so that the limitation member 1211 retracts by being pushed by the batch of documents when 60 sheets of OA paper of which basis weight is 80 g/m$^2$ and size is A4 are set, and the limitation member 1211 does not retract even when being pushed by the batch of documents when 60 sheets of slips of which basis weight is 40 g/m$^2$ and size is A6 are set.

As described above, the specification of the document feeding device A and the degree of the batch of documents that causes retraction can be set for the biasing force of the spring 1212 that biases the limitation member 1211, and the biasing force of the spring 1212 is not necessarily uniquely determined.

In particular, a feed jam (paper jam) of thin paper can be prevented by providing the limitation member 1211 as above. When there is no limitation member 1211, when a batch of documents of which paper thickness is thin such as slips is fed, a part of the batch of documents enters the feed nip, and a space K may be formed between the feed nip and the batch of documents leading edge as in FIG. 7. At this time, the following may occur. That is, when a document S1 is being fed, a document S2 to be fed next receives a force in the feeding direction (forward direction) along with the document S1 in the space K and also receives a force in the negative direction from the separation rollers 12, thereby causing the leading edge of the document S2 to warp. As a result, the leading edge of the document S2 curls or a jam occurs.

Meanwhile, in this embodiment, the following is obtained by providing the abovementioned limitation member 1211. That is, as in FIG. 8, the amount of the batch of documents that enters the feed nip can be limited for a batch of documents of which paper thickness is thin such as slips, the space K between the feed nip and the batch of documents leading edge can be reduced, the warp of the document S2 in the space K can be suppressed, and the occurrence of the curling of the leading edge of the document S2 and a jam can be suppressed. For a heavy batch of documents, the limitation member 1211 retracts, and hence the area of contact between the document S and the feeding roller 11 does not change, and the conveying force does not decrease. Therefore, a case where the document S is not fed does not occur. In addition, thick documents S such as credit cards also receive the conveying force of the feeding roller 11. The document S pushes the limitation member 1211 to cause the limitation member 1211 to retract. Therefore, a case where the document S is not fed does not occur.

In addition, as illustrated in FIG. 5, the document detection sensor 90 for detecting the reaching of the documents S is provided between the plurality of feeding rollers 11. The document detection sensor 90 is pivotally supported by a detection sensor shaft 90*a*, and hangs down by self-weight. The document detection sensor 90 is formed so as to be as light as possible and so that resistance against the rotation operation due to friction and the like is almost gone in order to be able to retract about the detection sensor shaft 90*a* regardless of the type of the reaching document S.

A feeding roller guide 17 is provided on the upstream side of the document detection sensor 90. The feeding roller guide 17 is pivotally supported by a guide shaft 17*a* provided on the upstream side of the feeding rollers 11, and extends toward the downstream side in the feeding direction. The feeding roller guide 17 is biased in a direction (the thickness direction of the conveyed document) orthogonal to the feeding direction by guide biasing means 17*b* illustrated in FIG. 10 so that a leading edge thereof moves from the feeding roller 11 side to the separation roller 12 side. When there are no documents S on the placing tray 1, the feeding roller guide 17 is positioned by a butting portion (not shown) in a state of being biased such that the leading edge thereof is at a position protruding from the outer periphery of the feeding roller 11 when seen from a shaft direction (the direction illustrated in FIG. 10) of the feeding roller 11.

Figure 8:
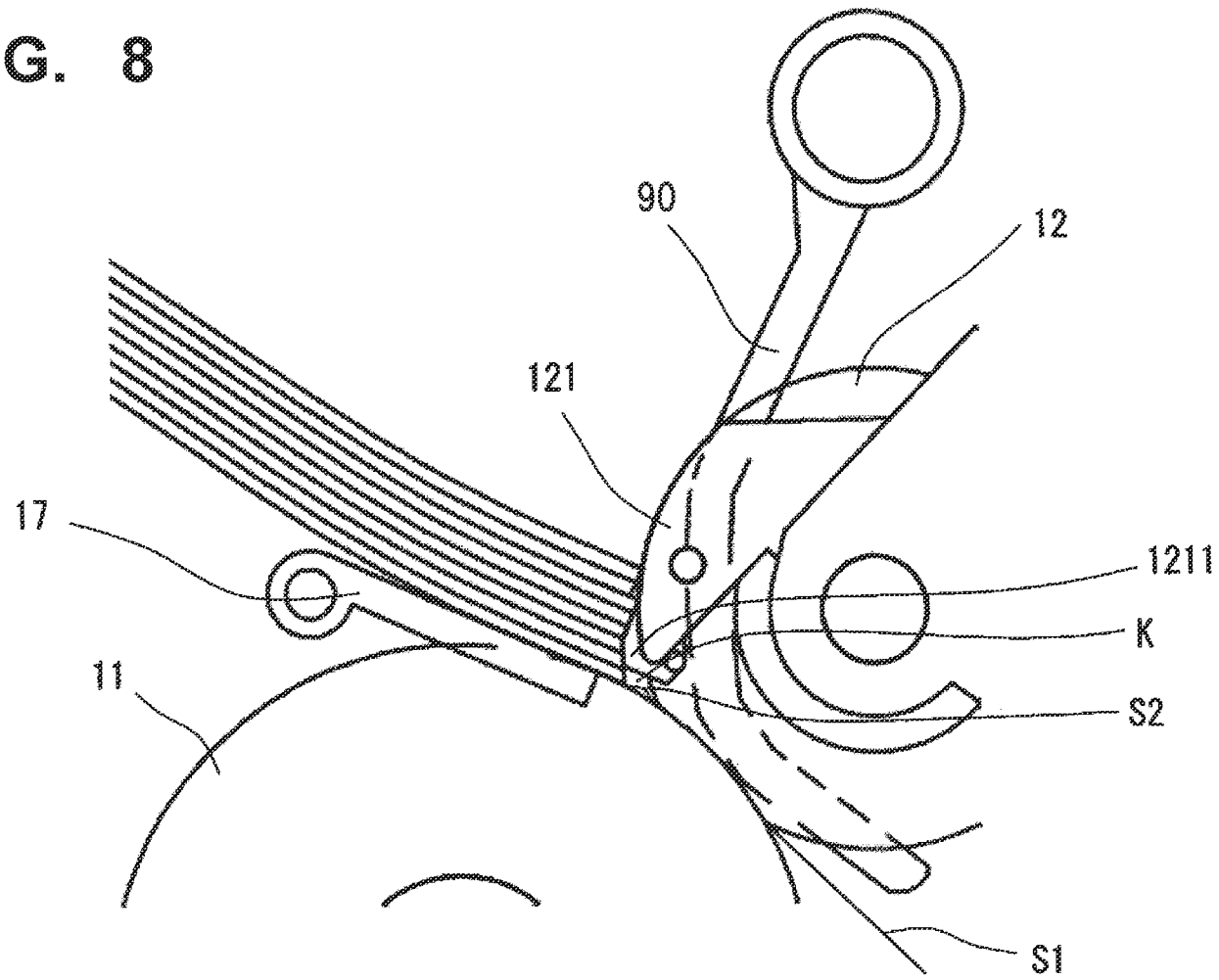
FIG. 8 is a cross-sectional view of the feeding unit.
Figure 9:
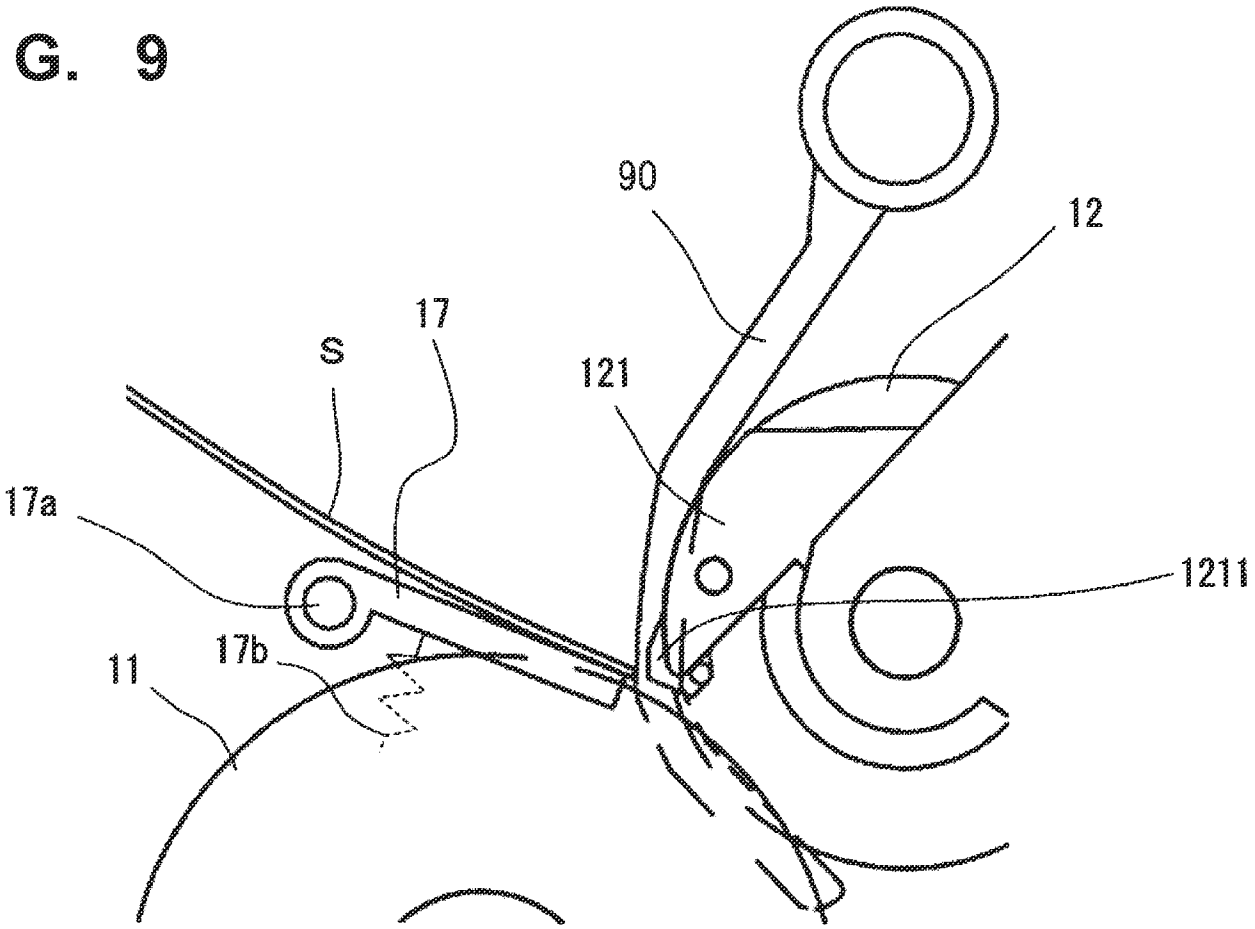
FIG. 9 is another cross-sectional view of the feeding unit.
Figure 10:
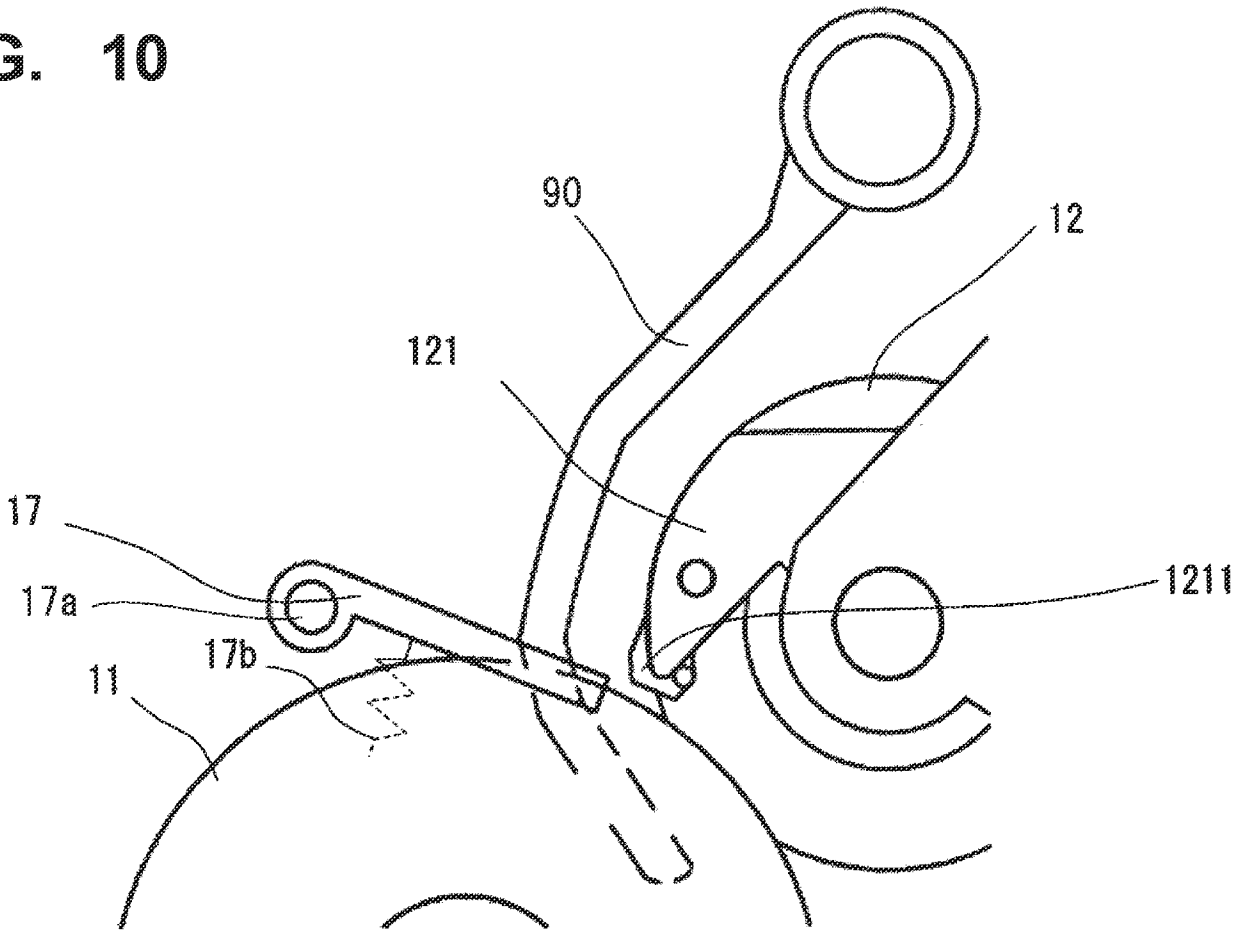
FIG. 10 is another cross-sectional view of the feeding unit.
Figure 11:
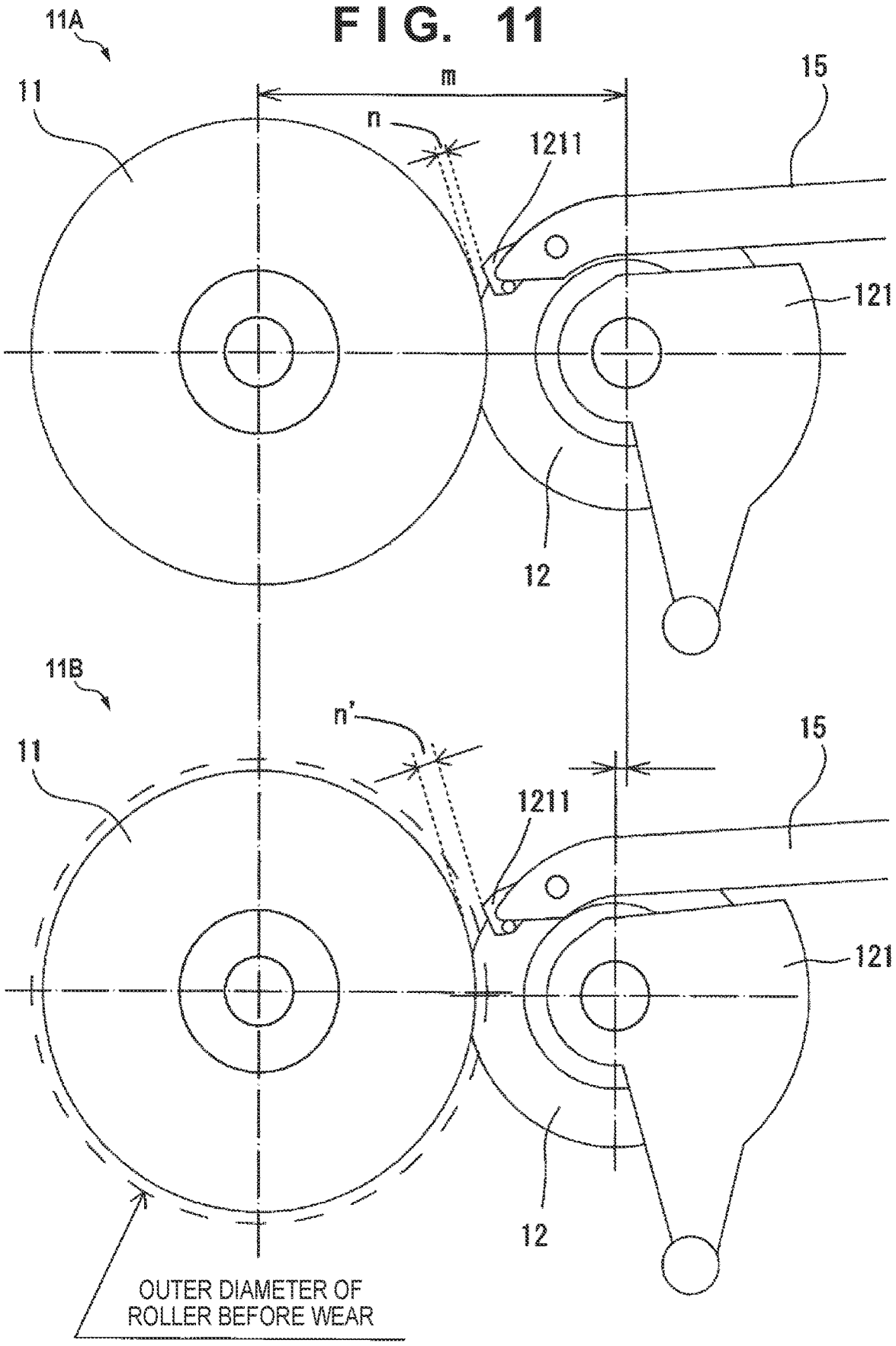
FIG. 11 is a cross-sectional view of a feeding unit of the related art.
Figure 12:
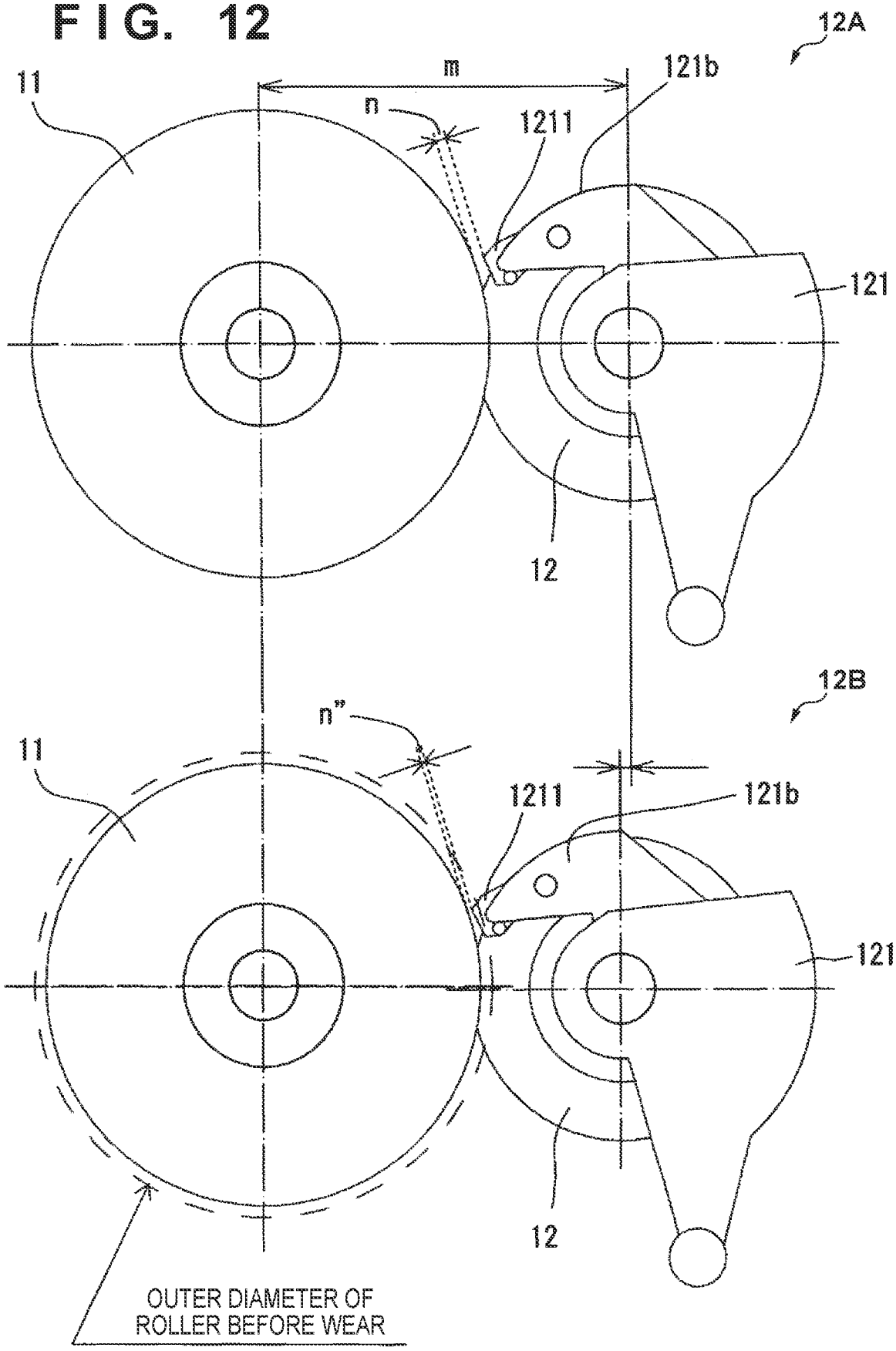
FIG. 12 is a cross-sectional view of the feeding unit.

By the feeding roller guide 17, the following is obtained. When the plurality of documents S are mounted on the placing tray 1, the feeding roller guide 17 is biased to the feeding roller 11 side against the biasing means as illustrated in FIG. 8. When the number of the documents S is small, in particular, when the number of the mounted documents S is small such as when only one sheet of the document S that is thin paper is mounted on the placing tray 1, the document is biased to the separation roller 12 side by the feeding roller guide 17, and the document S is prevented from abutting against the feeding rollers 11 while the leading edge of the document S is in sliding contact with the feeding roller guide 17 as illustrated in FIG. 9. By the configuration above, when the documents S are set on the placing tray 1, a case where the documents S cannot be set to a predetermined set position due to being caught by the feeding rollers 11 when the number of the documents S is small can be prevented.

Note that, in this embodiment, as illustrated in FIG. 5, the feeding roller guide 17 is provided so that the tips of the feeding roller guide 17 on the separation roller 12 side (the downstream side in the feeding direction) are placed on both sides of each of the feeding rollers 11 and between the feeding rollers 11. Therefore, when the batch of documents on the placing tray 1 decreases, the leading edge of the document S can be prevented from abutting against the feeding rollers 11 more reliably.

In addition, stiffness can be provided to the documents S by locally holding up the documents S by the feeding roller guide 17. According to the feeding roller guide 17 in this embodiment, a plurality of the feeding roller guides 17 can plunge the document S into the nip between the feeding roller 11 and the separation roller 12 in a state in which the document S is biased in a direction of being held up on the upstream side of the feeding rollers 11 and provided with stiffness. In addition, for the documents S that still have low stiffness, the limitation member 1211 as described above can limit the amount of the documents S that plunges into the nip by coming into abutment with the documents S. Therefore, the occurrence of the curling of the leading edge of the document S and a paper jam can be effectively suppressed. "The curling of the leading edge of the document" in this embodiment herein includes a state in which the document is fed with wrinkles as a result of being curled.

Note that the feeding roller guide 17 biases the document S so that the document S mounted on an upper surface thereof comes into sliding contact with a lower surface of the limitation member 1211. That is, the lower surface of the limitation member 1211 is located on a plane that is substantially the same as a plane extending from an edge of the upper surface of the feeding roller guide 17 on the downstream side thereof. In more detail, in this embodiment, the lower surface of the limitation member 1211 is provided so that there is slightly a distance from a plane extending from the end portion of the upper surface of the feeding roller guide 17 on the downstream side thereof. By the configuration, even when the document S is thin paper, a case where the document S cannot be fed due to being blocked by the feeding roller guide 17 and the limitation member 1211 does not occur, and the effect of enhancing the performance of feeding the document S that is thin paper can be exhibited, as appropriate, by the limitation member 1211 as described above.

Note that, in this embodiment, a feeding roller cover 18 illustrated in FIG. 5 is provided so as to cover the feeding rollers 11 and the feeding roller guide 17. The guide shaft 17*a* and the guide biasing means 17*b* of the feeding roller guide 17 are attached to a side (the lower side in FIG. 5) opposite to the surface of the feeding roller cover 18 that comes into sliding contact with the document, and the feeding roller cover 18 and the feeding roller guide 17 form an integrated unit.

By removing the feeding roller cover 18, the shaft and a bearing of the feeding rollers 11 are exposed, and the feeding rollers 11 can be detached from the document feeding device A. Note that an accommodation portion having a recessed shape is provided in the feeding roller cover 18 in a position in which the leading edge of the document stopper 14 is accommodated.

In this embodiment, by supporting the limitation member 1211 by the separation swinging member 121, the deterioration of the feed performance can be suppressed even when the feeding roller 11 and the separation roller 12 are worn out. As in an example 11A in FIG. 11, in a configuration in which the limitation member 1211 is supported by a fixed part 15 that does not swing instead of the separation swinging member 121, the separation rollers 12 are brought into pressure contact with the feeding roller 11 side when the feeding roller 11 and the separation roller 12 are worn out. As a result, as in an example 11B in FIG. 11, a pitch m between the shafts of the feeding roller 11 and the separation roller 12 decreases, and a gap n' between the limitation member 1211 and the feeding roller 11 becomes larger than a gap n. Therefore, the space K in FIG. 8 increases at the time of the feed, and hence the effect of reducing the curling of the leading edge of the document and the paper jam decreases. However, as in an example 12A in FIG. 12, when a configuration in which the limitation member 1211 is supported by the separation swinging member 121 that swings is used, the following is obtained. That is, when the feeding roller 11 and the separation roller 12 are worn out, even when a pitch m between the shafts of the feeding roller 11 and the separation roller 12 decreases as in the example 12B in FIG. 12, the limitation member 1211 swings to the feeding roller 11 side together with the separation roller 12 in abutment against the feeding roller 11. As a result, a gap n" between the limitation member 1211 and the feeding roller 11 becomes smaller than the gap n by the amount that the separation roller 12 has worn out. Therefore, the space K in FIG. 8 does not increase at the time of the feed as in the example 11B in FIG. 11, and hence problems in the feed such as a jam can be suppressed. In fact, the wear amount of the separation roller 12 is smaller than the wear amount of the feeding roller 11, and hence a case where the feed cannot be performed due to the gap n" being too narrow does not happen. In addition, even when the wear amount of the separation roller 12 is large, the gap n" becomes zero, and the limitation member 1211 comes into contact with the feeding roller 11, the limitation member 1211 can retract by swinging. Therefore, a case where the documents cannot be fed does not occur. The attachment angle of the limitation member 1211 only needs to be set, as appropriate, in consideration of the durability of the separation roller 12.

Figure 13:
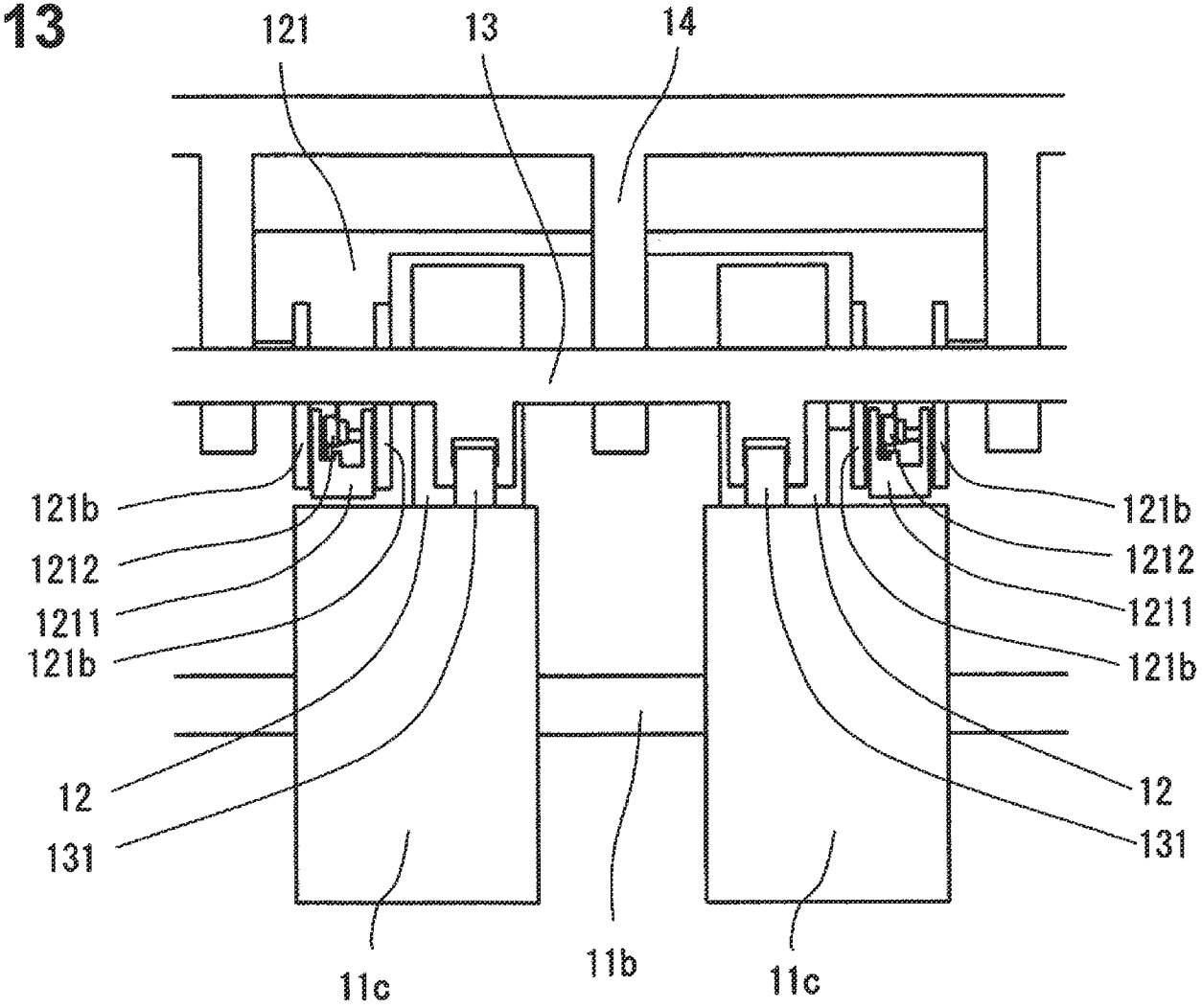
FIG. 13 is a front view of the feeding unit (a view seen from a placing tray in the feeding direction).
Figure 14:
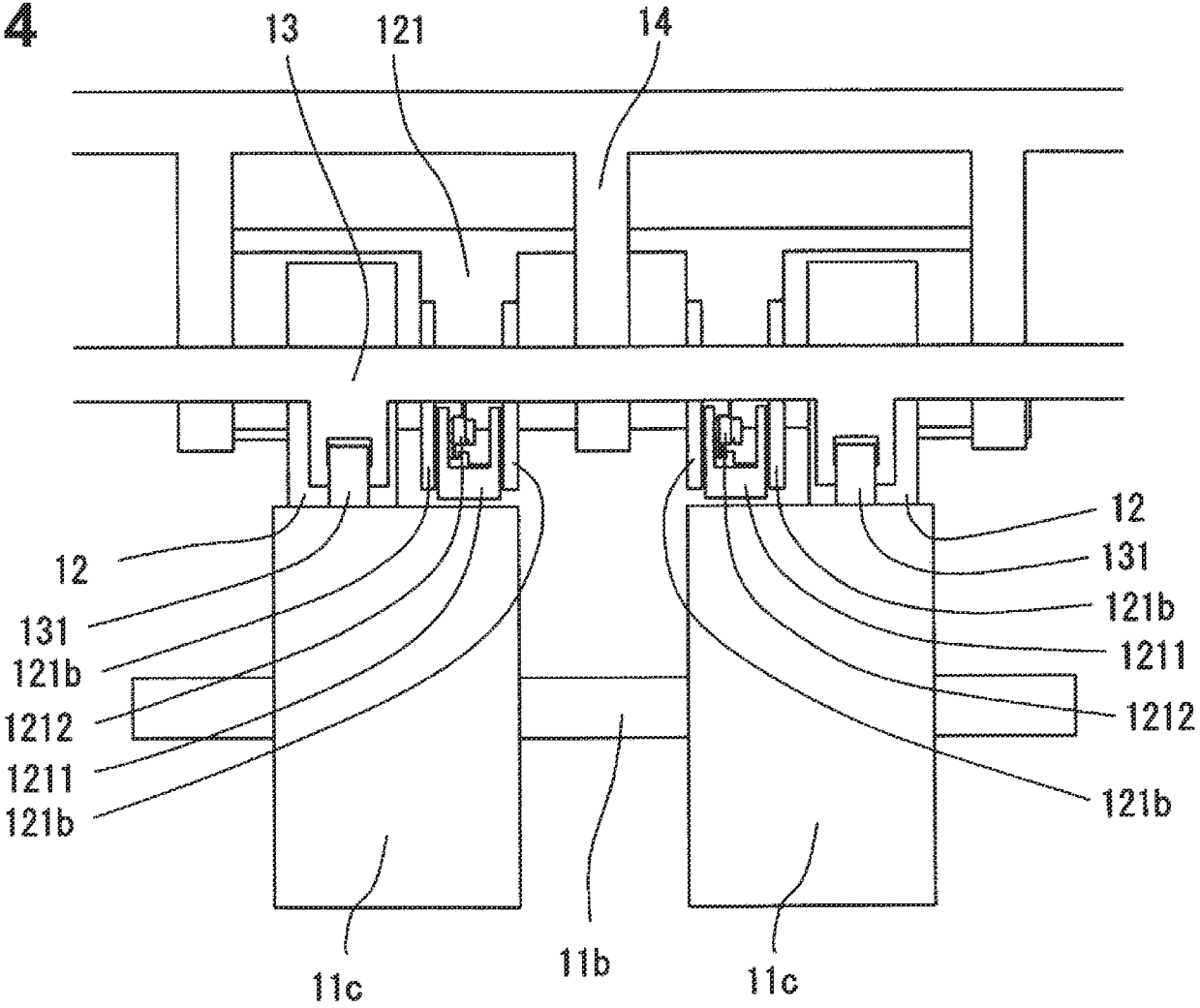
FIG. 14 is a front view of the feeding unit (a view seen from the placing tray in the feeding direction).
Figure 15:
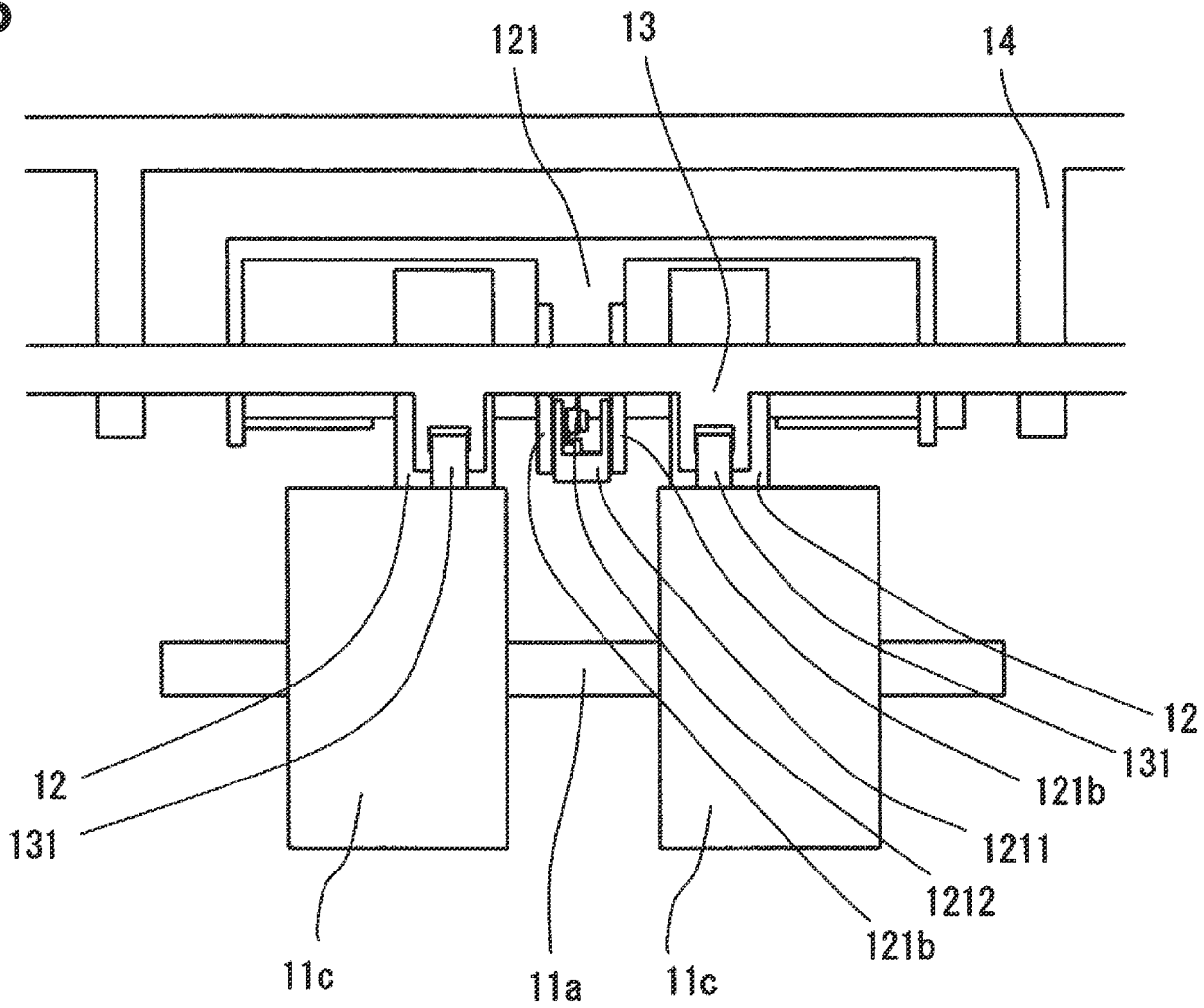
FIG. 15 is a front view of the feeding unit (a view seen from the placing tray in the feeding direction).
Figure 16:
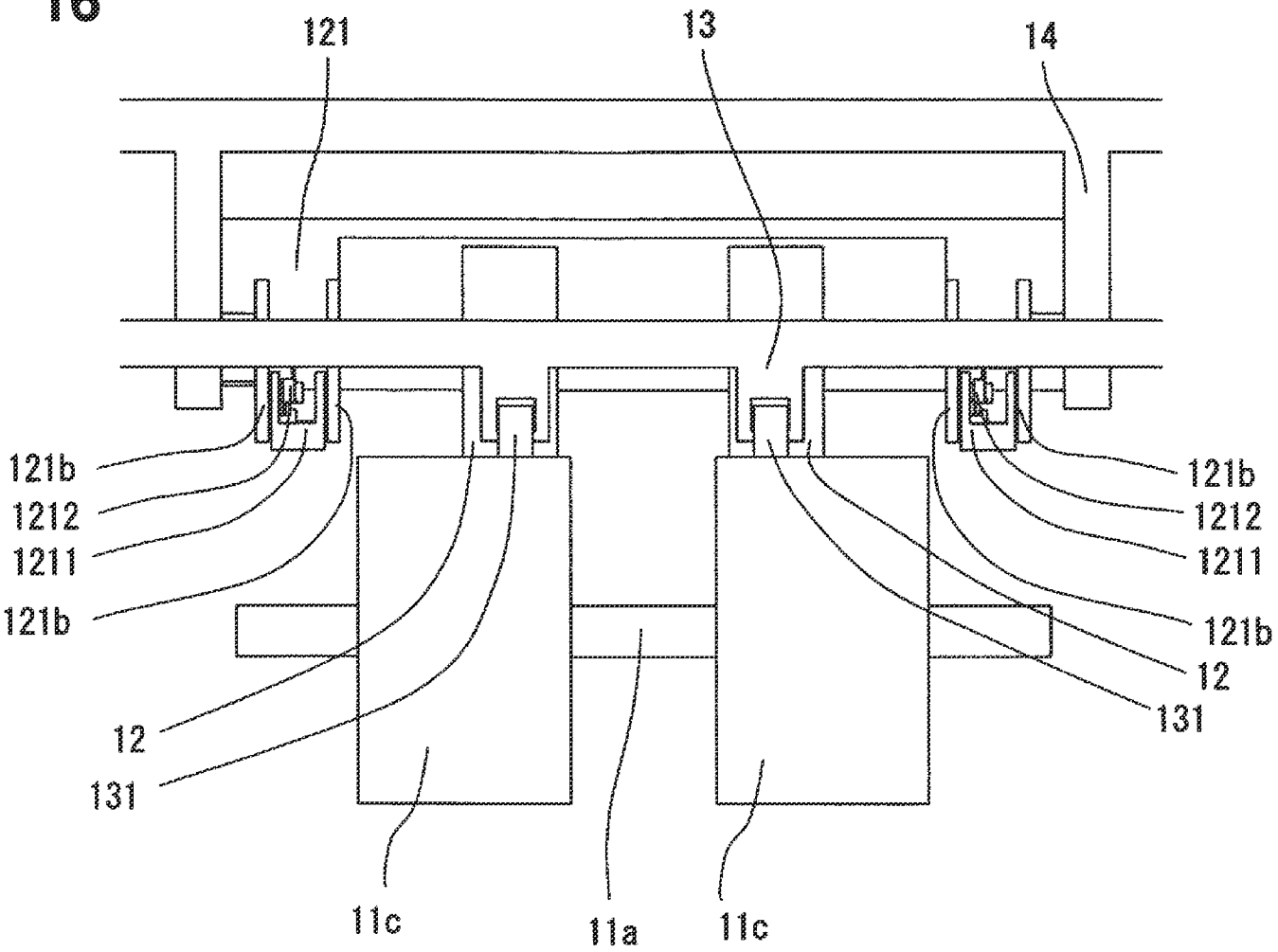
FIG. 16 is a front view of the feeding unit (a view seen from the placing tray in the feeding direction).

As illustrated in FIG. 13, the rib portions 121*b* and the limitation members 1211 in this embodiment are placed on a side facing friction members 11*c* of the feeding rollers 11. The friction members 11*c* are each formed on the outer periphery of the roller of each of the feeding rollers 11 by materials such as rubber so as to easily grip the document S. The feeding rollers 11 include two friction members 11*c*, and the rib portions 121*b* and the limitation members 1211 are placed on both sides of the two separation rollers 12. By causing the rib portions 121*b* and the limitation members 1211 to face friction members 11*c*, the document S is sandwiched between the rib portions 121*b* and the limitation members 1211, and the friction members 11*c*, and the friction force of friction members 11*c* increases. Therefore, the conveying force of the document S increases, and the document S is prevented from not being fed. In other words, the separation rollers 12 that are small in width are provided with respect to the feeding rollers 11, and the limitation members 1211 are provided for the feeding rollers 11 with use of the spaces of the parts in which the separation rollers 12 are not placed. By doing so, the limitation members 1211 can be placed while securing a width necessary for the separation rollers 12 with respect to the width of the feeding rollers 11. In particular, as in this embodiment, it is effective for the downsizing of a relatively small document feeding device in which the conveying path is raised in the vertical direction.

The places of the rib portion 121*b* and the limitation member 1211 are not limited to the above. As in FIG. 14, the rib portions 121*b* and the limitation members 1211 may be placed between the two separation rollers 12. Even when the rib portions 121*b* and the limitation members 1211 are placed as described above, as in the aspect of FIG. 13, the document S is sandwiched between the rib portions 121*b* and the limitation members 1211, and the friction members 11*c*, and the friction force of friction members 11*c* increases. Therefore, the conveying force of the document S increases, and the document S can be suitably prevented from not being fed. In addition, as in FIG. 15 and FIG. 16, the rib portion 121*b* and the limitation member 1211 may be placed in positions that do not face the friction members 11*c*, that is, positions that are shifted in the thrust direction of the feeding rollers 11. The rib portion 121*b* and the limitation member 1211 are placed between two friction members 11*c* in FIG. 15, and placed on each of both sides of two friction members 11*c* in FIG. 16. When the rib portion 121*b* and the limitation member 1211 are placed as described above, the rib portion 121*b* and the limitation member 1211 do not face the feeding rollers 11, and hence the effect of sandwiching the document S between the limitation member 1211 and friction members 11*c* is reduced. However, the limitation member 1211 and friction members 11*c* substantially sandwich the document S, and hence the friction force can be enhanced, an effect of pressing against a light batch of documents without retracting by the limitation member 1211 can be exhibited, and the feed performance can be enhanced.

Figure 17:
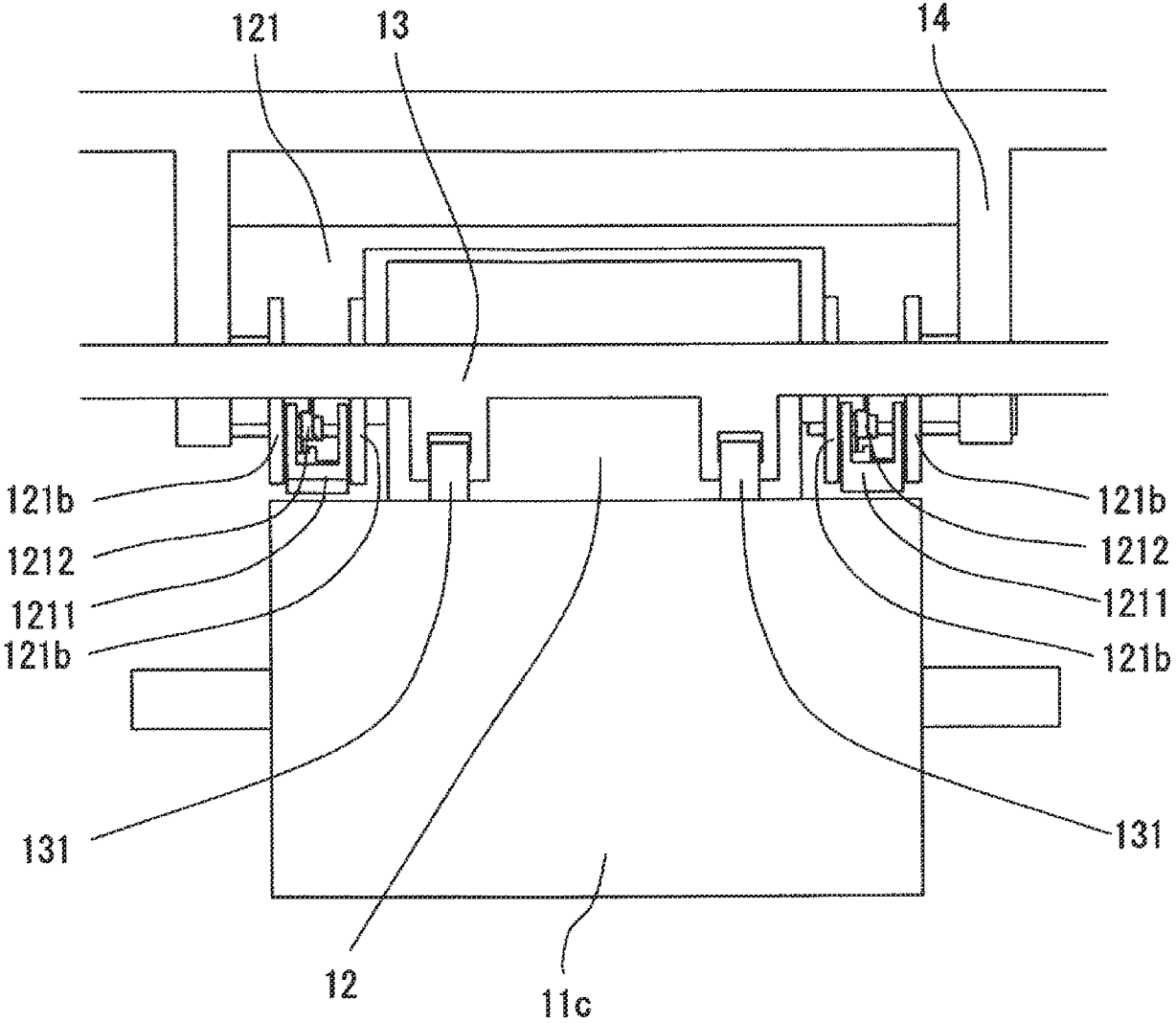
FIG. 17 is a front view of the feeding unit (a view seen from the placing tray in the feeding direction).

In addition, the abovementioned configuration includes two friction members 11*c* and two separation rollers 12, but there may be one friction member 11*c* and one separation roller 12 or a plurality of the friction members 11*c* and the separation rollers 12. As an example, a configuration including one friction member 11*c* and one separation roller 12 is illustrated in FIG. 17.

Figure 18:
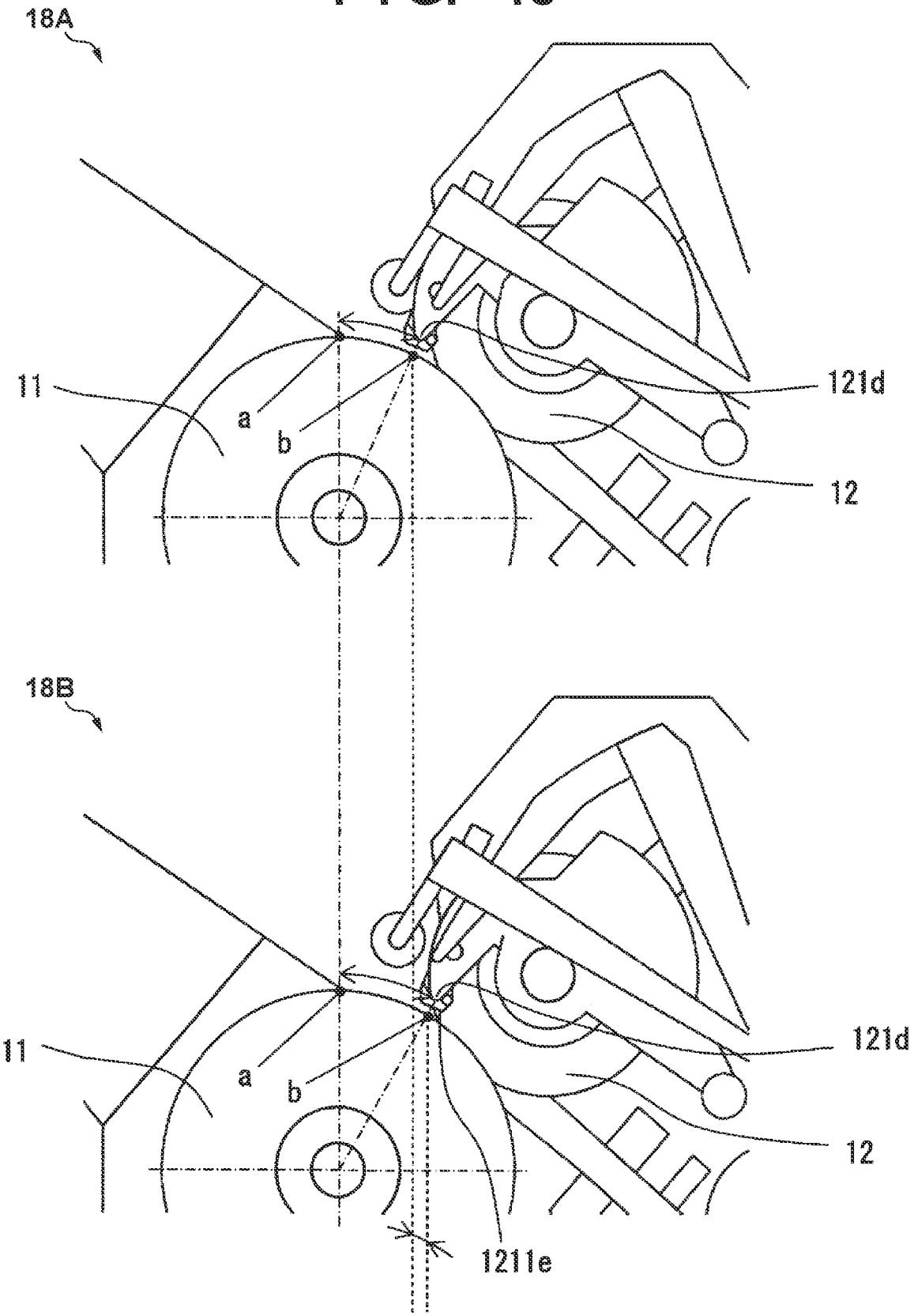
FIG. 18 is a cross-sectional view of the feeding unit.

FIG. 18 is a cross-sectional view for describing the places of the rib portion 121*b* and the limitation member 1211. As in an example 18B in FIG. 18, the rib portion 121*b* and the limitation member 1211 are placed on a side facing the friction member 11*c* and in a place close to the feed nip. As a result, the distance (from an upstream point a to a point b facing the protruding portion 121*d* of the external diameter of the roller) of the external diameter of the feeding roller 11*c* exposed to the conveying path increases. Therefore, the contact area between the batch of documents and the feeding roller 11*c* increases and the conveying force can be increased. Specifically, by placing the rib portions 121*b* and the limitation members 1211 on both sides of the separation rollers as in FIG. 13, the rib portions 121*b* and the limitation members 1211 can be placed on a side facing the friction members 11*c* and a place close to the feed nip. As a result, the conveying force can be increased. In more detail, as illustrated in an example 18B in FIG. 18, a surface 1211*e* formed on the limitation member 1211 on the feeding roller 11 side thereof is placed so that the surface 1211*e* overlaps with an outer periphery surface of the separation roller 12 in the thrust direction (the direction orthogonal to the feeding direction) thereof, and the external surface of the rib portion 121*b* forms the same external surface as the separation roller 12. In this way, the rising up, for example, of the document S to be fed can be suppressed by the limitation member 1211, and the conveying performance can be enhanced.

However, the place of the limitation member 1211 is not limited to the abovementioned configuration. In a device that does not convey a heavy batch of documents and does not need a large conveying force for the feed, for example, the distance (the upstream point a to the point b facing the protruding portion 121*d* of the external diameter of the roller) of the external diameter of friction member 11*c* exposed to the conveying path may be short as in the example 18A in FIG. 18.

As illustrated in FIG. 6, the limitation member 1211 includes a butt surface 1211*c* against which the batch of documents butts, and an inclined surface 1211*d*. The butt surface 1211*c* is substantially perpendicular to the feeding direction. The inclined surface 1211*d* is a surface inclined in the feeding direction on the feeding roller 11 side of the butt surface 1211*c*. By causing the butt surface 1211*c* to be substantially perpendicular to the feeding direction, the entrance of the upper layer portion of the batch of documents into the feed nip can be suppressed. By causing the inclined surface 1211*d* to be a surface inclined in the feeding direction on the feeding roller 11 side of the butt surface 1211*c*, the lower layer portion of the batch of documents can easily enter the feed nip.

In addition, in this embodiment, as illustrated in FIG. 5, the one-way clutches 11*a* are provided between the feeding roller shaft 11*b* that drives the feeding rollers 11 to rotate and each of the feeding rollers 11. That is, when the document S sent forth by the feeding rollers 11 is about to be pulled out by the conveying roller 21, which is provided on the downstream side thereof and has a faster peripheral velocity than the feeding rollers 11, the feeding rollers 11 are able to rotate in a direction that rotates together with the document S. In that case, as the way a drive gear (not shown) that transmits the drive force to the feeding roller gear 112 and the feeding roller gear 112 are in contact with each other, rotation restriction means described below maintains an abutment state in a state in which the drive gear drives the feeding roller gear 112.

When there is no rotation restriction means, the following happens. That is, when the document S slips out from the feeding rollers 11 in this state, the feeding rollers 11 may be pushed back to the upstream side by the separation rollers 12 that are in pressure contact with the feeding rollers 11. In that case, the feeding rollers 11 and the feeding roller gear 112 rotate in the negative direction by the amount of backlash between the feeding roller gear 112 and the drive gear. As a result, there is a fear that the leading edge of the document S mounted on the placing tray 1 is returned.

The returning of the leading edge of the document S in the negative direction leads to the decrease of the feeding performance. However, in this embodiment, a compression spring 115 that biases the feeding roller gear 112 in the shaft direction of the feeding roller shaft 11*b* is provided as the rotation restriction means. The compression spring 115 is provided between the feeding roller gear 112 and a bearing 116 of the feeding roller shaft 11*b*. As a result, even when the feeding rollers 11 are biased to rotate in the negative direction, the feeding roller gear 112 can be prevented from rotating in the negative direction. Note that the bearing 116 is formed to roughly have a U-shape, and fixed to a case so as not to rotate.

By the configuration, the document S can be prevented from returning in the negative direction, and a tap tone due to the collision of the gears caused by the feeding roller gear 112 being returned by the amount of backlash between the feeding roller gear 112 and the drive gear can be prevented from occurring.

According to the configuration of the compression spring 115 in this embodiment, the tap tone can be prevented from occurring. Therefore, not only the noise reduction of the document feeding device A can be obtained. In particular, by providing sound detection means such as a sensor (microphone) capable of detecting a sound in the vicinity of the feeding rollers 11, a prominent effect can be obtained in the document feeding device A that detects a jam (paper jam) of the document S, for example, and the accuracy of the jam (paper jam) detection can be enhanced.

Embodiment 2

The device configuration of Embodiment 2 is substantially the same as the device configuration of Embodiment 1, and the difference is that the limitation member 1211 and the feeding roller 11 are in pressure contact with each other.

Figure 19:
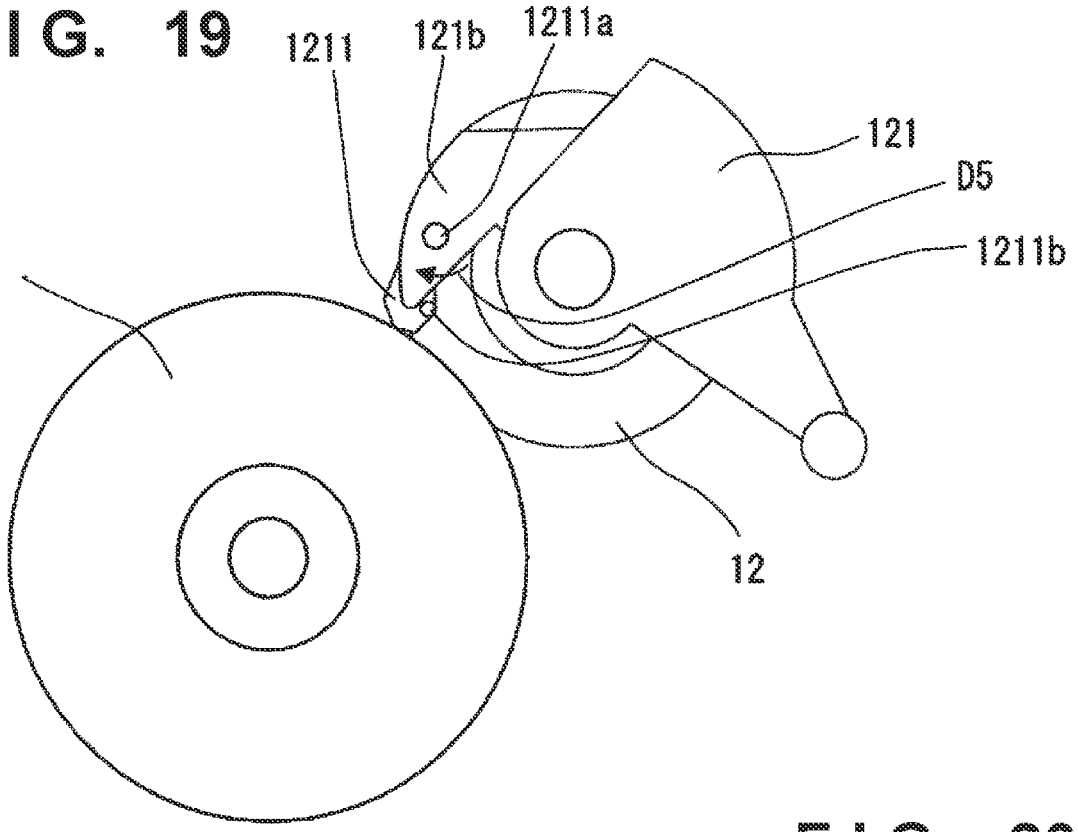
FIG. 19 is a cross-sectional view of a feeding unit according to Embodiment 2 of Embodiment A.

As in FIG. 19, the limitation member 1211 is in pressure contact with the external diameter of the feeding roller 11. The limitation member 1211 is rotatable about the shaft portion 1211*a*, and is biased in a direction (the direction of arrow D5 in FIG. 19) protruding to the conveying path by the spring 1212. The limitation member 1211 butts against the feeding roller 11 before the rotation stopper portion 1211*b* butts against the rib portion 121*b*. The contact point between the limitation member 1211 and the feeding roller 11 is upstream of the feed nip. The limitation member 1211 can limit the amount of the batch of documents that enters the feed nip, reduce the space between the feed nip and the batch of documents leading edge, suppress a warp of the document S in the space, and prevent the leading edge of the document S from curling or the jam. As compared with Embodiment 1, because there are no gaps between the limitation member 1211 and the feeding roller 11, Embodiment 2 can further reduce the paper bundle that enters the feed nip, and the curling of the leading edge of the document S and the jam can be prevented.

Figure 20:
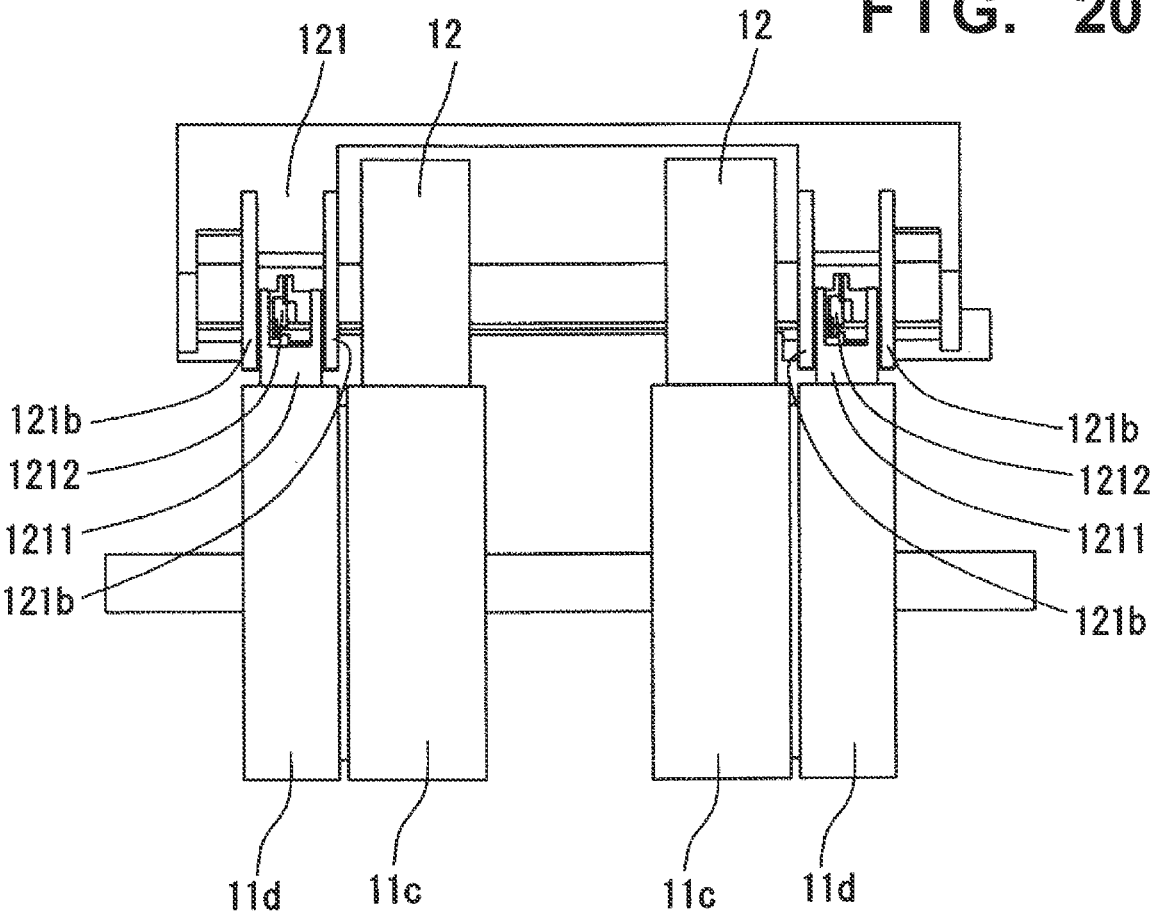
FIG. 20 is a front view of the feeding unit in FIG. 19 (a view seen from the placing tray in the feeding direction).

The configuration of the feeding roller 11 is illustrated in FIG. 20. The feeding roller 11 has a cylindrical portion 11*d* having substantially the same diameter as the external diameter of the friction member 11*c*. The cylindrical portion 11*d* may be made of a low-friction material such as resin having a coefficient of friction lower than that of rubber, and rotates with the friction member 11*c* in an integrated manner. The limitation member 1211 butts against the cylindrical portion 11*d*, and slides along the external diameter of the cylindrical portion 11*d* when the feeding roller 11 rotates. In a configuration in which the leading edge of the limitation member 1211 is in contact with the friction member 11*c*, the limitation member 1211 moves by the rotation of the feeding roller 11 due to the friction of the friction member 11*c*. As a result, the feed performance cannot be stable, and strange noises tend to occur. Therefore, for example, there is a need to provide a structure that reduces the friction in a position on the limitation member 1211 that abuts against friction member 11*c*. In this embodiment, in order for the limitation member 1211 to act on the document S more suitably, the limitation member 1211 is formed so as not to come into contact with the friction member 11*c* but with the cylindrical portion 11*d* made of a low-friction material. By doing so, the structure of the limitation member 1211 can be a structure that performs a suitable action on the batch of documents and the document S as described in the abovementioned embodiments, and can enhance the effect of reducing the occurrence of the curling of the leading edge of the document S and the jam by causing the limitation member 1211 to butt against and be in pressure contact with the cylindrical portion 11*d* that is a part of feeding unit.

The devices of Embodiments 1 and 2 described above have a configuration in which the limitation member 1211 that is an example of the movable member is rotatably supported by the separation swinging member 121, but the configuration is not limited thereto. A configuration in which the movable member is supported by the separation swinging member 121 in a slidable or swingable manner and the limitation member 1211 is displaceable in the thickness direction of the batch of documents may be used.

Embodiment 3

Figure 21:
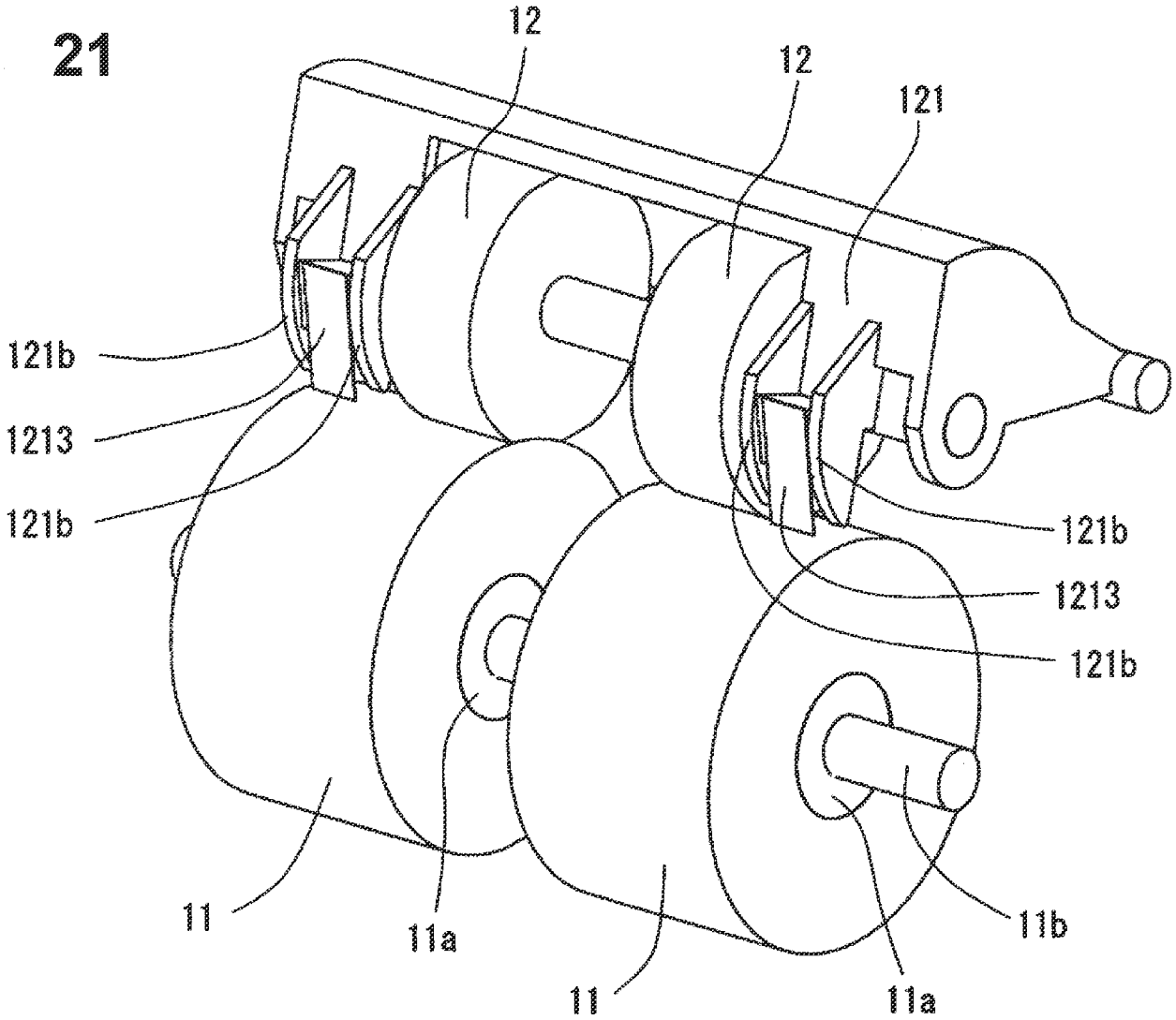
FIG. 21 is a perspective view of a feeding unit according to Embodiment 3 of Embodiment A.
Figure 22:
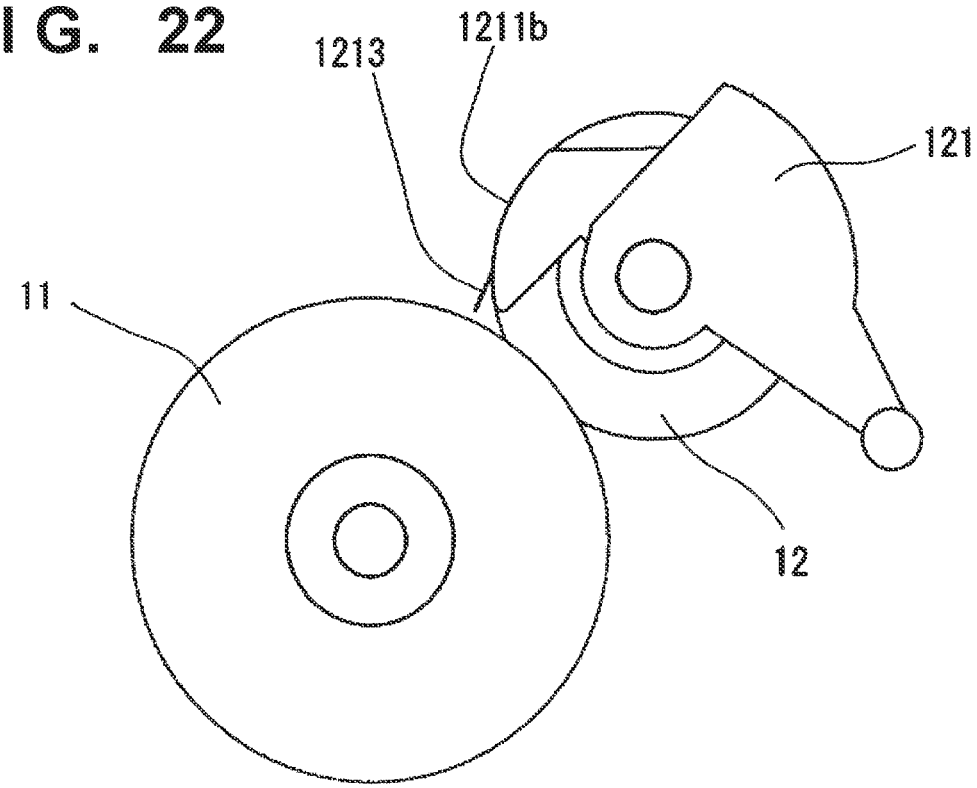
FIG. 22 is a cross-sectional view of the feeding unit in FIG. 21.

The devices of Embodiments 1 and 2 described above have a configuration in which the limitation member 1211 is provided on the separation swinging member 121, but a configuration in which an elastic member 1213 is provided instead of the limitation member 1211 as illustrated in FIG. 21 and FIG. 22 has a similar effect. In FIGS. 21 and 22, the elastic member 1213 is made of an elastically deformable material such as a thin plate or rubber, and is fixed to the separation swinging member 121. Further, an end of the elastic member 1213 protrudes to the feeding roller 11 side as with the limitation member 1211. According to the configuration, as with the limitation member 1211 described in Embodiments 1 and 2 above, the amount of the batch of documents that enters the feed nip can be limited for a particular batch of documents, the space K between the feed nip and the batch of documents leading edge can be reduced, the warp of the document S2 in the space K can be suppressed, and the occurrence of the curling of the leading edge of the document S2 and the jam can be suppressed.

Embodiment 4

Figure 23:
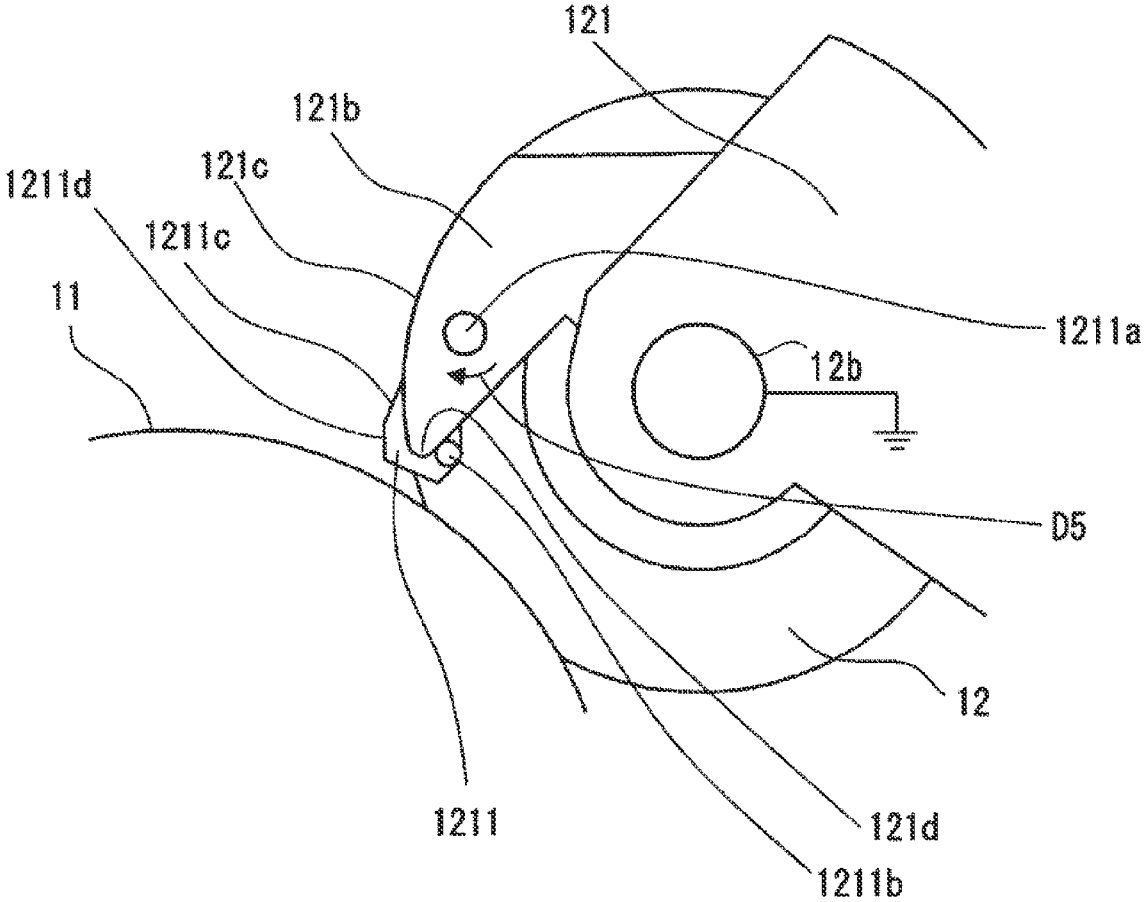
FIG. 23 is a cross-sectional view of a feeding unit according to Embodiment 4 of Embodiment A.

A discharging structure that discharges the document may be provided. FIG. 23 is a cross-sectional view of the feeding unit that is an example thereof. In the example of FIG. 23, a shaft 12*b* of the separation roller 12 is grounded. The shaft 12*b*, the limitation member 1211, and the separation swinging member 121 are formed by conductive members. Even when static electricity occurs by the friction between the document and the feeding unit and the like, the static electricity of the document can be released through the limitation member 1211, the separation swinging member 121, and the shaft 12*b*. In the example of FIG. 23, a configuration in which the shaft 12*b* is grounded is used, but a configuration in which the compression spring 122 is grounded may be used. In addition, this embodiment can also be applied to an example using the elastic member 1213 as in Embodiment 3 described above by using a conductive plastic or an elastic member on which a conductive pattern is formed as the elastic member 1213.

In the present invention, by placing both the separation rollers 12 and the movable members so as to face the feeding rollers 11 within the width (the width in the direction orthogonal to the feeding direction) by which the feeding rollers 11 are provided, the effect of sandwiching the document between the feeding rollers 11 and the movable members can be enhanced, and the downsizing can be obtained. The separation roller 12 can be formed to be smaller than the feeding roller 11 in the width direction, and the movable members and the separation swinging members 121 can be placed with use of parts in which the separation rollers 12 are not provided within the width by which the feeding rollers 11 are provided. The expression of "within the width by which the feeding rollers 11 are provided" herein means a region sandwiched between end portions on the outer sides of the rollers that are placed on the outermost sides when a plurality of the feeding rollers 11 are provided. By placing both of the separation rollers 12 and the movable members (and the separation swinging members 121) in the space facing the region, the region outside the width by which the feeding rollers 11 are provided and the space facing the region can be used as a space for placing other structures.

As described in the abovementioned embodiment, the present invention can be suitably used for the document feeding device A in which the conveying path (the feeding direction D1) is provided at a predetermined angle with respect to the mounting surface of the device. As an example of the document feeding device A, downsizing is required for a scanner and the like used on the deskside. Meanwhile, there are needs for enhancement in the feed speed. With respect to the above, the document can be fed while reducing damage on the document by using the present invention. Note that the abovementioned embodiments supply the documents to the feed mechanism by the self-weight of the documents loaded on the placing tray 1 with use of a conveying path inclined at a predetermined angle with respect to the mounting surface. Further, the feeding rollers 11 are placed on the lower side of the conveying path, and the batch of documents loaded on the placing tray 1 is sequentially fed from the bottommost document. That is, the document can be fed without providing a pick roller and the like for feeding the document, and the present invention can suitably perform an action on the jam (paper jam) of the leading edge of the document caused by the second document and documents thereafter entering the separation feed mechanism together with the document that occurs in that case. The description of Embodiment A is ended.

Embodiment B

Main problems of Embodiment B are described.

In a document feeding device of the related art, when documents are successively fed, a phenomenon in which a feeding roller rotates in reverse after one sheet of document is fed occurs. This phenomenon occurs because a separation roller rotates the feeding roller in reverse by the force charged in a torque limiter of the separation roller. By this phenomenon, the loaded document is returned to the upstream side by a several millimeters. When the next document is fed in this state, there have been cases where feeding failures such as the curling of the leading edge of the document, a feed jam, and a skew occur. In addition, because the phenomenon in which the feeding roller rotates in reverse occurs after one sheet of document is fed, a tap tone occurs in a mesh portion between a feeding roller gear and a feed drive gear.

There are document feeding devices of the related art in which the reverse rotation of the feeding roller is prevented by providing a one-way clutch between a shaft of a feeding roller and a gear that transmits the drive force from a motor to the shaft. However, there is a backlash until the locking occurs in the one-way clutch, and there is also a gap between a member holding the one-way clutch (not shown) and the device main body. Therefore, the feeding roller rotates in reverse by the amount of the backlash and the gap.

Embodiment B provides a feature that prevents the reverse rotation of the feeding roller and enhances the feed performance.

Embodiment 1

Figure 24:
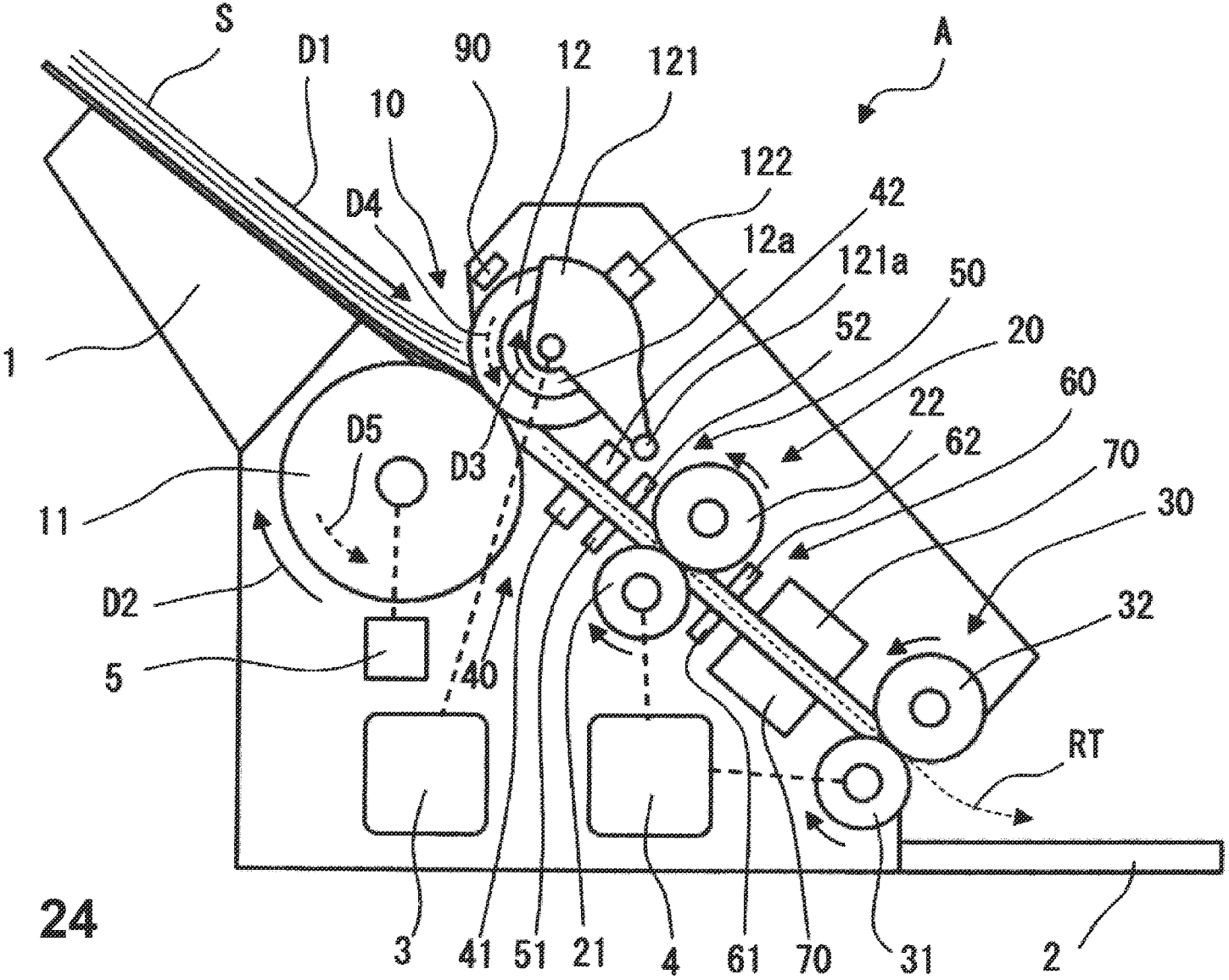
FIG. 24 is a schematic cross-sectional view of a document feeding device according to Embodiment 1 of Embodiment B.

Embodiment 1 is described with reference to FIG. 24 to FIG. 36. FIG. 24 is a schematic view of a document feeding device A according to an embodiment of the present invention.

<Configuration of Device>

The document feeding device A is a device that conveys one or more documents S loaded on a placing tray 1 one by one into the device through a route RT, reads images thereof, and outputs the documents S to an output tray 2. The documents S to be read may be sheets such as an OA paper, a bill, a check, a business card, and cards, for example, and may be a thick sheet or a thin sheet. The cards can include an insurance card, a license, a credit card, and the like, for example.

<Feeding>

As illustrated in FIG. 24, a first conveyance unit 10 serving as a feed mechanism that feeds the documents S along the route RT is provided. In this embodiment, the first conveyance unit 10 includes feeding rollers 11 and separation rollers 12 placed so as to face the feeding rollers 11, and sequentially conveys the documents S on the placing tray 1 one by one in a conveying direction D1.

The drive force is transmitted to the feeding rollers 11 from a motor 3 via a transmission unit 5, and is driven to rotate in the direction of solid arrow D2 (the direction in which the documents S are conveyed along the route RT) in FIG. 24. The transmission unit 5 is an electromagnetic clutch, for example, and intermittently provides the drive force from the motor 3 to the feeding rollers 11.

<Separation>

The separation rollers 12 placed so as to face the feeding rollers 11 are rollers for separating the documents S into separate sheets and are in pressure contact with the feeding rollers 11 at a constant pressure. In order to ensure the pressure contact state, the separation rollers 12 are supported by a separation float 121 as illustrated in FIG. 24. The separation float 121 is rotatably supported about a shaft portion 121*a*. In addition, the separation float 121 is applied with a biasing force by a compression spring 122 so that the separation rollers 12 are in pressure contact with the feeding rollers 11.

As illustrated in FIG. 24, the drive force is transmitted to the separation rollers 12 from the motor 3 via a torque limiter 12*a*, and the separation rollers 12 are driven to rotate in the direction of solid arrow D3. The transmission of the drive force to the separation rollers 12 is restricted by the torque limiter 12*a*, and hence the separation rollers 12 rotate in a direction (the direction of dashed arrow D4) of rotating together with the feeding rollers 11 when in abutment against the feeding rollers 11. As a result, when the plurality of documents S are conveyed to a portion at which the feeding rollers 11 and the separation rollers 12 are in pressure contact with each other, the plurality of documents S are held back so that two or more of the documents S are not conveyed to the downstream besides one document S.

<Drive Transmission Unit>

In this embodiment, for example, the transmission unit 5 that connects the motor 3 and the feeding rollers 11 with each other is caused to be in a state (hereinafter referred to as "ON") in which the drive force is transmitted in a normal state, and is caused to be in a state (hereinafter referred to as "OFF") in which the drive force is blocked when the documents S are fed in the opposite direction at the time of multi-feed retry described below. At the time of multi-feed retry, when the transmission unit 5 is turned OFF, the feeding rollers 11 are caused to be in a state of being freely rotatable and rotate in the direction of dashed arrow D5 together with the separation rollers 12 driven to rotate in the direction of solid arrow D3 in FIG. 24. Note that the transmission unit 5 as above does not necessarily need to be provided when the feeding rollers 11 are only driven in one direction.

<Feeding Roller>

Figure 25:
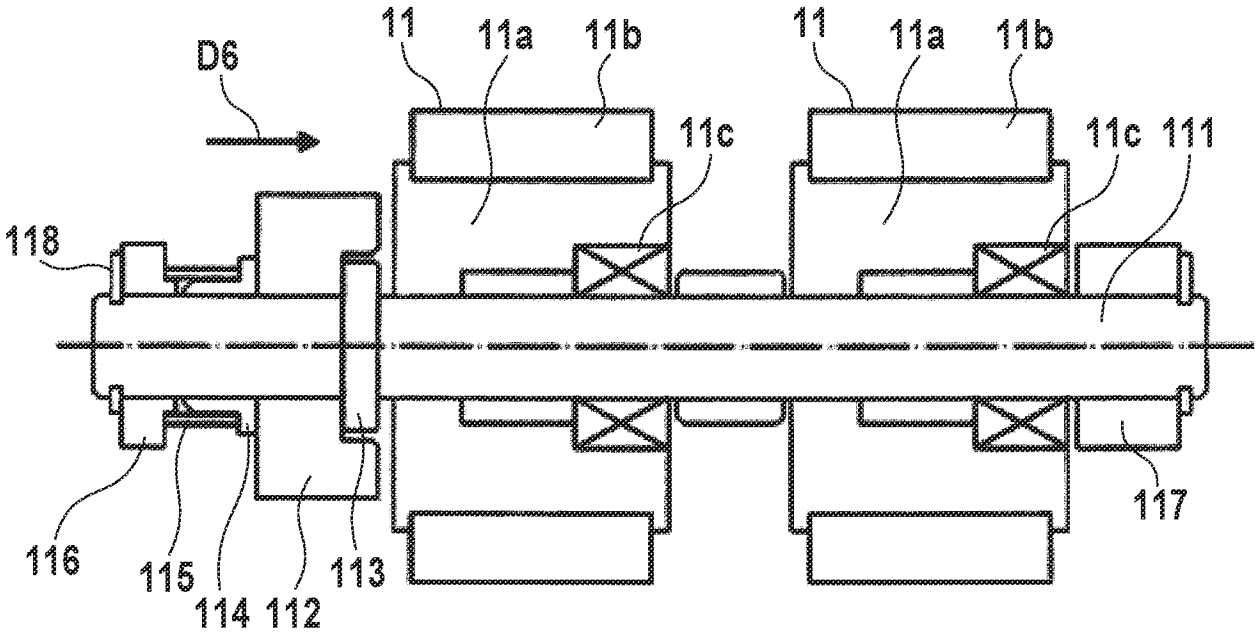
FIG. 25 is a schematic cross-sectional view of feeding rollers.

The configuration of the feeding rollers 11 is illustrated in FIG. 25. FIG. 25 is a schematic cross-sectional view of the feeding rollers 11, and the feeding roller 11 includes a roller core 11*a*, a rubber portion 11*b* included on the outer layer of the roller core 11*a*, and a one-way clutch 11*c* included in the roller core 11*a*.

The feeding rollers 11 are supported by a feeding roller shaft 111. When the feeding roller shaft 111 rotates in the feeding direction (the direction of solid arrow D2 in FIG. 24), the one-way clutches 11*c* mesh with the feeding roller shaft 111, and the feeding roller 11 rotates in the feeding direction. The conveying speed of the feeding rollers 11 is set to be a speed that is slower than the conveying speed of a conveying roller 21 described below. Therefore, when the fed document S reaches the conveying roller 21 and the conveying speed increases, the feeding rollers 11 rotate together with the conveyed document and rotates faster than the speed at which the feeding rollers 11 rotate by the drive transmission from the motor 3 because there is the one-way clutch 11*c*.

Note that, in this embodiment, each of the one-way clutches 11*c* is provided for each of two feeding rollers, but the one-way clutch 11*c* does not necessarily need to be provided as above. For example, the one-way clutch 11*c* may be provided between the feeding roller shaft 111 and a feeding roller gear 112 described below. Alternatively, a single feeding roller 11 or three or more feeding rollers 11 may be provided, and each of the one-way clutches 11*c* may be provided between each of the feeding rollers 11 and the feeding roller shaft 111. In addition, a plurality of the feeding rollers 11 may be connected to only a side in the vicinity of the feeding roller shaft 111, and a single one-way clutch 11*c* may be provided between the feeding rollers 11 and the feeding roller shaft 111.

The feeding roller gear 112 engages with the feeding roller shaft 111 by a parallel pin 113 so as to rotate with the feeding roller shaft 111 in an integrated manner. Further, the movement of the feeding roller gear 112 on the feeding roller shaft 111 in the direction of solid arrow D6 (the direction approaching the feeding rollers 11) is restricted by the parallel pin 113. A friction disc 114 is in pressure contact with a side facing the parallel pin 113 across the feeding roller gear 112 by a compression spring 115.

Note that, other than the compression spring 115, a flat spring and the like may be used, and the part only needs to be a part that comes into physical contact with and applies a load to the feeding roller shaft 111 or the feeding roller gear 112 by the friction disc 114. In particular, it is preferred that the part can elastically apply bias.

Both ends of the feeding roller shaft 111 are supported by a bearing 116 and a bearing 117. The bearing 116 is in pressure contact with the compression spring 115, and is prevented from slipping out from the feeding roller shaft 111 by a slip prevention member 118 fixed to the feeding roller shaft 111. The bearing 116 is held by the device main body and the rotation of the bearing 116 is restricted.

Figure 26:
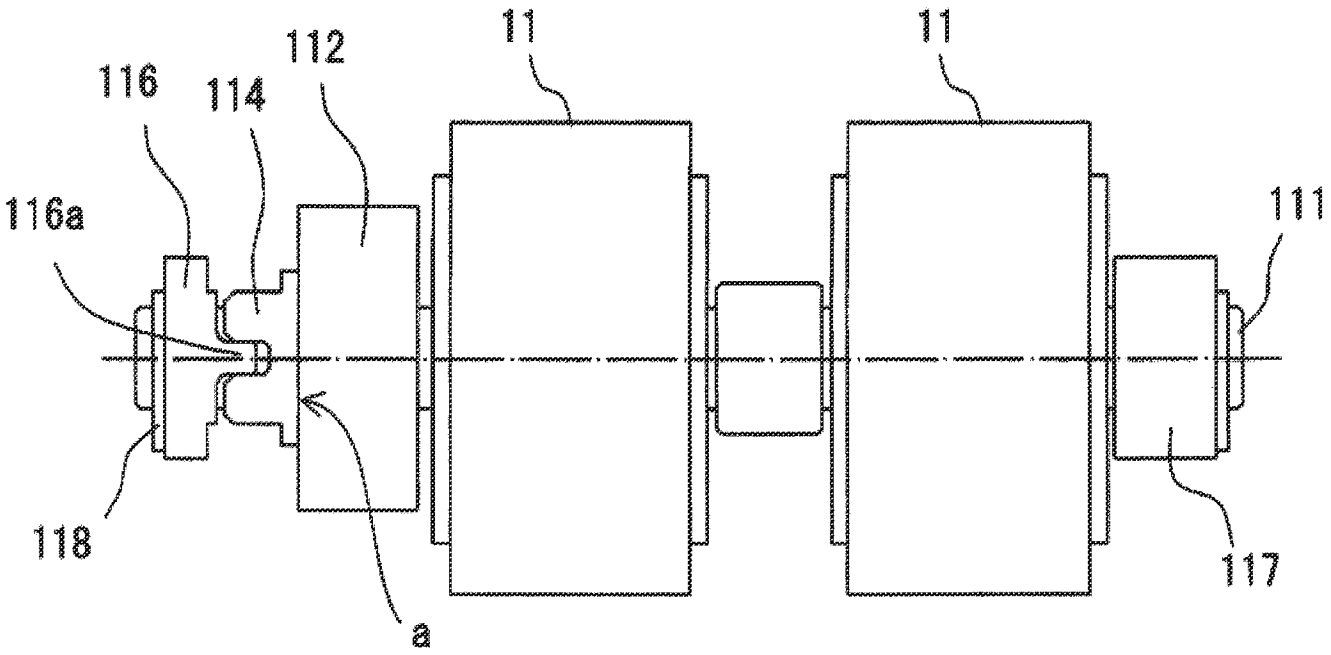
FIG. 26 is a schematic view of the feeding rollers.
Figure 27:
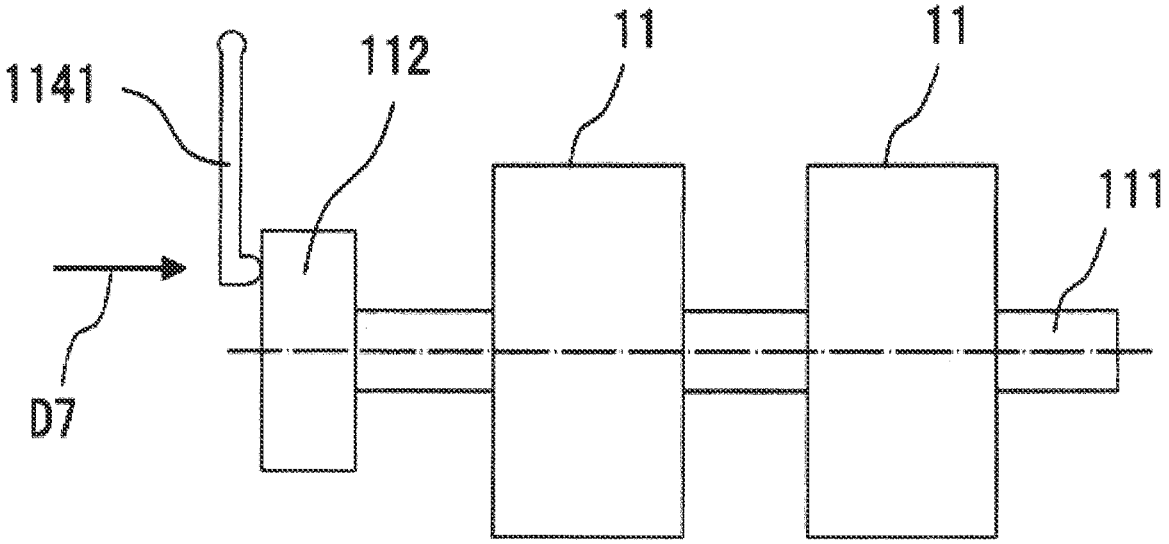
FIG. 27 is another schematic view of the feeding rollers.
Figure 28:
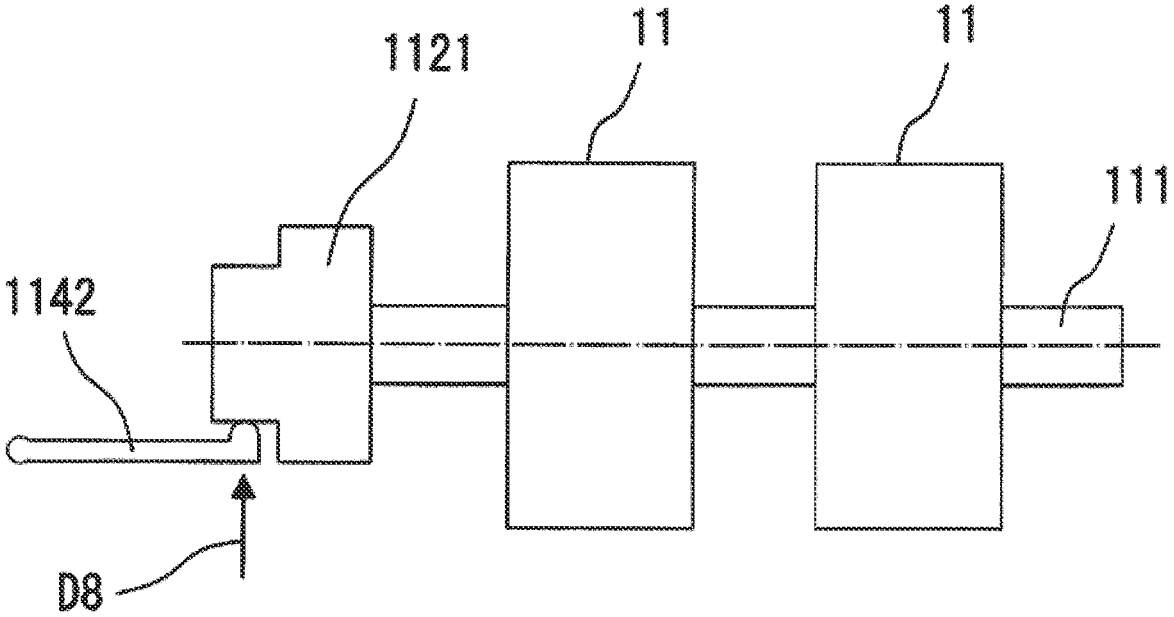
FIG. 28 is another schematic view of the feeding rollers.

The detailed shapes of the bearing 116 and the friction disc 114 are illustrated in FIG. 26. As in FIG. 26, the bearing 116 includes an engagement portion 116*a* that engages with the friction disc 114, and prevents the friction disc 114 from rotating together with the feeding roller gear 112 that is rotating. The feeding roller gear 112 is in contact with the friction disc 114 at a surface a, and the rotation of the feeding roller gear 112 is restricted by a load applied in the rotation direction by a torque (hereinafter referred to as a "restriction torque") that occurs from a friction and the like on the contact portion.

The restriction torque that restricts the rotation of the feeding roller gear 112 is set to a value larger than the drag torque necessary for the feeding rollers 11 to run idle on the feeding roller shaft 111. The restriction torque that restricts the rotation of the feeding roller gear 112 is a torque that occurs by the friction between the feeding roller gear 112 and the friction disc 114, the friction between the slip prevention member 118 and the bearing 116, the friction between the bearing 116 and the feeding roller shaft 111, and the friction between the bearing 117 and the feeding roller shaft 111. The drag torque necessary for the feeding rollers 11 to run idle with respect to the feeding roller shaft 111 is a torque obtained by adding the drag torque when the one-way clutch 11*c* runs idle with respect to the feeding roller shaft 111 and a torque that occurs by the friction between the roller core 11*a* and the feeding roller shaft 111.

Note that the way that the friction disc 114 and the feeding roller gear 112 are in contact with each other at the surface a is not necessarily limited to the mode described above. For example, a rod-like member 114*a* capable of pressing the feeding roller gear 112 to the direction in which the feeding roller shaft 111 extends may be formed instead of the friction disc 114, and the rod-like members 114*a* may be able to press the feeding roller gear 112 to the direction in which the feeding roller shaft 111 extends at a plurality of places. Further, the pressing direction is also not limited to the direction in which the feeding roller shaft 111 extends as long as the direction provides a friction resistance that restricts the rotation of the feeding roller gear 112. A specific configuration is described below with use of FIG. 28 and the like.

By the configuration above, when the feeding rollers 11 freely rotate in the conveying direction, the feeding roller gear 112 is held in a stopped state without rotating together with the feeding rollers 11. In particular, when the feeding rollers 11 are biased by the separation rollers 12 in a direction (the direction of dashed arrow D5 in FIG. 24) of rotating in the direction opposite to the feeding direction, the feeding roller shaft 111 and the feeding roller gear 112 start to rotate in the reverse direction in accordance with the reverse rotation of the feeding rollers 11. However, the reverse rotation of the feeding roller gear 112 is restricted by the friction disc 114. As a result, the document can be prevented from returning to the direction opposite to the feeding direction. In addition, a tap tone caused by the contact between the feeding roller gear 112 and a feed drive gear 73 for transmitting the drive force from a drive unit 3 to the feeding roller gear 112 that are pushed back by the amount of backlash between the gears can be prevented from occurring.

Note that a structure using the separation rollers 12 is described in this embodiment, but the present invention is not necessarily limited to a form of a roller. The same applies to a case where a part that applies load to the document in the direction opposite to the feeding direction, for example, a separation pad is used, and the separation means may be any kind of form.

In this embodiment, the configuration in FIG. 25 including the feeding rollers 11 is one unit, and is a unit that is mountable on and removable from the device for maintenance and the like.

In addition, the configuration for generating the restriction torque is not limited to the configurations above. The configuration may be a configuration in which a sliding member 1141 that is in pressure contact with the feeding roller gear 112 from the thrust direction (the direction of solid arrow D7) is provided as in FIG. 27. In addition, the configuration may be a configuration in which a sliding member 1142 that is in pressure contact with the feeding roller gear 1121 from the radial direction (the direction of solid arrow D8) is provided as in FIG. 28.

Figure 29:
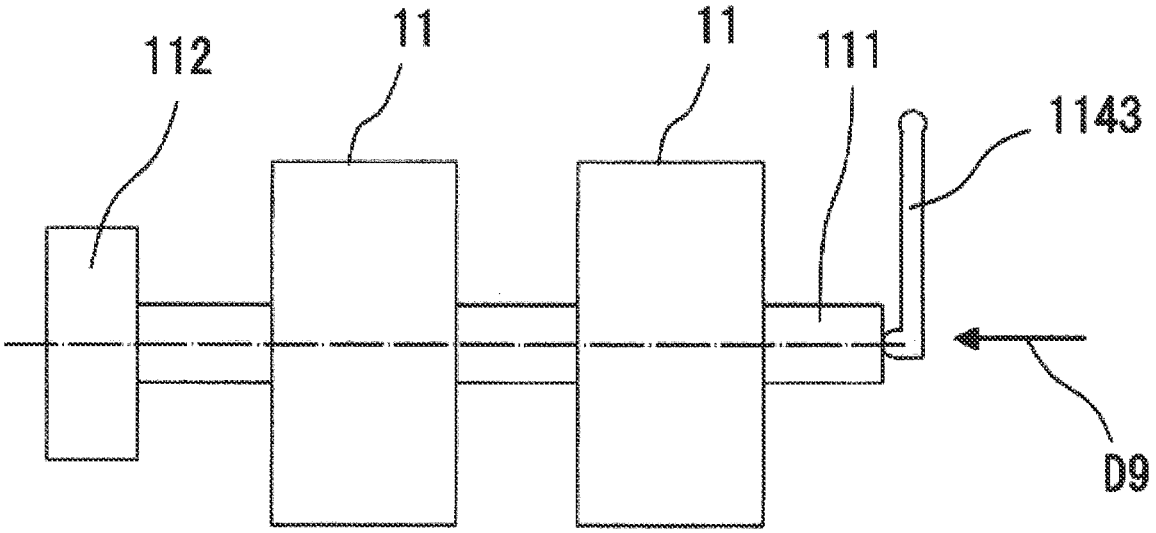
FIG. 29 is another schematic view of the feeding rollers.
Figure 30:
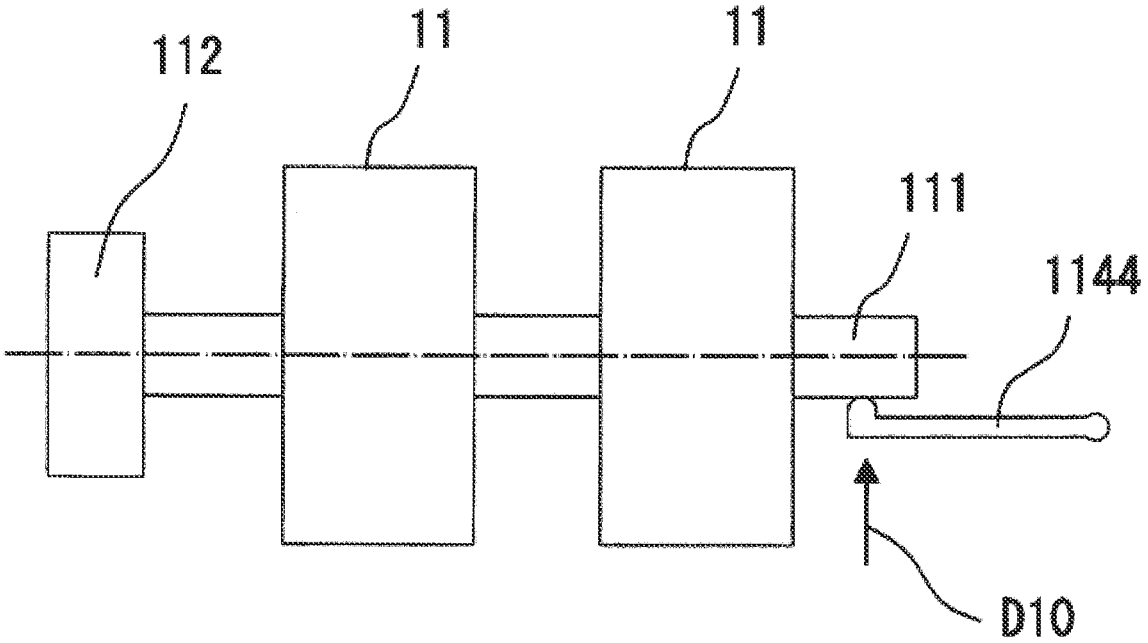
FIG. 30 is another schematic view of the feeding rollers.

In addition, the configuration may be a configuration in which a sliding member 1143 that is in pressure contact with the feeding roller shaft 111 from the thrust direction (the direction of solid arrow D9) is provided as in FIG. 29. In that case, the feeding roller shaft 111 may be biased from the side opposite to the side on which the feeding roller gear 112 is provided as illustrated in FIG. 29, or may be biased from the feeding roller gear 112 side. In addition, the configuration may be a configuration in which a sliding member 1144 that is in pressure contact with the feeding roller shaft 111 from the radial direction (the direction of solid arrow D10) is provided as in FIG. 30. In that case, the feeding roller shaft 111 may be biased from the side opposite to the side on which the feeding roller gear 112 is provided as illustrated in FIG. 30, or may be biased from the feeding roller gear 112 side.

<Feed/Separation Drive Unit>

Figure 31:
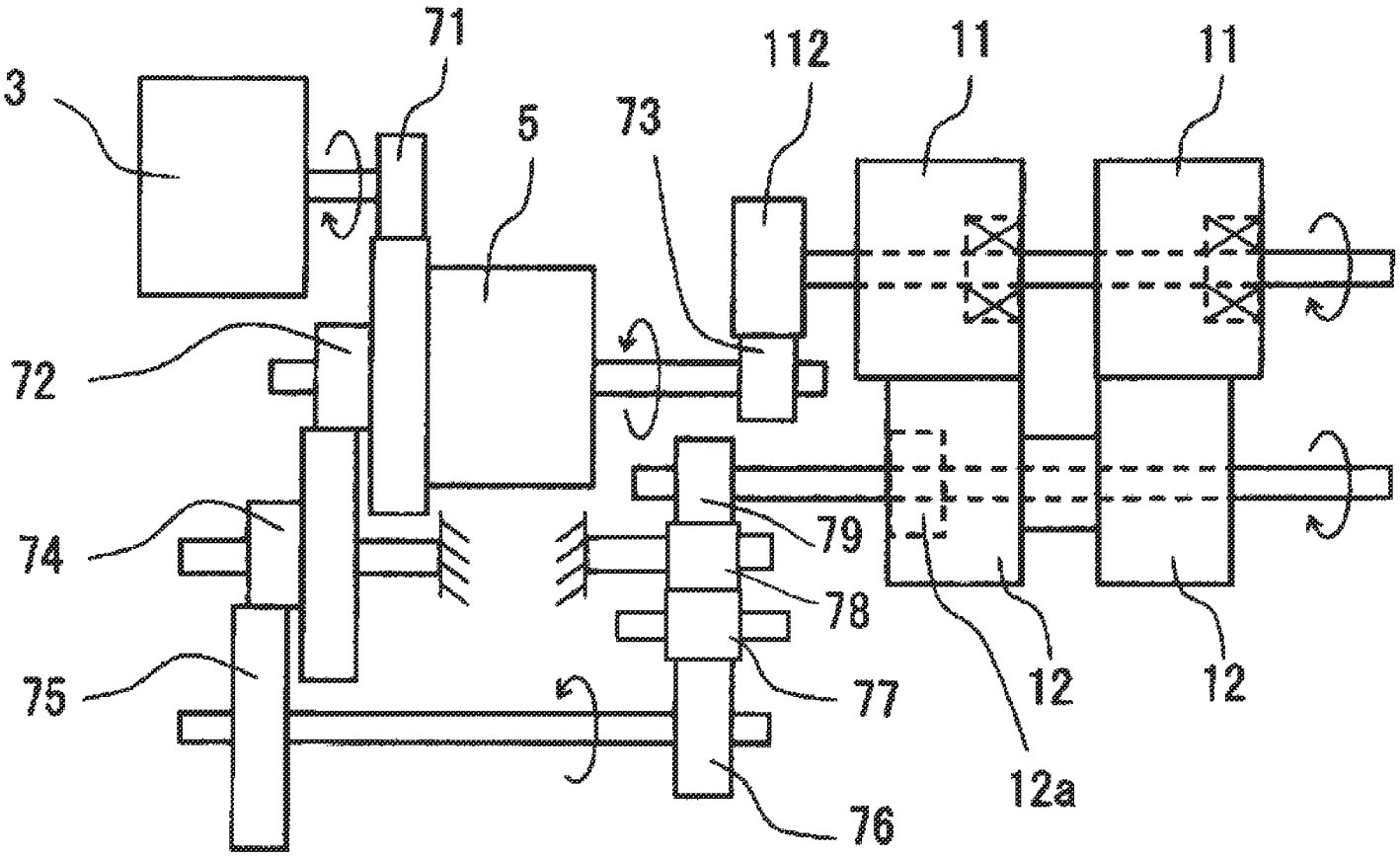
FIG. 31 is a schematic view of a feed/separation drive unit.

FIG. 31 is a schematic view of a feed/separation drive unit according to Embodiment 1 of the present invention. As illustrated in FIG. 31, the drive force from the motor 3 is transmitted to the feed drive gear 73 via a gear 71, a stepped gear 72, and the transmission unit 5. The feed drive gear 73 transmits the drive force to the feeding roller gear 112, and drives the feeding rollers 11. In addition, the drive force from the motor 3 is passed to the torque limiter 12*a* included in each of the separation rollers 12 via the gear 71, the stepped gear 72, a stepped gear 74, and gears 75 to 79, and is transmitted via the torque limiter 12*a* to the separation rollers 12.

<Document Detection Structure of Feeding Unit>

In order to detect whether there are documents on the placing tray 1, a document detection sensor 90 is provided on an upstream portion of the feeding rollers 11 as illustrated in FIG. 24. An example of the document detection sensor 90 is a lever-type sensor described in Embodiment A. As another example, the document detection sensor 90 may be an optical sensor such as medium detection sensors 50 and 60 described below.

<Conveyance Structure>

As illustrated in FIG. 24, a second conveyance unit 20 serving as a conveying mechanism on the downstream side of the first conveyance unit 10 in the conveying direction includes a driving roller 21 and a driven roller 22 driven by the driving roller 21, and conveys the document S conveyed from the first conveyance unit 10 to the downstream side thereof. The drive force is transmitted to the driving roller 21 from the motor 4, and the conveying roller 21 is driven to rotate in the direction of the arrow in FIG. 1. The driven roller 22 is in pressure contact with the driving roller 21 at a constant pressure, and rotates together with the driving roller 21.

A third conveyance unit 30 that is on the downstream side of the second conveyance unit 20 as above in the conveying direction includes a driving roller 31 and a driven roller 32 driven by the driving roller 31, and conveys the document S conveyed from the second conveyance unit 20 to the output tray 2. That is, the third conveyance unit 30 serves as an output mechanism. The drive force is transmitted to the driving roller 31 from the motor 4, and the driving roller 31 is driven to rotate in the direction of the solid arrow in FIG. 1. The driven roller 32 is in pressure contact with the driving roller 31 at a constant pressure, and rotates together with the driving roller 31.

<Multi-Feed Detection>

A multi-feed detection sensor 40 placed between the first conveyance unit 10 and the second conveyance unit 20 is an example of a detection sensor (a sensor that detects the behavior and the state of the documents) for detecting, when the documents S such as paper have passed through the first conveyance unit 10 in a state in which the documents S are stuck together due to static electricity and the like (that is, in a multi-feed state in which the documents S are conveyed while overlapping with each other), the state. As the multi-feed detection sensor 40, various sensors may be used. In this embodiment, the multi-feed detection sensor 40 is an ultrasonic sensor, and includes a transmitting unit 41 for ultrasonic waves and a receiving unit 42 thereof. Further, the multi-feed detection sensor 40 detects multi-feed on the basis of the principle that the attenuation of the ultrasonic waves that passes through the documents S such as paper changes between a case where the documents S are multi-fed and a case where the documents S are conveyed one by one.

<Registration Sensor>

A medium detection sensor 50 placed on the downstream side of the multi-feed detection sensor 40 as above in the conveying direction is an example of a detection sensor (a sensor that detects the behavior and the state of the documents) on the upstream side placed on the upstream side of the second conveyance unit 20 and the downstream side of the first conveyance unit 10. The medium detection sensor 50 detects the position of the document S conveyed by the first conveyance unit 10. In detail, the medium detection sensor 50 detects whether an edge of the document S has reached or passed through a detection position of the medium detection sensor 50. As the medium detection sensor 50, various sensors can be used. In this embodiment, the medium detection sensor 50 is an optical sensor, and includes a light-emitting unit 51 and a light-receiving unit 52 thereof. Further, the medium detection sensor 50 detects the document S on the basis of a principle that the intensity of the received light (the amount of the received light) changes when the document S reaches or passes through the medium detection sensor 50.

In this embodiment, the abovementioned medium detection sensor 50 is provided on the downstream side of the multi-feed detection sensor 40 in the vicinity thereof so that the document S reaches a position at which the multi-feed detection sensor 40 can detect multi-feed at the time point at which the leading edge of the document S is detected by the medium detection sensor 50. Note that the medium detection sensor 50 is not limited to the abovementioned optical sensor. For example, a sensor (an image sensor and the like) that can detect the edge of the document S may be used, or a lever-type sensor protruding to the route RT may be used.

A medium detection sensor 60 different from the medium detection sensor 50 is placed on the upstream side of an image reading unit 70. The medium detection sensor 60 is an example of a detection sensor on the downstream side placed on the downstream side of the second conveyance unit 20, and detects the position of the document S conveyed by the second conveyance unit 20. As the medium detection sensor 60, various sensors can be used. In this embodiment, the medium detection sensor 60 is an optical sensor as with the medium detection sensor 50, and includes a light-emitting unit 61 and a light-receiving unit 62. Further, the medium detection sensor 60 detects the document S on the basis of a principle that the intensity of the received light (the amount of the received light) changes when the document S reaches or passes through the medium detection sensor 60.

<Place of CIS>

The image reading unit 70 on the downstream side of the medium detection sensor 60 performs optical scanning, conversion into an electrical signal, and reading as image data, for example, and includes a light source such as an LED, an image sensor, a lens array, and the like on the inside thereof. In this embodiment, the image reading unit 70 is placed on each of both sides of the route RT, and reads the front and back surfaces of the document S.

<Description of Block Diagram>

Figure 32:
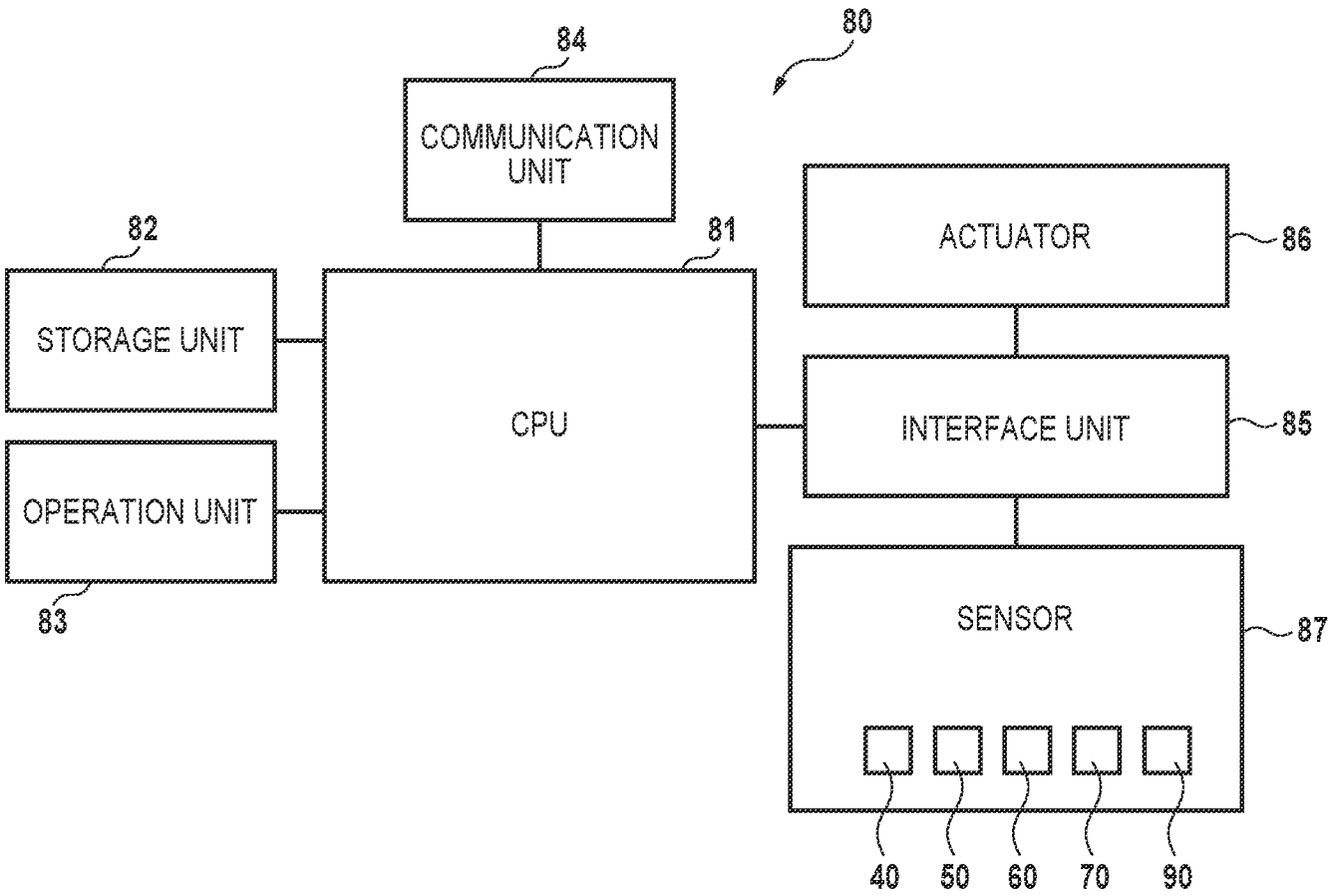
FIG. 32 is a block diagram of a controlling unit.

A control unit 80 is described with reference to FIG. 32. FIG. 32 is a block diagram of the control unit 8 of the document feeding device A.

The control unit 80 includes a CPU 81, a storage unit 82, an operation unit 83, a communication unit 84, and an interface unit 85. The CPU 81 controls the entire document feeding device A by executing a program stored in the storage unit 82. The storage unit 82 is formed by a RAM, a ROM, or the like, for example. The operation unit 83 is formed by a switch, a touch panel, and the like, for example, and receives the operation from an operator.

The communication unit 84 is an interface that communicates information with an external device. When a PC (personal computer) is supposed as the external device, a USB interface or a SCSI interface can be used as the communication unit 84, for example. In addition, other than the wired communication interfaces as above, the communication unit 84 may be a wireless communication interface, or may include interfaces for both wired communication and wireless communication.

The interface unit 85 is an I/O interface that inputs and outputs data from and to an actuator 86 and a sensor 87. The actuator 86 includes the motor 3, the motor 4, the transmission unit 5, and the like. The sensor 87 includes the multi-feed detection sensor 40, the medium detection sensors 50 and 60, the image reading unit 70, the document detection sensor 90, and the like.

<Drive by Reception of Start Command from PC>

A basic operation of the document feeding device A is described. The control unit 80 starts to drive the first to third conveyance units 10 to 30 when the control unit 80 receives a command for starting the image reading from an external personal computer connected to the document feeding device A, for example. The documents S loaded on the placing tray 1 are conveyed one by one from the bottommost document S.

<Control of Multi-Feed>

It is determined by the multi-feed detection sensor 40 whether multi-feed of the documents S is performed in the middle of the conveyance. When it is determined that the multi-feed is not performed, the conveyance is continued. Note that, when it is determined the multi-feed is performed, multi-feed retry described below may be performed, the conveyance may be stopped, or the intake of the following document S by the first conveyance unit 10 may be stopped and the documents S in the multi-feed state may be output without any change. The multi-feed retry is a function of causing the documents of which multi-feed is detected to move in the reverse direction and performing the feed again. When the transmission unit 5 is turned OFF when the multi-feed is detected, the feeding rollers 11 are caused to be in a freely rotatable state and rotate together with the rotation of the separation rollers 12, and the document can be caused to move in the reverse direction.

<Start of Reading in Accordance with Output of Registration Sensor>

At a timing based on the detection result of the medium detection sensor 60, the control unit 80 starts the reading of the image of the document S, which is conveyed by the second conveyance unit 20, performed by the image reading units 70, 70. The control unit 80 temporarily stores the read images and sequentially transmits the read images to the external personal computer. The document S of which image is read is output to the output tray 2 by the third conveyance unit 30, and image reading processing of the document S ends.

<Operation Flow of Feeding and Conveying>

Figure 33:
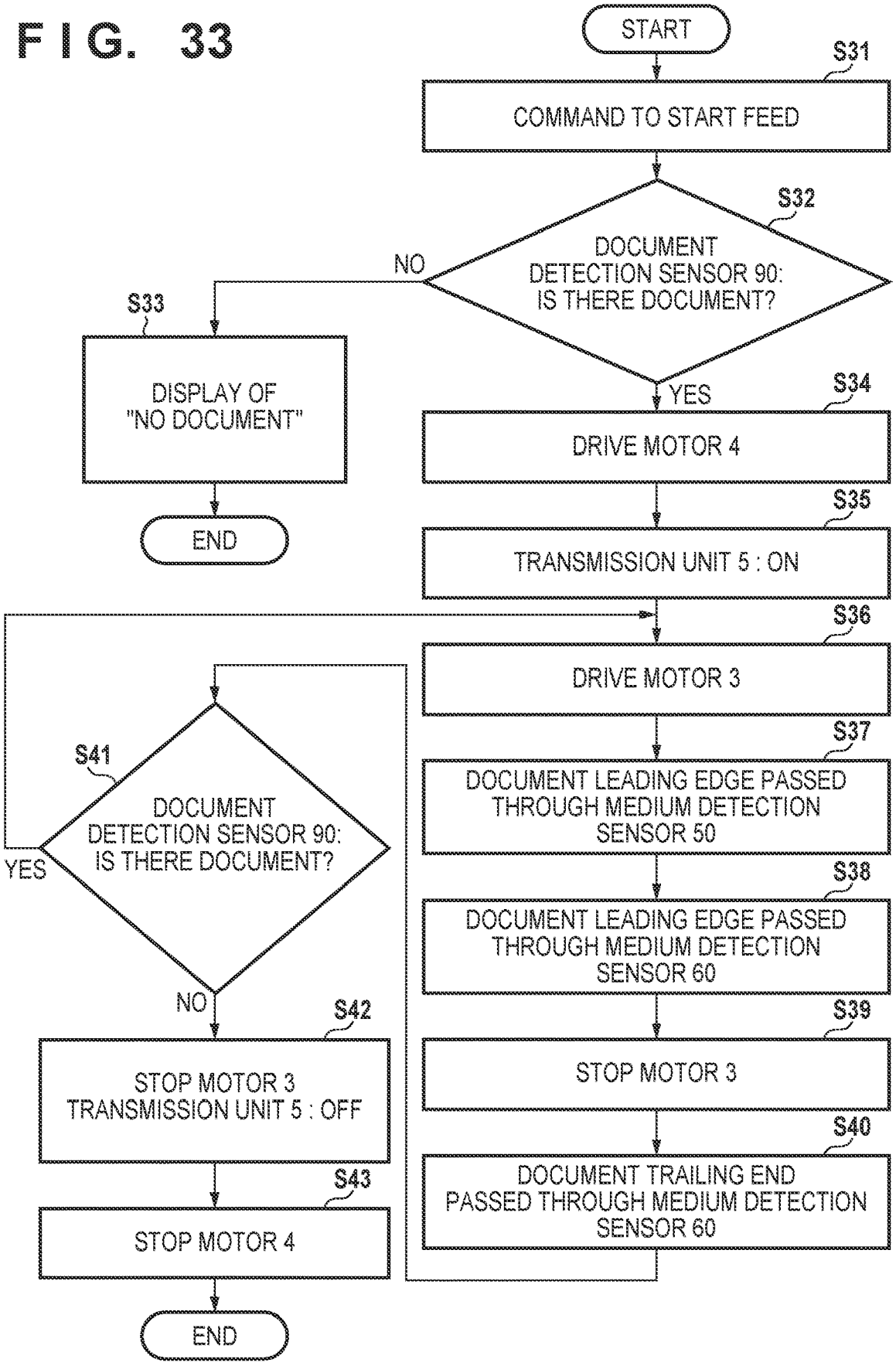
FIG. 33 is a flowchart illustrating the operation of the document feeding device in FIG. 24.

Next, the operation flow of the feeding and the conveying is described with reference to FIG. 33.

In step S31, the control unit 80 receives a command for starting the image reading from an external personal computer connected to the document feeding device A, for example.

In step S32, the control unit 80 determines whether there are documents by the document detection sensor 90.

In step S33, when the control unit 80 determines that there are no documents by the document detection sensor 90, the control unit 80 displays a notice saying that there are no documents on the external personal computer and the like, and the processing ends without performing the feeding and the conveying.

In step S34, when the control unit 80 determines that there are documents by the document detection sensor 90, the control unit 80 drives the motor 4.

In step S35, the control unit 80 turns the transmission unit 5 ON.

In step S36, the control unit 80 drives the motor 3, rotates the feeding rollers 11 in the conveying direction of the documents, and feeds the documents. The conveying speed of the feeding rollers 11 at this time is set to be a speed that is slower than the conveying speed of the second conveyance unit 20 and the third conveyance unit 30.

In step S37, it is detected that the leading edge of the conveyed document has passed through the medium detection sensor 50.

In step S38, it is detected that the leading edge of the conveyed document has passed through the medium detection sensor 60.

In step S39, the control unit 80 stops the motor 3.

In step S40, it is detected that the trailing edge of the conveyed document has passed through the medium detection sensor 60.

In step S41, the control unit 80 determines whether there are documents by the document detection sensor 90. When it is determined that there are documents, the processing proceeds to step S36.

In step S42, when the control unit 80 determines that there are no documents by the document detection sensor 90, the control unit 80 stops the motor 3 and turns the transmission unit 5 OFF.

In step S43, the control unit 80 stops the motor 4, and the operation of the feeding and the conveying ends.

By the operation flow as above, a conveying control for feeding the next document is performed with the medium detection sensor 60 being the trigger. As a result, a predetermined space between the sheets of paper is provided at the reading position of the image reading unit 70, and hence the documents are successively conveyed in a stable manner.

<Operation of Feeding Roller Gear>

Figure 34:
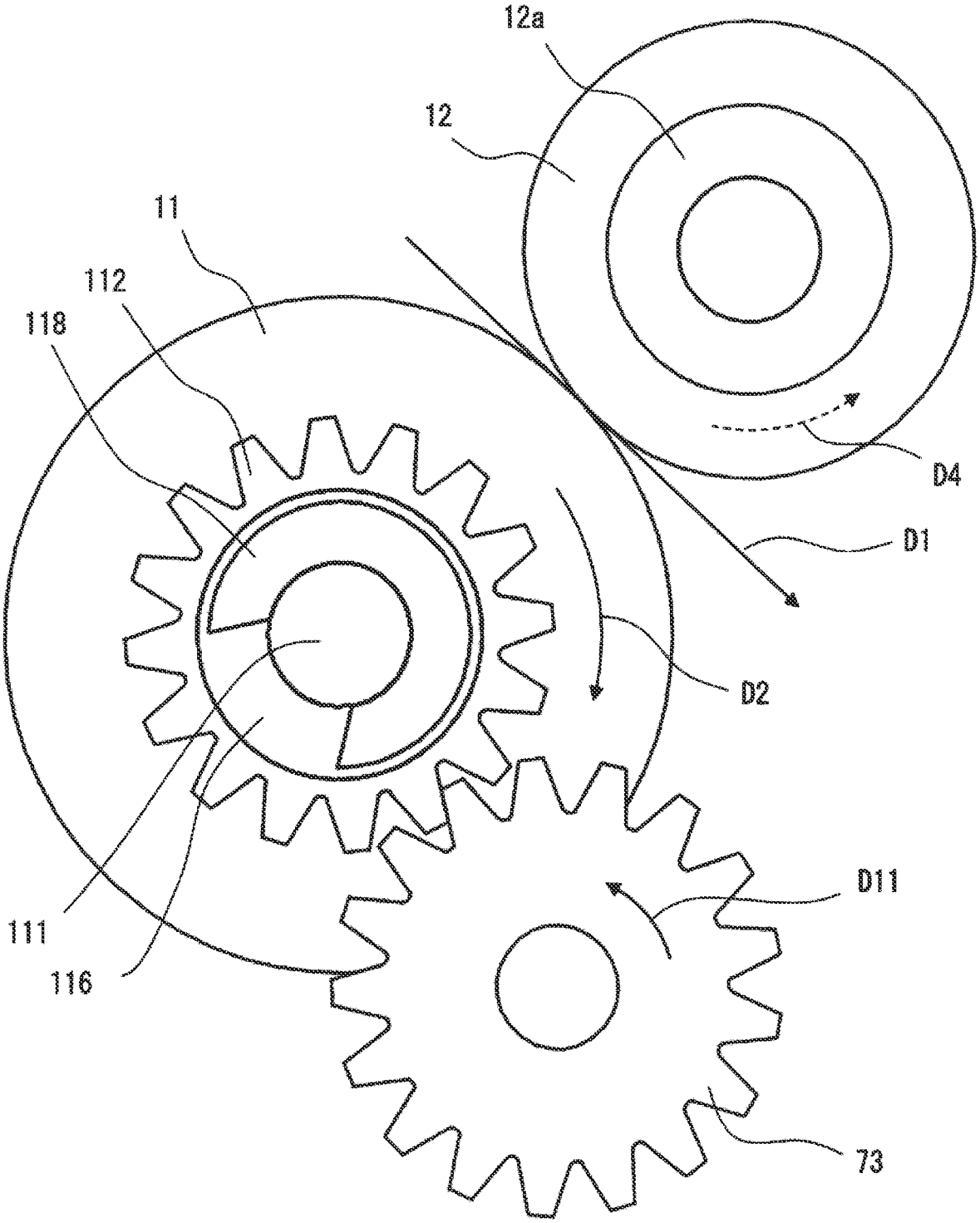
FIG. 34 is a schematic cross-sectional view of the vicinity of the feeding roller.
Figure 35:
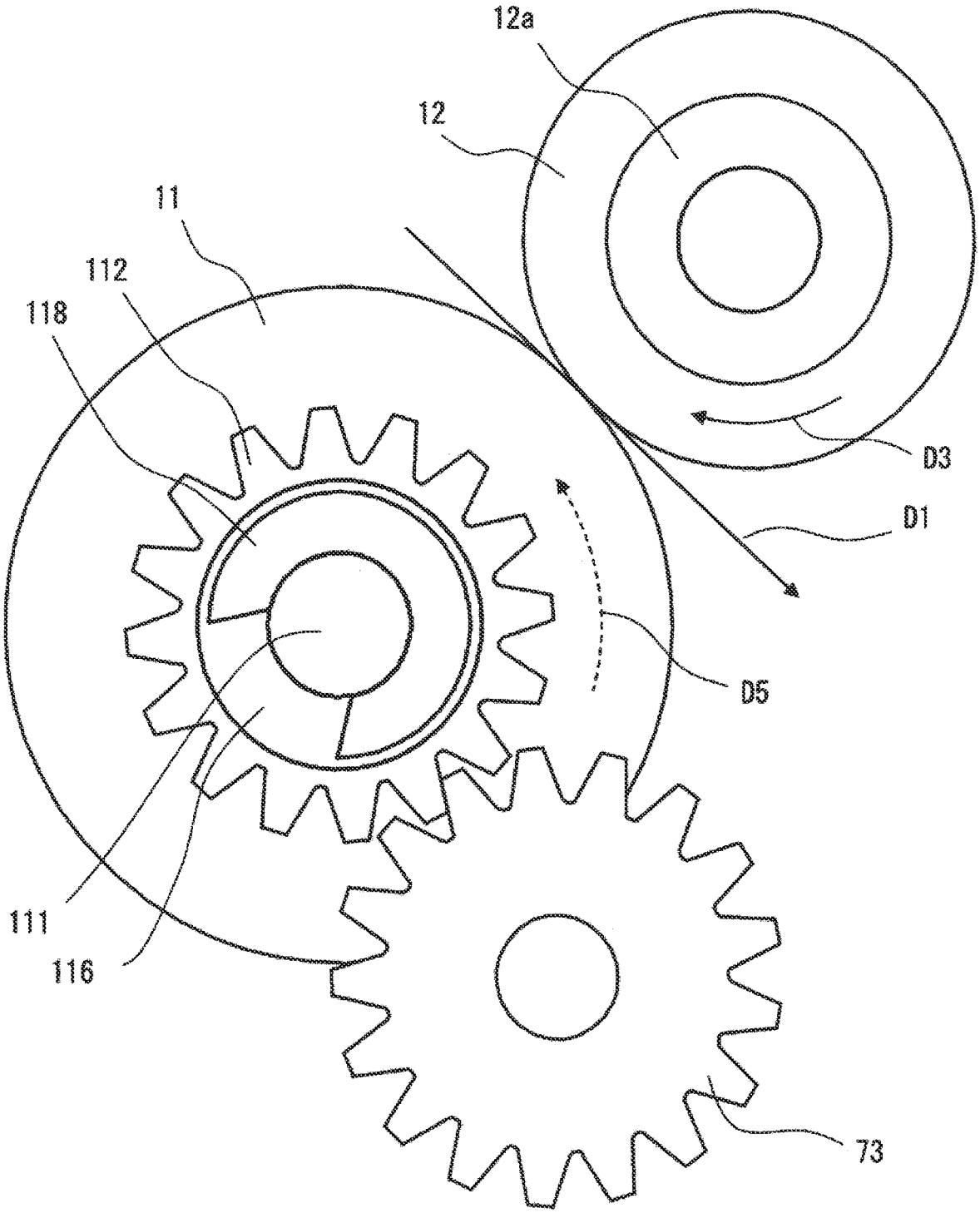
FIG. 35 is another schematic cross-sectional view of the vicinity of the feeding roller.

The operation of the feeding roller gear 112 in this embodiment is described with reference to FIGS. 34 and 35. When a document is fed, the feeding roller gear 112 is driven in the direction of solid arrow D2 by the feed drive gear 73 rotating in the direction of solid arrow D11 as in FIG. 34. Subsequently, when the leading edge of the fed document reaches the medium detection sensor 60, the motor 3 stops, and the feeding rollers 11 rotate in the conveying direction together with the conveyed document. At this time, the feeding roller gear 112 does not rotate together with the feeding rollers 11 and is held in a stopped state by the restriction torque caused by the friction and the like with the friction disc 114.

Subsequently, when the trailing edge of the document slips out from the feeding rollers 11, as in FIG. 35, the separation rollers 12 start to rotate the feeding rollers 11 in reverse (rotate in the direction of dashed arrow D5) by the force charged in the torque limiter 12*a* in each of the separation rollers 12. However, the feeding roller gear 112 and the feed drive gear 73 are meshed together, and hence the feeding rollers 11 cannot rotate in reverse. Therefore, the loaded document does not return by the feeding rollers 11, and hence the loaded document can plunge into the first conveyance unit 10 with stability in the next feed operation.

Now, the consequence of the reverse rotation of the feeding rollers 11 is described. The document butting against the separation rollers 12 is pushed back by the reverse rotation of the feeding rollers 11. Therefore, a skew may occur when the document plunges into a separation unit again, and bending or damage may occur when the leading edge abuts against the separation unit again. The expression of "being able to plunge with stability" means that, because the feeding rollers 11 cannot rotate in reverse, the following document can be maintained in a state of being held in the nip of the separation unit, and the document can be prevented from plunging into the separation unit again.

By the operation of the feeding roller gear 112 above, the reverse rotation of the feeding rollers 11 can be prevented, and a case where the documents return for each sheet of paper can be suppressed, and the feeding failure can be reduced.

In the configuration of the related art, there are no configurations that prevent the reverse rotation of the feeding rollers 11. In the configuration of the related art, when a document is fed, the feeding roller gear 112 is driven in the direction of solid arrow D2 by the feed drive gear 73 rotating in the direction of solid arrow D11 as in FIG. 34. Subsequently, when the leading edge of the fed document reaches the medium detection sensor 60, the motor 3 stops, and the feeding rollers 11 rotate in the conveying direction together with the conveyed document.

Figure 36:
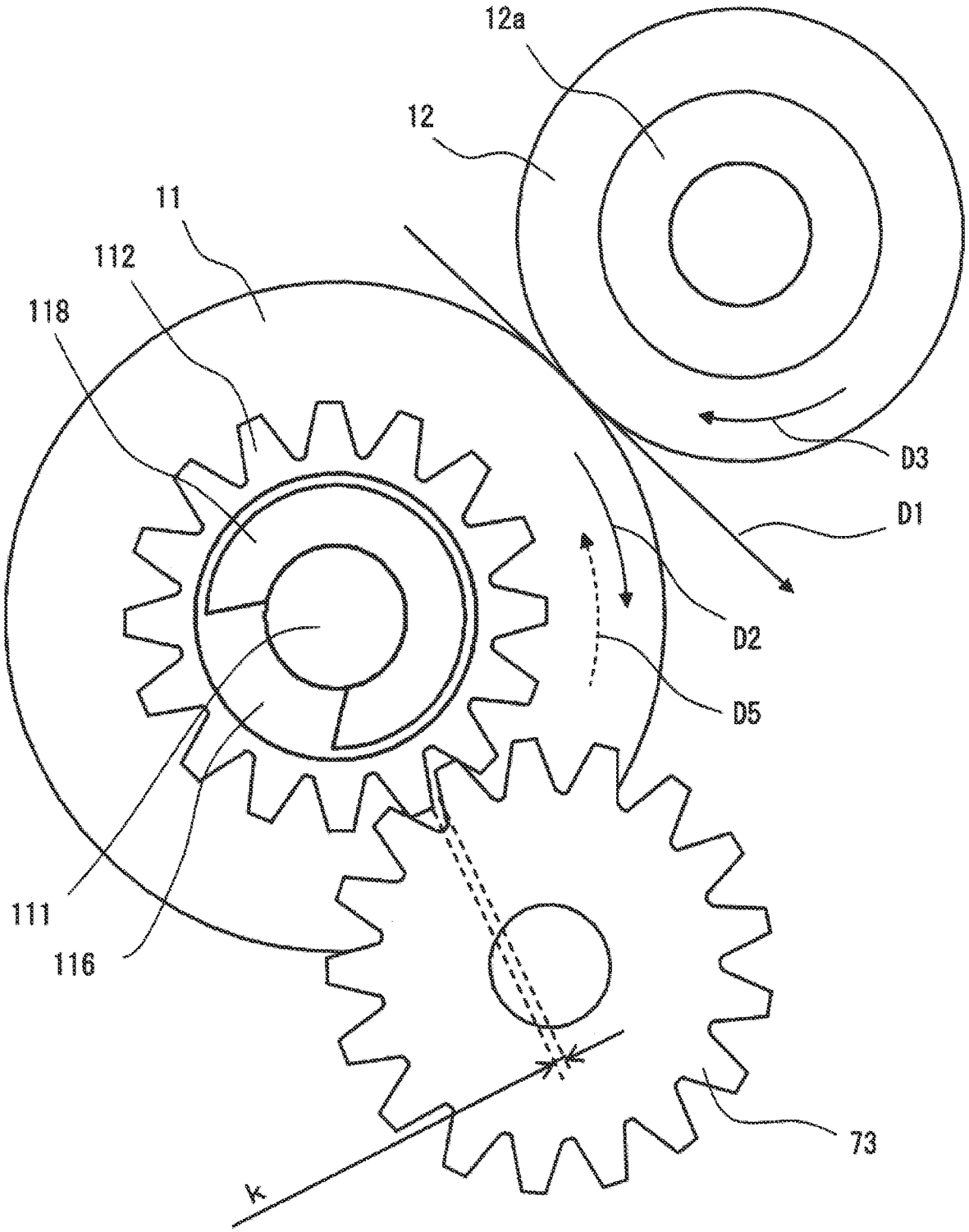
FIG. 36 is another schematic cross-sectional view of the vicinity of the feeding roller.

At this time, a gap k is formed in the rotation direction when the feeding roller gear 112 rotates in the direction of solid arrow D2 by the amount of backlash between the feeding roller gear 112 and a feed drive gear 73 as in FIG. 36 together with the feeding rollers 11 by the drag torque of the feeding rollers 11. Subsequently, when the trailing edge of the document slip out from the feeding rollers 11, the separation rollers 12 rotate the feeding rollers 11 in reverse (rotate in the direction of dashed arrow D5) by the force charged in the torque limiter 12*a* in each of the separation rollers 12. The feeding roller gear 112 rotates in the direction of dashed arrow D5 by the amount of the gap k, butts against the feed drive gear 73, and stops at the position in FIG. 35.

By this operation, the feeding rollers 11 also rotate in the direction of dashed arrow D5 by the amount of the gap k in accordance with the rotation of the separation rollers 12, and the next feed operation is performed after the loaded document returns upstream by the feeding rollers 11. There have been cases where feeding failures such as the curling of the leading edge of the document, a feed jam, and a skew occur because, the feed is performed after the feeding rollers 11 rotate in reverse and the loaded document returns upstream for each sheet of paper as described above. In addition, a tap tone occurs in a mesh portion between the feeding roller gear 112 and the feed drive gear 33 because the feeding rollers 11 rotate in reverse for each sheet of paper.

In this embodiment, by restricting the rotation of the feeding roller gear 112 by the friction disc 114 and the like, the reverse rotation of the feeding roller can be suppressed, and hence the feeding failure can be reduced, and the tap tone in the mesh portion between the feeding roller gear 112 and the feed drive gear 33 can be prevented.

Hitherto, the reverse rotation of the feeding roller has been prevented by providing a one-way clutch between the feeding roller shaft 111 and the feeding roller gear 112. However, there is a backlash in the one-way clutch until the locking occurs, and there is also a gap between the member holding the one-way clutch (not shown) and the device main body. Therefore, the feeding roller rotates in reverse by the amount of backlash and the gap. In this embodiment, the reverse rotation of the feeding roller can be effectively suppressed and the cost can be reduced as compared to a case including the one-way clutch as above by preventing the backlash and the gap relating to the one-way clutch.

Embodiment 2

The device configuration of Embodiment 2 is substantially the same as the device configuration of Embodiment 1, and the difference is the configuration of the feeding roller.

Figure 37:
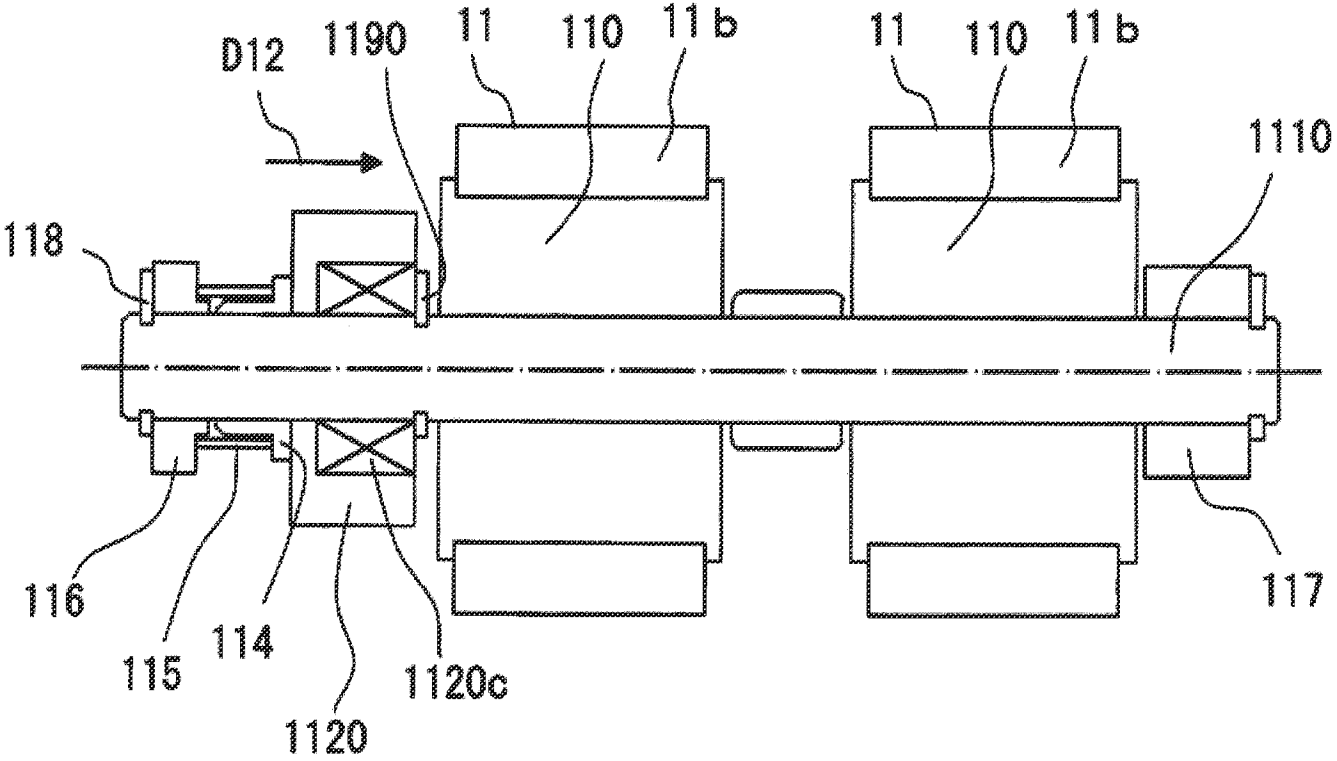
FIG. 37 is a schematic view of feeding rollers according to Embodiment 2 of Embodiment B.

The configuration of the feeding roller is illustrated in FIG. 37. The feeding roller 11 is formed by a roller core 110 and a rubber portion 11*b* included on an outer layer of the roller core 110. The feeding rollers 11 are supported by the feeding roller shaft 1110, the feeding roller shaft 1110 is supported by the bearings 116 and 117, and the feeding rollers 11 and the feeding roller shaft 1110 engage with each other by a parallel pin and the like, for example, and are rotatable in an integrated manner. A feeding roller gear 1120 that transmits the drive force from the device main body to the feeding roller shaft 1110 is supported by the feeding roller shaft 1110. The feeding roller gear 1120 has a one-way clutch 1120*c* built therein. When the feeding roller gear 1120 rotates in the feeding direction (the direction of solid arrow D2 in FIG. 24), the one-way clutch 1120*c* meshes together with the feeding roller shaft 1110, and the feeding roller shaft 1110 rotates in the feeding direction (the direction of solid arrow D2 in FIG. 24).

The conveying speed of the feeding rollers 11 are set to a speed that is slower than the conveying speed of the conveying roller 21. Therefore, when the fed document S reaches the conveying roller 21 and the conveying speed increases, the drive transmission from the motor 3 to the feeding rollers 11 is cut off because there is the one-way clutch 1120*c*. Therefore, the feeding rollers 11 become able to freely rotate, and rotate together with the conveyed document S.

The movement of the feeding roller gear 1120 on the feeding roller shaft 1110 in the direction of solid arrow D12 (the direction approaching the feeding rollers 11) is restricted by bringing the feeding roller gear 1120 into contact with a slip prevention member 1190 fixed to the feeding roller shaft 1110. The friction disc 114 is in pressure contact with a side facing the slip prevention member 1190 across the feeding roller gear 1120 by the compression spring 115. The bearing 116 is in pressure contact with the compression spring 115, and is prevented from slipping out from the feeding roller shaft 1110 by the slip prevention member 118 fixed to the feeding roller shaft 1110. Other configurations are similar to the configuration of Embodiment 1. By the configuration, the rotation of the feeding roller gear 1120 is restricted by the restriction torque that occurs by the friction and the like with the friction disc 114.

Also in Embodiment 2, by restricting the rotation of the feeding roller gear 1120, the reverse rotation of the feeding rollers 11 can be suppressed, the feeding failure can be reduced, and the tap tone in the mesh portion between the feeding roller gear 1120 and the feed drive gear 73 can be prevented as with Embodiment 1.

In Embodiment 1 and Embodiment 2, a predetermined space between the sheets of paper is provided and the documents are successively conveyed by repeating the stopping and the rotation of the feeding rollers 11. However, the present invention is not limited thereto. A configuration in which the rotation of the feeding rollers 11 is continued, and the documents are successively conveyed by providing a space between the sheets of paper due to the speed difference between the feeding rollers 11 and the conveying roller 21 may be used. Also in that case, in a state in which the document is conveyed by the conveying roller 21 and the feeding rollers 11 rotate together therewith, the feeding roller gear can be prevented from rotating by the amount of backlash, and a problem in which a tap tone occurs by the rotation in the gap formed by the amount of backlash and the problem in which the leading edge of the document is curled can be prevented next time the feeding roller gear is driven by the feed drive gear 73.

Figure 38:
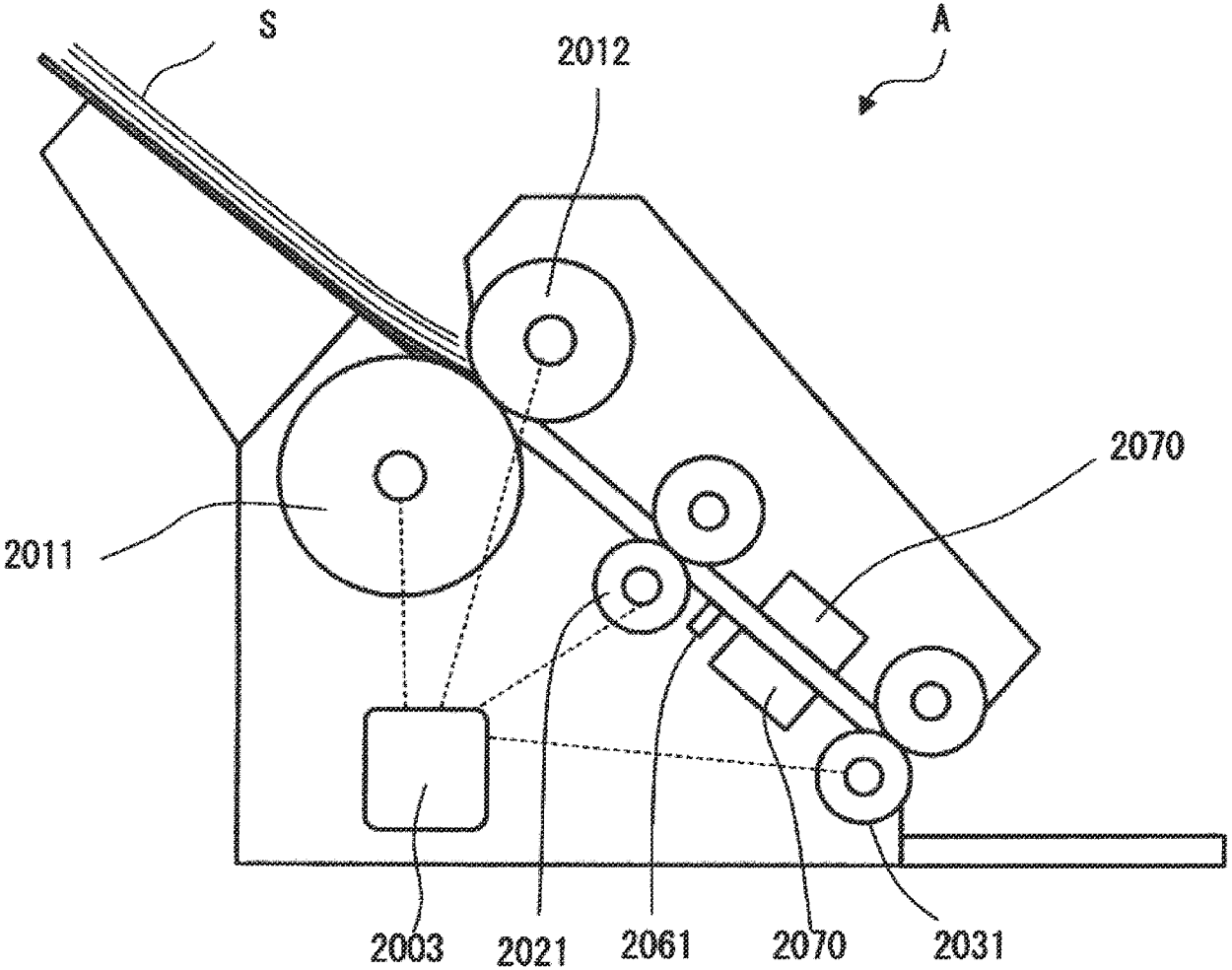
FIG. 38 is a schematic cross-sectional view of a document feeding device according to another Embodiment of Embodiment B.

In addition, in Embodiment 1 and Embodiment 2, two motors are used, but the present invention is not limited thereto. As illustrated in FIG. 38, a configuration in which a feeding roller 2011 and conveying rollers 2021 and 2031 are driven by a single motor 2003, the rotation of the feeding roller 2011 are continued, and the documents are successively conveyed by providing a space between the sheets of paper due to the speed difference between the feeding roller 2011 and the conveying roller 2021 may be used. In addition, a configuration in which the drive transmission of the feeding roller 2011 is performed by driving the feeding roller 2011 and the conveying roller 2021 by one motor, and providing one electromagnetic clutch between the motor 2003 and the feeding roller 2011 may be used.

In addition, the place in which the rotation of the feeding rollers 11 is restricted by the friction disc 114 and the like may be any place as long as the place rotates along with the feeding roller gear 112. For example, the place may be a position that corresponds to the feeding roller shaft 111 between a plurality of the feeding rollers 11, or may be on the bearing 117 side. In that case, the rotation restriction means such as the friction disc 114 only needs to be in abutment against the feeding roller shaft 111. In addition, as the rotation restriction means, not only the rotation restriction means in the thrust direction as with the friction disc 114, but also cylindrical rotation restriction means that is in pressure contact with the stepped gear and the like in the radial direction may be used. In that case, the rotation restriction means does not necessarily need to be in abutment against the inner portion thereof (for example, the feeding roller gear 112) along the entire circumference of the inner wall of the cylinder, and the contact area only needs to be set in accordance of the degree of the pressure contact.

The pressure contact means such as the compression spring brings the friction disc 114 and the like in pressure contact with the contact surface (contact place) may be provided in any place on the side of the main body of the document feeding device A in addition to the places described in the abovementioned embodiments.

Note that, in Embodiment 1 and Embodiment 2, an embodiment in which the friction disc 114 constantly biases the feeding roller gear 112 and the like is described, but the rotation of the feeding rollers 11 may be restricted at any timing from the timing immediately before the operation of the drive unit 3 stops to the timing at which the operation stops. In that case, a control unit for electrically controlling the friction disc 114 and the like only needs to be provided.

As the document feeding device, it is preferred that the diameter of the feeding roller 11 be a large diameter from viewpoint of durability, but the effect increases even more as the diameter of the feeding roller 11 increases in the present invention. In this embodiment, the diameter of the feeding roller 11 is about 40 mm. When the document is pushed back by the amount of backlash between the feeding roller gear 112 and the feed drive gear 73 by the separation roller 12, the distance by which the document is pushed back by the separation roller 12 increases as the movement distance on the surface of the feeding roller 11 increases when the distance of the backlash is the same.

For example, in the case of the feeding roller 11 of which size is that used in this embodiment, when the feeding roller gear 112 of which diameter is about 15 mm is used, the backlash is a little less than 1 mm at most. In that case, the surface of the feeding roller 11 (that is, the movement amount by which the document is pushed back) is pushed back by about 2.5 mm by the separation roller 12. The movement amount above is a degree at which the document retracts from the separation unit and a load is applied to the document when the document plunges into the nip between the feeding roller and the separation means again, and hence the present invention can be suitably applied.

The present invention is not limited to the above embodiments and various modifications can be made within the range of the technical idea of the present invention.

In conclusion, the present invention is as the following. A feeding device that forms a nip between separation means such as a separation roller or a separation pad and a feeding roller, and feeds sheets one by one while applying a separation force (friction force) on the sheets has a configuration in which a rotation drive force from a drive unit (motor) is transmitted to the feeding roller, and is characterized in that the difference between the rotational speed of a feeding roller shaft and the rotational speed of a drive transmission unit (feed drive gear) that transmits the drive force to the feeding roller shaft that occurs by external factors such as whether there is a document passing through the nip is reduced.

Specifically, when the rotational speed of a conveyance unit that conveys a document placed on the downstream side in the conveying direction is set to be faster than the rotational speed of a feeding roller gear, the rotational speed of the feeding roller increases by being pulled by and rotating together with the document, and a difference is generated between the rotational speed of the feeding roller shaft and the rotational speed of the drive transmission unit (feed drive gear) that transmits the drive force to the feeding roller shaft. This may also occur when a one-way clutch is provided between the feeding roller and the feeding roller shaft or between the feeding roller shaft and the feeding roller gear.

In more detail, a backlash is generated between the feeding roller gear and the drive transmission unit (feed drive gear) due to the generation of the difference between the rotational speed of the feeding roller shaft and the rotational speed of the drive transmission unit (feed drive gear) that transmits the drive force to the feeding roller shaft. In order to prevent the document from moving to the upstream side in conveying direction by a distance corresponding to the backlash by the reverse rotation of the feeding roller caused by the separation means, rotation restriction means for restricting the rotation of the feeding roller gear is provided, and an excellent meshing state is maintained between the feeding roller gear and the drive transmission unit in the process of conveying the document.

By the configuration above, the difference between the rotational speed of the feeding roller shaft and the rotational speed of the drive transmission unit (feed drive gear) that transmits the drive force to the feeding roller shaft can be reduced, and the document can be prevented from returning to the upstream side in the conveying direction together with the feeding roller by the separation means. In addition, a tap tone that occurs by the collision between the feeding roller gear and the drive transmission unit (feed drive gear) when the feeding roller rotates in reverse by the separation means can be reduced.

In addition, the present invention is also effective for a configuration in which, when a plurality of the feeding rollers are provided, a drag skew is prevented from occurring by providing one-way clutches separately between the rollers and the roller shaft. That is, by providing one-way clutches separately between the rollers and the roller shaft, a parameter (factor) for generating a load on the feeding rollers that intermittently occur increases in the process of the separation feed of the documents. However, by applying the configuration of restricting the rotation of the feeding rollers in the present invention described above, an excellent meshing state of the feeding roller gear and the drive transmission unit (feed drive gear) can be maintained between the gears for transmitting power to the feeding rollers, and hence an advantage is obtained in the stabilization of in the feeding performance. The description of Embodiment B is ended.

Embodiment A and Embodiment B of the present invention are described above, but the occurrence of the curling of the leading edge of the document and the like can be prevented more effectively by combining Embodiment A with Embodiment B as described in the description of Embodiment A. That is, the occurrence of the rising up (curling) of the leading edge of the document can be suppressed by the restriction member described in Embodiment A, and the document can be prevented from being fed in the opposite direction that is one of the factors of the occurrence of the rising up (curling) of the leading edge of the document by further using Embodiment B, and hence the occurrence of the rising up (curling) of the leading edge of the document can be prevented more reliably.

The present invention is not limited to the above embodiments and various modifications can be made within the spirit and scope of the present invention.

The invention claimed is:

1. A document feeding device comprising:

a feeding unit configured to feed a document from a batch of documents on a placing tray;

a separation member configured to be in pressure contact with the feeding unit and configured to separate documents one by one;

a separation swinging member configured to support the separation member and be displaceable in a thickness direction of the batch of documents when feeding the document;

a movable member:

configured to be supported by the separation swinging member so as to be displaced in the thickness direction of the batch of documents according to displacement of the separation swinging member when feeding the document, configured to be supported by the separation swinging member so as to be displaceable with respect to the separation swinging member in the thickness direction of the batch of documents when feeding the document, and configured to enter a space formed between the separation member and a document on an upstream side of the separation member with respect to a feeding direction of the feeding unit when feeding the document; and a biasing member configured to bias the movable member toward the feeding unit, wherein the movable member is always separated from the feeding unit, and a biasing force of the biasing member is set so that:

the movable member retracts in the thickness direction of the batch of documents when a heavy batch of documents is placed on the placing tray, and the movable member does not retract in the thickness direction of the batch of documents when a light batch of documents, which is lighter than the heavy batch of documents, is placed on the placing tray.

2. The document feeding device according to claim 1, further comprising a friction member provided on an outer periphery of the feeding unit, and configured to perform feeding while in close contact with the document, wherein the movable member is provided in a position facing the friction member.

3. The document feeding device according to claim 2, wherein:

the feeding unit includes a cylindrical portion that is rotatable with the friction member in an integrated manner; and the cylindrical portion is formed of a material having a lower coefficient of friction than that of the friction member, and an external diameter of the cylindrical portion is substantially the same as a diameter of the friction member.

4. The document feeding device according to claim 1, wherein the separation swinging member has an external surface that is substantially the same as an external surface of the separation member on an upstream side of the feeding unit with respect to the feeding direction when viewed from a direction orthogonal to the feeding direction.

5. The document feeding device according to claim 1, wherein the movable member includes:

a butt surface, which is substantially perpendicular to the feeding direction of the feeding unit and against which the batch of documents butts; and an inclined surface provided on the butt surface at a side of the feeding unit in the thickness direction of the batch of documents, and inclined toward a downstream side in the feeding direction.

6. The document feeding device according to claim 1, wherein:

the feeding unit includes:

a feeding roller;

a feeding roller shaft configured to rotatably support the feeding roller; and a feeding roller gear configured to be fixed to the feeding roller shaft; and the document feeding device further includes:

a drive unit configured to supply a rotation drive force to the feeding roller gear; and a rotation restriction unit configured to limit rotation of the feeding roller gear.

7. A document feeding device comprising:

a feeding unit configured to feed a document from a batch of documents on a placing tray, the feeding unit including a feeding roller, a feeding roller shaft configured to pivotally support the feeding roller, and a feeding roller gear configured to be fixed to the feeding roller shaft;

a separation member configured to be in pressure contact with the feeding unit and configured to separate the documents one by one;

a separation swinging member configured to support the separation member in a swingable manner and be displaceable in a thickness direction of the batch of documents when feeding the document;

a movable member:

configured to be supported by the separation swinging member so as to be displaced in the thickness direction of the batch of documents according to displacement of the separation swinging member when feeding the document, configured to be supported by the separation swinging member so as to be displaceable with respect to the separation swinging member in the thickness direction of the batch of documents, and configured to enter a space formed between the separation member and a document on an upstream side of the separation member with respect to a feeding direction of the feeding unit when feeding the document;

a biasing member configured to bias the movable member toward the feeding unit; and a rotation restriction unit configured to limit rotation of the feeding roller gear, wherein:

the movable member is always separated from the feeding roller, a rotation drive force of a drive unit is supplied to the feeding roller gear; and a biasing force of the biasing member is set so that:

the movable member retracts in the thickness direction of the batch of documents when a heavy batch of documents is placed on the placing tray, and the movable member does not retract in the thickness direction of the batch of documents when a light batch of documents, which is lighter than the heavy batch of documents, is placed on the placing tray.

8. The document feeding device according to claim 7, wherein:

the rotation restriction unit includes a sliding member that is in contact with the feeding roller gear and/or the feeding roller shaft; and the rotation of the feeding roller gear is limited by friction between the sliding member and the feeding roller gear or the feeding roller shaft.

9. The document feeding device according to claim 8, further comprising:

a feed drive gear configured to mesh with the feeding roller gear and transmit the rotation drive force from the drive unit to the feeding roller gear; and a one-way clutch configured to be provided between the feeding roller gear and the feeding roller shaft, wherein the rotation restriction unit limits the rotation of the feeding roller gear so as not to generate a difference in rotational speed between the feeding roller gear and the feed drive gear.

10. The document feeding device according to claim 9, wherein:

the rotation restriction unit includes a bearing pivotally supporting the feeding roller shaft; and the rotation of the feeding roller gear is restricted by friction between the feeding roller shaft and the bearing.

* * * * *